US007679479B2

(12) United States Patent
Edmonson, Jr.

(10) Patent No.: US 7,679,479 B2
(45) Date of Patent: Mar. 16, 2010

(54) MAGNETIC ASSEMBLY FOR MAGNETICALLY ACTUATED CONTROL DEVICES

(76) Inventor: Mahlon William Edmonson, Jr., 320 32nd Ave., Santa Cruz, CA (US) 09062

( * ) Notice: Subject to any disclaimer, the term of this patent is extended or adjusted under 35 U.S.C. 154(b) by 140 days.

(21) Appl. No.: 11/694,122

(22) Filed: Mar. 30, 2007

(65) Prior Publication Data

US 2007/0176718 A1 Aug. 2, 2007

Related U.S. Application Data

(62) Division of application No. 10/798,636, filed on Mar. 11, 2004, now Pat. No. 7,199,688.

(60) Provisional application No. 60/455,061, filed on Mar. 14, 2003.

(51) Int. Cl.
*H01H 9/00* (2006.01)

(52) U.S. Cl. ..... 335/207; 335/205; 340/574

(58) Field of Classification Search ..... 335/151–154, 335/205–207; 340/574
See application file for complete search history.

(56) References Cited

U.S. PATENT DOCUMENTS 4,039,985 A * 8/1977 Shlesinger et al. ..... 335/153
5,635,887 A * 6/1997 Fischette et al. ..... 335/205
5,668,533 A * 9/1997 Jackson et al. ..... 340/547
5,929,731 A * 7/1999 Jackson, Jr. ..... 335/207
7,019,607 B2 * 3/2006 Busch ..... 335/207

* cited by examiner

*Primary Examiner*—Anh T Mai
*Assistant Examiner*—Bernard Rojas
(74) *Attorney, Agent, or Firm*—Carella, Byrne, et al.; G. Glennon Troublefield

(57) ABSTRACT

A magnetically actuated apparatus, which enlarges, extends and makes continuous magnetic fields used by magnetically controlled devices, such as a magnetic reed switch for use in physical security monitoring systems is shown. Apparatus includes a sensor and a magnetic actuator for use with a movable closure member. The sensor is mounted into to a fixed support member that is arranged for displacement relative to a second movable support member. The sensor has a pair of contacts that are connectable to an electronic circuit. The contacts form a switch that is actuated by the magnetic actuator. The magnetic actuator comprises a unique elongated magnet with specific polarity or a plurality of aligned, alike permanent magnets that are mountable to the second support member. The aligned magnets have like magnetic fields that align one another and combine to form an effective magnetic actuation field that has a given magnitude and a given direction that is greater that the magnitude and direction than any one of the magnets. The elongated magnet has a specific pole for a given distance as its controlling means. The effective magnetic actuation field increases the distance in which the movable support member is displaceable relative to the fixed support member without changing the electric condition of the sensor. The present invention creates a magnetic apparatus, having a wider and controllable gap and break point distance not found in the present art.

10 Claims, 31 Drawing Sheets

FAULTED CONDITION

Prior art

Prior Art

Normal Circuit

Prior Art

Faulted Circiut

Prior Art

Normal Circuit

Normal Circuit PRIOR ART

Normal Circuit PRIOR ART

Faulted Circuit PRIOR ART

Normal Circuit

Normal Circuit

Faulted Circuit

FIG. 17 New Art Prior Art
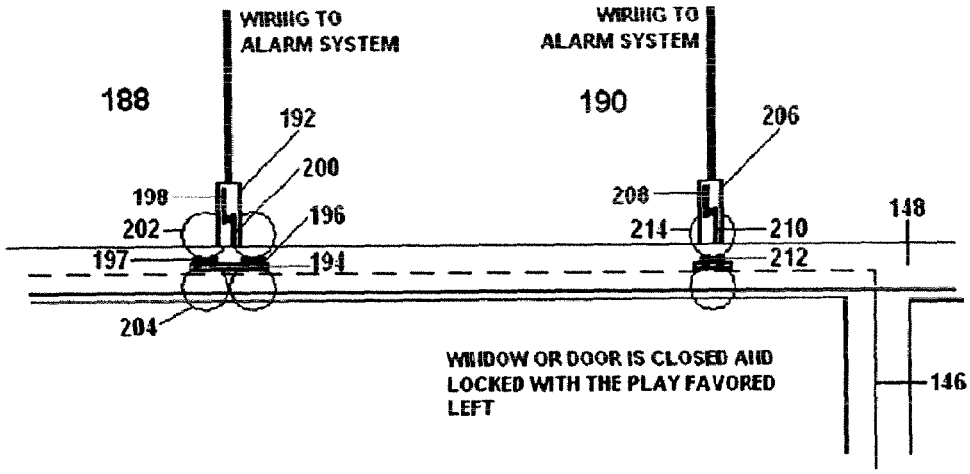
FIG. 18 New Art Prior Art
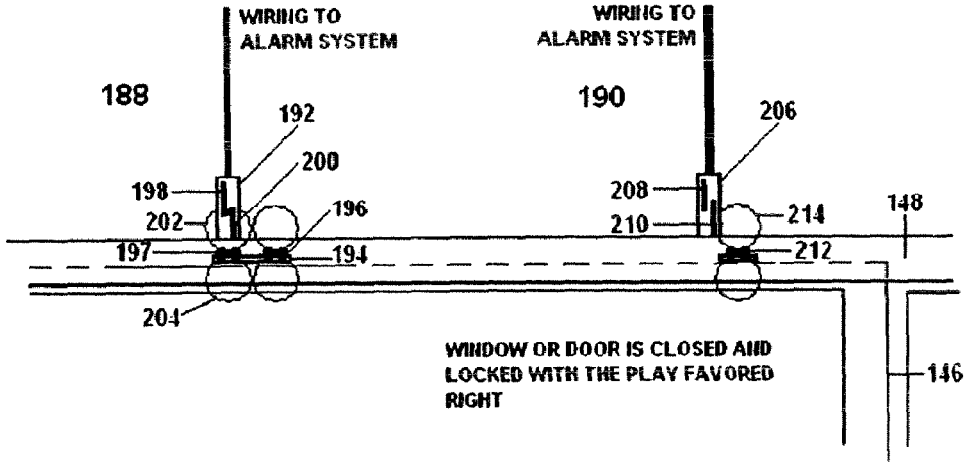

NEW ART OVERHEAD DOOR SWITCH

NEW ART OVERHEAD DOOR SWITCH

MAGNETIC ASSEMBLY FOR MAGNETICALLY ACTUATED CONTROL DEVICES

REFERENCE TO PRIOR APPLICATION

This application is a divisional application of U.S. Nonprovisional application Ser. No. 10/798,636, filed on Mar. 11, 2004, entitled "Magnetic Assembly for Magnetically Actuated Control Devices," in the name of Mahlon William Edmonson, Jr., which claims the benefit of U.S. Provisional Application No. 60/455,061, filed on Mar. 14, 2003, entitled "Magnetic Assembly For Magnetically Actuated Control Devises," in the name of Mahlon William Edmonson, Jr.

FIELD OF THE INVENTION

The present invention relates to magnetically actuated control devices. In particular, the present invention relates to an enhanced magnetic assembly for use with magnetically actuatable controlled devices, such as a magnetic reed switch used in a physical security monitoring system.

BACKGROUND OF THE INVENTION

Physical monitoring systems are well known in the art. Conventional monitoring systems typically comprise a reed switch that is electrically connected by wires to an electronic circuit, such as alarm or machinery control system. The reed switch generally comprises a cylindrical glass capsule containing a pair of electrical contacts disposed therein. Each contact is attached to a flexible or movable blade member (i.e., a reed) made of magnetizable material. The reeds are secured to a lead wire that is connected to an electronic circuit. In most applications, at least one of the reeds secured within the capsule is adapted to move toward or away from the other, normally fixed, reed.

A permanent biasing magnet typically actuates the reed switch. The magnet has a magnetic field that is used to magnetize one or both of the reeds, by increasing the magnetic flux in the vicinity of its magnetic portions. Once a reed is magnetized, it will either be attracted to or repel away from the other reed. The magnetization of the reeds is used to open and close the reed switch. When the magnetic flux is reduced, the magnetized reed returns to its normal, unmagnetized condition.

Reed switches are often used in conjunction with external electronic devices, such as security alarms and proximity devices, to name a few. In a typical application, the reed switch is electronically connected to an electronic circuit or loop that is used as a means to set or trigger the security alarm. The reed switch could be either in a normally closed state or a normally open state. In a normally open state, the individual pair of reeds are spaced apart from one another, such that the reed switch is opened. When the reed switch is open, electricity cannot flow through the reeds to the electronic circuit. In a normally closed state, the reeds are in close enough proximity to each other such that the reed switch is closed. When the reed switch is closed, electric current flows through the reeds to the electric circuit. Electrical conductors associated with the electronic circuit lead to a security alarm control unit that is used to set the alarm. The alarm is capable of being set depending on the condition of reed switch being opened or closed.

Proximity devices having reed switches controlled by permanent biasing magnets are typically mounted into movable closure structures. The reed switch is usually mounted in or about a fixed member, such as a frame surrounding a doorway, window, or access panel of a floor. The reed switch has conductors leading out from it to the security or monitoring control unit, such as an alarm control panel. The magnet is mounted into the movable member, such as a door or window that moves relative to the fixed member. The magnetic field of the magnet is used to operate the reeds by magnetizing one or both reeds to open or close the reed switch, thereby controlling the flow of electricity to the alarm. The reeds will remain magnetized or magnetically biased relative to the polarity of the magnetic field of the biasing magnet under which they are influenced. So long as the magnetic field is not moved to a distance in which the reeds are released and return to their normal unbiased or unmagnetized state, the electrical condition of the reed switch will not change. The distance in which the magnet is moved such that the magnetic field releases the reeds and causes the reeds to return to their normal unbiased state, defines the "gap" and "break distance" of the particular proximity device of which the reed switch and magnet are a part.

The gap and break distance for a particular proximity device has been established by industry standards based on acceptable mounting specifications, safety considerations, and market place acceptable. Acceptable gap distances range between 12.5 millimeters (½ inches) for standard gap mounts and 25.5 millimeters (1 inch) for wide gap mounts. However this is fine for protective openings that return to their exact closed position every time. Not all openings do this. Sliding glass doors and windows may have as much as a ½ to ¾ of an inch of movement in the locked closed position. This puts the industries standard right on the edge of operation.

In view of the relatively small tolerances presently used and accepted in the industry for gap and break distances, a problem exists in the use of prior art proximity devices in control devices and physical monitoring systems, such a security alarms. Proximity devices require careful alignment between the reed switch and the biasing magnet which are typically aligned parallel relative to one another along a common axis. In view of the relatively small gap and break distances between the reed switch and the biasing magnet, slight movement of the biasing magnet relative to the reed switch could allow the reeds to be released, resulting in an unnecessary "false alarm". An example of this problem is found in the use of proximity switches in an overhead door for a garage, as one example.

Overhead doors by design move from a closed position near a floor or a driveway to an open position to allow access to the garage. In both residential and industrial applications, lateral movement or play is designed into the overhead doors to allow the door to move left or right as it rides along its associated, opposed door tracks or guide rails. Manufacturers design play into the door to accommodate the realities of opening and closing a garage door. For instance, door manufacturers anticipate that as a door is opened and closed over time, the alignment of the door will change from its position when first installed simply put, the door will not return to its initial position relative to the floor when the door was first installed. This change in alignment particularly occurs in large industrial doors that are often motorized using an electric motor or lifting mechanism. The torque of the motors that are used to pull the garage door open, will cause the curtain segments of the door to shift laterally as it is being opened or, in some cases, being closed. In anticipation of this occurrence, door manufacturers design the doors or the curtain segments to move laterally as they are being opened or closed so that the door will not jam and thus overtax the electric motor or lifting mechanism.

The play that manufacturers design into garage doors is to keep the doors from binding in the tracks or rails when opening or closing the doors. The wider the door the bigger the lateral play. This can create a problem with proximity devices that require careful alignment for operational stability. After many operations of the door, the lateral shift will place the biasing magnet off from its initial, first installed alignment position that is normally parallel to the reed switch. Once the door shifts out of alignment, it is difficult, if not impossible to use the proximity device to set an alarm until the alignment is returned to at least the position when the proximity device was installed. Therefore, to set the alarm, the door will have to be physically realigned or shifted so that the biasing magnet will be in a position to bias the reeds to operate the reed switch. For example, some commercial doors are 25 feet long and may have as much as 2 inches of lateral play. Therefore, a customer will have to shift the door 1-½ inches or so, in order to set the alarm. Most customers, however, will call the security alarm service to advise of a problem with setting the alarm. The security alarm service usually instructs the customer to look at the door to make sure that the biasing magnet is aligned parallel to the reed switch that is typically mounted to the floor. However, to the untrained eye of many customers, it is difficult to identify the problem. To them the door is closed and secure, so something is wrong with the security alarm that was installed. As a result, the customer requires the security alarm service to fix the problem at its own costs. In reality, the security alarm service tries to pass the cost of security alarm servicing to the consumer in the form of a billable service call. It is not the service company's fault that the building has settled or the frame is out of alignment, which has changed the door's closed position. The service company feels justified in passing this labor cost on to the consumer.

Even if the door is initially aligned when the alarm is set, problems with the security alarm still might occur. It is possible for the garage door to move out of alignment after the door is locked and the alarm has been set. Do to the overhead door being out of square, or possibly because a forklift has accidentally adjusted the door during the day, adverse pressure may create binding pressure that may cause the door to move after the door has been closed and secured. The sudden and unanticipated movement of the door causes the biasing magnet to move out of alignment relative to the reed switch thereby creating a condition in which the alarm may trigger. In the security alarm industry, this is called "swinging" and can result in a false alarm. The shift can be little as ½ inch and thereby cause the reed switch to remain in the open state, creating what is known in the industry as a "can't set" condition. Although the shift in a large overhead door is very gradual, the same problem of swinging can still occur. For instance, it takes a long time for opening and closing pressure to shift the door segments of a commercial door. If a 15 foot tall door has curtain segments that have moved ½ an inch in three years, it moves that much closer to the swinging phenomena. If the door is 25 feet wide it may have as much as 2 inches of factory curtain play built into the design. It would be safe to say that particular type of door after 5 years or hundreds of operations, will move out of alignment such that the bottom rail that typically houses the biasing magnet does not land on the floor exactly at the same place it did the day that the security alarm was installed.

Also influencing the sensitivity of proximity devices and in particular, reed switches, is temperature. Temperature affects the metal reeds as well as the biasing magnets. Changes in temperature will make the material used for the reeds and the biasing magnet to contract and expand. An alarm system may set at the end of the day when temperatures are warmer and appear that all is normal. But a drop in temperature can make the reeds contract. For instance, in the example of the overhead door in which the security alarm is installed, the repeated movement or operation of the door can cause the door to move out of alignment relative to its initial position immediately after it was installed. As a result of the door moving out of alignment, the effective magnitude of the magnetic field that is generated by the biasing magnet which is used to bias the reed switch, is reduced. Thus, as explained previously, the gap or acceptable distance in which the door can move (e.g. laterally) without triggering the security alarm is reduced. As such, a drop in temperature might cause both the magnet and reed switches metals to contract sufficiently to result in a false alarm activation.

Accordingly, the contraction or expansion of the metallic material used to make the reeds or the biasing magnet can impact the location in which the reeds will be biased by the magnetic field of the biasing magnet. Therefore, a change in temperature can cause a change in the location of each reed located within the capsule. As a result, the change in temperature may make it difficult for the magnetic field of the biasing magnet to bias one or both reeds sufficiently to operate the reed switch and in turn the security alarm. The end result is that a change in the temperature can change the magnitude and direction of the magnetic field of magnet as well as the ability of the reeds to open and close the reed switch. For proximity devices and reed switches that operate with a relatively narrow gap, a slight change in the magnet may cause the reed switch to be aligned such that neither pole will have control of the reed switch. As a result, the alarm will not be able to be set or will trigger a false alarm activation.

Another weather related problem is the wind. Wind gusts might cause a garage door or window to move out of alignment after the alarm has been set. The door or window may move such that the magnetic field of the biasing magnet moves beyond the gap or break distance that is used for the particular proximity device. Again, this slight movement can result in a false alarm.

Adding to the problem of the sensitivity to proximity devices and reed switches, of the prior art, are the structure of the doors or windows themselves. New style vinyl windows and doors have large plastic frames. A window may appear closed to the eye when actually there may be a much as ½ to ¾ of an inch to fully close the opening. If the alarm switch is on the edge but sets at the time of arming the biasing magnet could release the switch later resulting in a false alarm activation.

Many door contacts and sliding windows have a weather seal. The last ½ to ¾ inch of closing requires more pressure to secure the point of contact, namely the seating of the door or window in the frame. Some individuals will attempt to close the opening, but will stop at the weather seal do to the responsive/opposing pressure they feel when hitting the weather seals. Thus, an individual might believe that the opening is closed when it is not. This last ½ to ¾ of an inch sits on the edge of the current arts gap tolerance. If the alarm sets with the opening in this position a false alarm activation could occur.

Accordingly, the precise alignment that is required to set and use a proximity device is a problem in the physical monitoring industry. Physical monitoring security systems that are commercially available in the alarm industry presently allow as little as ½ to 1 of play or movement before the switch cannot be set. However, not all magnets or proximity switches are mounted perfectly to all surfaces. This is a common occurrence in the security industry, where the volume of installation of security systems can take precedence over the precise alignment. It is known in the industry that a large number of subcontractors who install physical monitoring systems do so for the short term and are motivated to install the systems quickly and without sufficient care. These contractors are paid on a by the point basis. They receive a set amount of money on each protection point that is installed. So the faster they get the points installed the more money they make per hour. This can lead to some hurried installations with some alarm contacts not being precisely aligned. As a result, the biasing magnet might be just barely aligned relative the reed switch, so that the physical monitoring system will work. This puts the reed switch on the edge of being controlled by the magnetic field. However, the magnetic field will shift out of alignment and require possible resetting by repeated service calls, which is a cost that is often paid for by the consumer.

Although perfect alignment is not an absolute requirement, if the biasing magnet is out of alignment by ½ to ¾ of an inch of its preferred position, problems with setting the alarm and weather will have an increased impact on the ability to set the alarm. For example, the reduction in the temperature at night will cause the metal or other materials used as part of the door and switch to contract as noted previously. The contractions might cause the alignment of the reed switch relative to the biasing magnet to move even further. Therefore, even if the reed switch is aligned sufficient to set the alarm, that condition may change at night when the temperature drops. As the temperature drops, a false alarm might occur because the reed switch has moved out of alignment with the biasing magnet.

Because of the sensitivity of reed switches to slight or momentary movements and changes in temperatures, the reliability of proximity devices have been drawn into question. Today's alarm panels have very sensitive circuitry. Their reaction times are very quick, usually within tenths of a second. All a circuit has to sense is a slight movement in the contracts of a reed switch to generate an alarm. False alarms produced by slight movement of the reed switch relative to the biasing magnet leads to unnecessary multiple police responses and as well as fines incurred by the customer. The company responsible for the installation of the alarm in order to maintain the customer relations in good standing usually pays these fines upon realizing that their installation is at fault. In addition to the fines, the number of times a false alarm is triggered causes police and other law enforcement personnel to direct their attention away from other tasks as well as putting themselves and the public at risk during the response.

Furthermore, each time a false alarm occurs, a technician might be required to realign the relative position between the reed switch and the biasing magnet. This becomes costly and reduces the ability to discern whether an alarm is triggered because of an intruder or because of some other reason. Many cities have adopted special ordinances to combat false alarm problems. In addition, in a number of communities, residents have formed committees to combat the problem of false alarms in their neighborhood and the resulting injuries and hazards that are suffered by police and others in responding to false alarms. Indeed, municipalities have imposed significant fines to ensure a resolution is addressed to a repetitive false alarm problem. Some responding agencies have adopted a no response policy unless verified. This requires a second or third party to respond first and identify that a real crime is occurring, before the local police agency will respond.

Prior art solutions to the problem with proximity devices have been unsuccessful in resolving lateral shifting problems associated with magnetic reed switches. The industry has been known to use larger magnets. These are combined with reed switches and are referred to as wide gap contacts. They do offer a larger gap distance to control the distance but only in the vertical lift distance. The problem with lateral slide play cannot be addressed by the wide gap switches. The problem resides in the physics of the poles of the magnet. As the magnet moves, one pole looses control of the reed. The other pole starts to cross the center of the reed, when the pole is near the center of the parallel reed it cannot maintain control of the reed. The closer to the center the less field strength the magnet has to hold the reed's stability. This, combined with the fast speed of the alarm circuit, is where unnecessary false alarms are generated. There are many different types of openings that require proximity protection that have factory designed lateral play built into the normal operation. Many of these openings play exceed the industry gap control distance. Airplane hangers, barn doors, large commercial steel sectional curtain overhead doors and double sliding glass doors to name a few.

Other attempts to solve the problems associated with reed switches and proximity devices have been by manipulating the location and use of the biasing magnets. For instance, Holce, U.S. Pat. No. 4,213,110 shows a proximity switch having adjustable sensitivity. The sensitivity of the reed switch is adjusted by varying the position of the biasing magnet. Varying the position of the biasing magnet adjusts the distances between the switch and the biasing magnet at which the switch will actuate and release for a given actuating magnet. Holce teaches that by adjusting the distance of the biasing magnet, smaller magnets for a given separation makes the device less expensive to produce, more easily concealed from sight, and more difficult to detect. However, Holce does not teach how to better control the sensitivity of the proximity devices through the use of an improved magnetic assembly that is relatively low in cost. Also, Holce does not teach the use of an enhanced magnetic assembly that provides the flexibility to design the amount of gap or location of the break distance that is desired, beyond present industry standards.

Therefore, it is desired to provide a magnetic apparatus to increase and control the gap or break distance used for proximity devices, particularly those used in physical security monitoring or position control systems. In particular, it is desired to provide an enhanced magnetic assembly, comprising the use of multiple, aligned alike magnets to control external electronic devices, such as a physical security monitoring system. Still yet, it is further desired to provide a magnetically operated system that is adjustable, creates a wider gap, and is inexpensively manufactured. It is also desired to provide a magnetic assembly to create a wider gap to permit the venting of a room, yet maintain the electrical condition of the physical security monitoring system. These and other features of the present invention are described in further detail below.

SUMMARY OF THE INVENTION

A magnetically actuated apparatus for use with magnetically controlled devices is provided. The apparatus is mountable to a movable closure member, having a fixed support member and a movable support member that are displaceable relative to one another. The apparatus comprises a sensor that is mounted to the fixed support member and a magnetic actuator mountable to the movable member. The sensor has a pair of contact members that are connectable to an electronic circuit. The contact members form a switch that is actuated by the magnetic actuator. The magnetic actuator preferably comprises a plurality of aligned, alike biasing magnets. The magnets have like magnetic poles that combine to form an effective magnetic actuation field that has a given magnitude and a given direction that is greater than the magnitude and direction of any one of the magnets. As an alternate embodiment, the magnetic actuator comprises an elongated magnetic bar that has unique specific polarization that may be used to actuate the sensor. In operation, the effective magnetic actuation field of the magnetic actuator increases the distance in which the movable member is displaceable relative to the fixed member without a change in the electric condition of the sensor.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIGS. 17 and 18 are isolated front plan views of the window assembly shown in FIG. 16, illustrating the operation of the control device and enhanced magnetic actuator of the present invention, relative to the prior art proximity device.

DETAILED DESCRIPTION OF THE DRAWINGS

Turning now to the drawings, where like numerals represent like elements, there is shown embodiments of the present invention that are presently preferred. The present invention is directed to a magnetically actuated apparatus, having an enhanced magnetic assembly which enlarges, extends and makes continuous the magnetic field used by control devices, such as a magnetic reed switch device or a proximity device that is used in physical security alarm monitoring systems, machine controlled systems and the like. The magnetic assembly of the present invention contemplates the use of multiple aligned, alike magnets with overlapping magnetic fields or an elongated magnetic actuator with specific polarity that are used as a means to actuate the controlled device. The multiple aligned alike overlapping magnetic fields may have a non-magnetic bar or plate to act as an influence on the control of the magnetic fields. The magnets that create the multiple aligned alike overlapping magnetic fields are mountable in many types of housings, plastics, resins, foam, and non-ferocious metals such as cast aluminum or even wood. As detailed below, the magnetic assembly of the present invention, when combined with a magnetically or electro-magnetically actuated sensor, such as a magnetic reed switch adapted to interact with the overlapping magnetic field, defines a new type of proximity device that is an improvement over prior art proximity devices that are presently commercially available.

PRIOR ART DEVICES

Figures 1A, 2, 3:
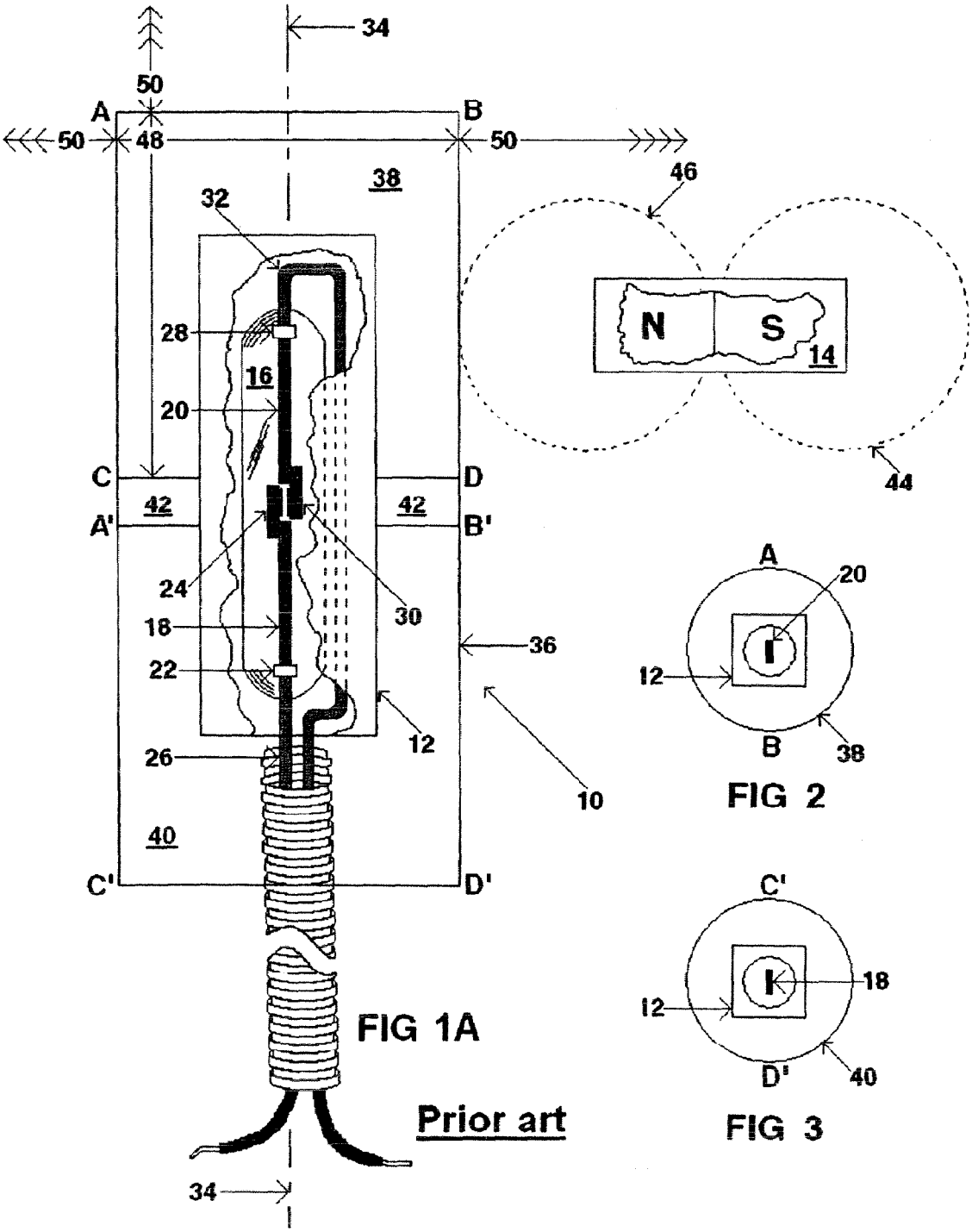
FIG 1A Prior art
FIG. 1A is a plan view of a prior art proximity device comprising a reed switch in an open condition and a biasing magnet on a given side, with portions of the reed switch broken away to show internal components.
FIG. 2 is an isolated top plan view of the reed switch shown in FIG. 1A.
FIG. 3 is an isolated bottom plan view of the reed switch shown in FIG. 1A.
Figure 1B:
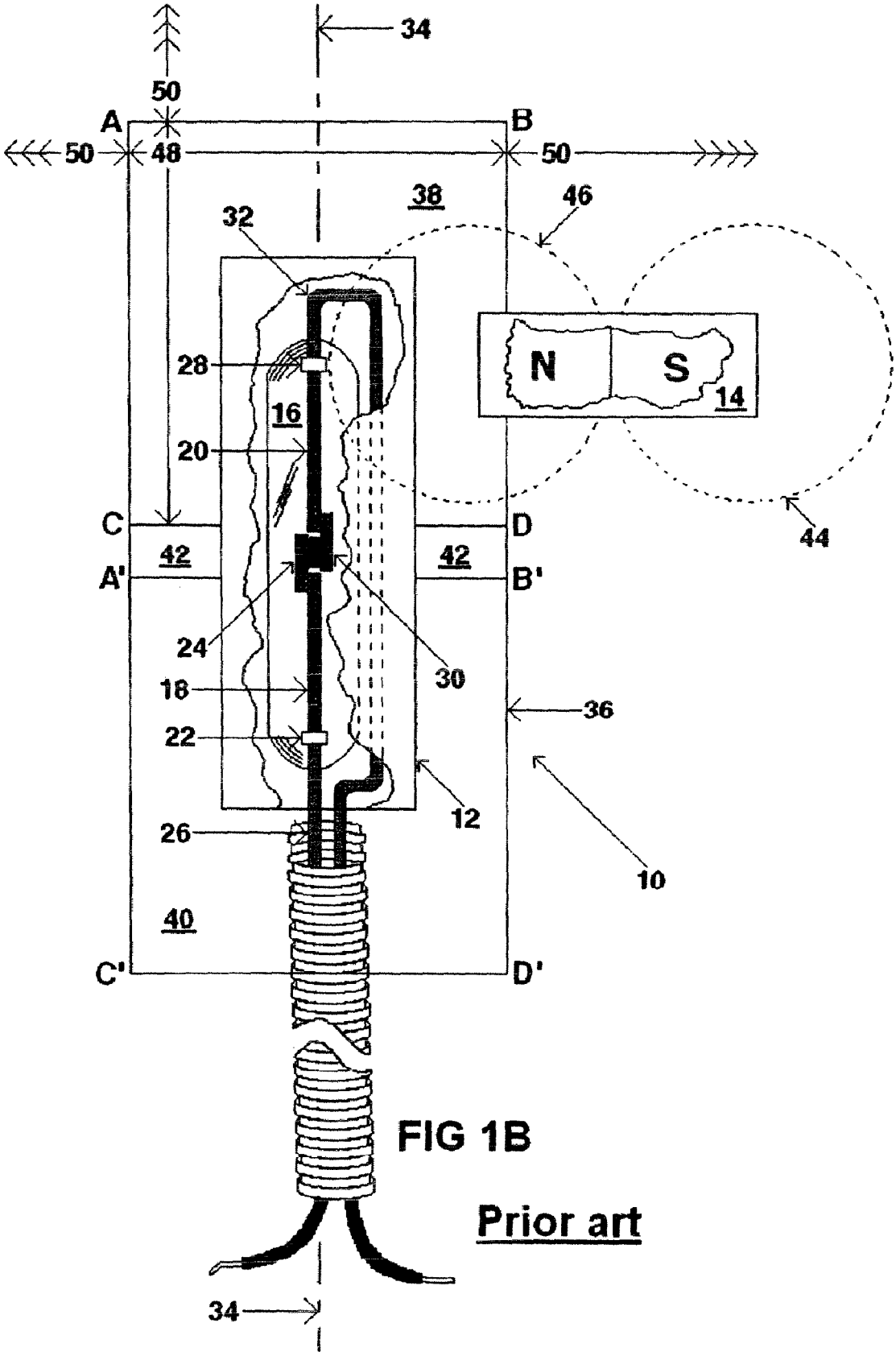
FIG 1B Prior art
FIG. 1B is a plan view of the prior art reed switch and biasing magnet shown in FIG. 1A, illustrating the reed switch in a closed condition relative to the position of the biasing magnet.
Figure 1C:
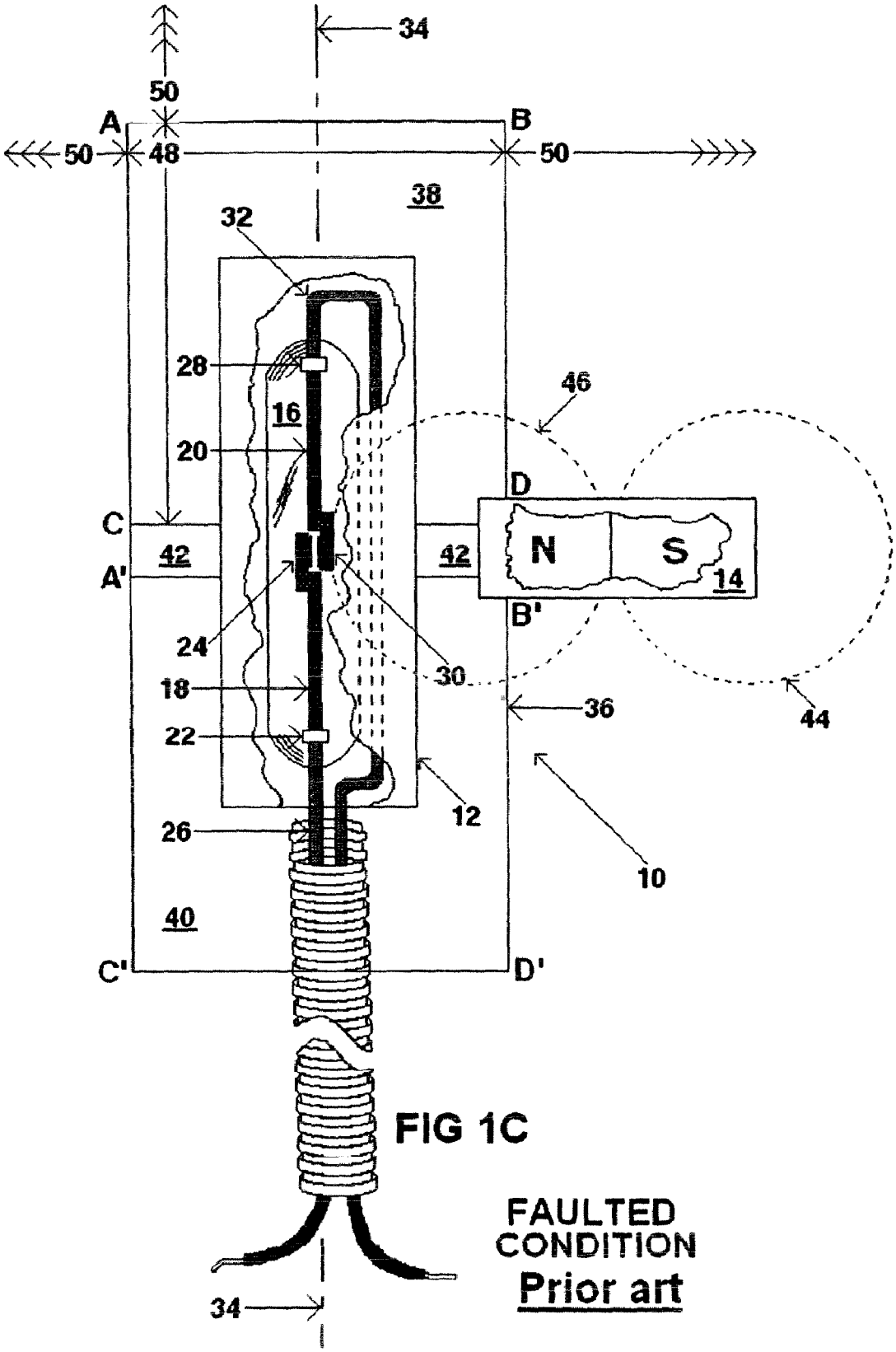
FIG. 1C is a plan view of the prior art reed switch and biasing magnet shown in FIG. 1A, illustrating the reed switch in a faulted condition relative to the position of the biasing magnet.

FIGS. 1A, 1B, and 1C show a prior art proximity device designated generally as 10. FIGS. 1A, 1B, and 1C along with FIGS. 2 and 3 are provided to explain the activation of the prior art proximity device, relative to a magnet field. The proximity device 10 comprises a reed switch 12 and a permanent magnet 14 shown in space relation to one another. The reed switch 12 has an elongated, cylindrically shaped glass capsule or tube 16 having a pair of magnetic reeds 18 and 20 positioned along a longitudinal axis 34.

Reed 18 can be fixed having a first end 22 and a second end 24. The first end 22 is secured to a wire 26 that is connected to one end of an electric circuit (not shown). The second end 24 of reed 18 is free, forming a contact that is used to electrically connect to reed 20. Reed 20 is movably disposed within the glass capsule 16 and also has a first end 28 and a second end 30. End 28 is connected to a wire 32 that projects outwardly through the capsule 16. The wire runs along the reed switch 12 until it connects to a second end of an electric circuit (not shown). The second end 30 is free and defines a contact that is adapted to move within close proximity to and electrically connect with reed 18.

The reed switch 12 shown in FIG. 1A is in a normally open state. In the open state, the reeds 18 and 20 are spaced apart sufficiently so that electric current cannot flow through the reed switch 12 to the electronic circuit. When rood switch 12 is in a closed state, reeds 18 and 20 touch or interact with each other about contacts 24 and 30, to permit electric current to flow through the reed switch 12 to the electric circuit.

A biasing magnet 14 controls the opening and closing of the reed switch 12. Reed switch 12 interacts with magnet 14 through a magnetic actuation field 36. Field 36 is broken in to quadrants or zones 38 and 40 to illustrate the operation of the reed switch 12 and the limitations of the prior art. Zone 38 is defined by an imaginary line connecting points A, B, C, and D. Zone 40 is defined by an imaginary line connecting points A', C', D', B' and A'. Intermediate zones 38 and 40 is a neutral, non-actuation zone defined by an imaginary line connecting points A', B', D, and C.

As viewed from the top looking down (See FIG. 2), zone 38 surrounds reed 20 in about an approximately 360° radius around the reed switch 12. The sides of zone 38 extend downwardly from the top and terminate at an end defined by the imaginary line connecting points C and D (See FIG. 1). Zone 40 is similar to zone 38. As viewed from the bottom looking upwardly (See FIG. 3), zone 40 surrounds reed 18 in about an approximately 360° radius around the reed switch 12. The sides of zone 40 extend upwardly toward zone 38 and terminate at an end defined by the imaginary line connecting points A' and B'. Both zones 38 and 40 are provided to illustrate that the reeds 18 and 20 will become biased under the influence of a magnetic field in a 360° radius around the reed switch 12.

Zone 42 represents an area in which no actuation or biasing of the reeds will occur. If a magnetic field enters zone 42, the magnetic field will induce increased magnetism in both reeds 18 and 20, thereby causing them to repel away from each other. When the reeds 18 and 20 repel away from each other, the reed switch 12 will assume its open state.

Magnet 14 is disposed in a plane that is normal to longitudinal axis 34. Magnet 14 is any permanent magnet having opposite polarities (i.e., a north pole and a south pole). The polarities are marked by "N" for north and "S" for south. As illustrated in FIG. 1A, the north and south poles of magnet 14 creates magnetic fields 44 and 46, respectively, that extend radially outwardly from about approximately the center portion of the magnet. Magnetic fields 44 and 46 have a given magnitude and a given direction that is defined by the magnetic flux (i.e. strength) of the magnet 14. As used herein, the magnitude of the magnetic flux that is created by a pole of a magnet is a measure of the quantity of magnetism, being the total number of magnetic lines of force passing through a specified area in a given magnetic field. The quantity of magnetism is dependent upon such factors as the given magnetic domain structure and size of the magnet. Also influencing the magnitude and direction of the magnetic flux is the material used to make the magnet, which is defined by its intrinsic coercive force measured in ostereds. Those of ordinary skill in the art are familiar with the factors appurtenant to the selection and strength of magnets, such that further discussion is not necessary.

When magnet 14 is close enough to reed switch 12, magnetic field 46 increases the magnetic flux density around reed 20 to magnetize it. Once reed 20 is magnetized, reed 18 will itself create a magnetic field that will be magnetically attracted to reed 18, thereby causing reed 20 to move close enough to reed 18 to close the reed switch 12. The distance that magnetic field 46 moves relative to actuation zone 38 defines an actuation gap 48 and break distance 50 for the reed switch 12. Gap 48 and break distance 50 are measured between the face of a housing (not shown) for the magnet 14 and the reed switch 12. Acceptable gap and break distances between the magnet 14 and reed switch 12 have been established by industry standards based on customary mounting specifications, safety considerations, and market acceptance.

For instance, as illustrated in FIG. 1B, so long as magnetic field 46 remains within zone 38 (defined by the imaginary line connecting points A to C to D to B and to A), reed 20 will remain biased. However, if magnet 14 is moved sufficiently so that magnetic field 46 clears zone 38, the reed 20 will relax back toward the unmagnetized state, thereby opening the reed switch 12, as shown in FIG. 1A. Similarly, if magnet 14 is move sufficiently so that the magnetic field 46 crosses into zone 42, then the magnetic material of reeds 20 and 18 will repel away from one another, thereby moving the reed 12 to the open state. The point in which the reed switch 12 assumes an open state from the closed state is the break point distance 50.

As shown in FIG. 1B, gap 48 of the prior art proximity device substantially coincides and approximates the actuation zones 38 and 40. Moving magnet 14 within either zone 38 or 40, the magnetic field 46 will magnetize either reed 18 or 20, depending upon which zone 38 or 40 the magnetic field 46 that is disposed. For instance, moving magnet 14 downwardly (i.e. toward the bottom of the paper) within a plane that is parallel to reed switch 12 will cause magnetic field 46 to also move. Once magnetic field 46 crosses into zone 42, the reeds 18 and 20 will become magnetized with the same polarity and repel away from each other and the reed switch 12 will change to the open state, as shown in FIG. 1C. The point in which reeds 18 and 20 repel away from defines part of the break distance and creates "faulted condition" of the reed switch 12. Likewise, moving magnetic 14 is moved upwardly (i.e., toward the top of the paper) or laterally away from the reed switch 12 (i.e., toward the right side of the paper) will also move magnetic field 46. Moving magnet 14 so that magnetic field 46 no longer intersects or is disposed within zone 38, reed 20 will be released and will resume its unmagnetized state and the reed switch 12 will move to its open state.

Figure 1D:
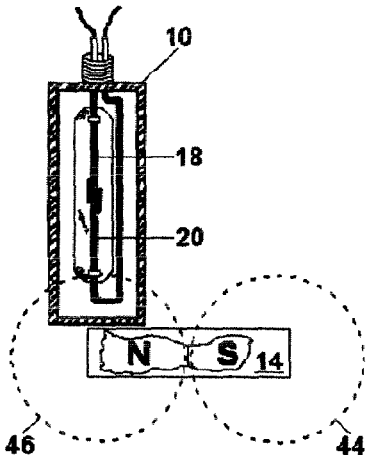
FIGS. 1D, 1E, and 1F are section views of the prior art proximity device shown in FIG. 1A, illustrating the change in the circuit associated with the proximity device from a normal circuit, to a faulted circuit, back to a normal circuit as the as the magnet assembly Is moved from right to left.
Figure 1E:
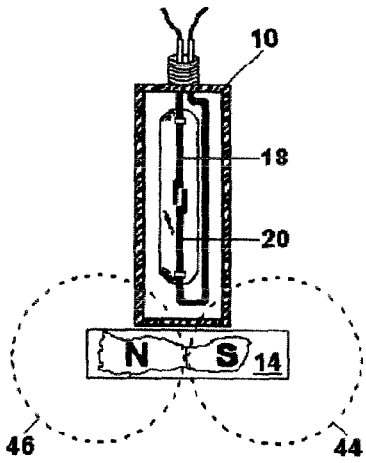
Figure 1F:
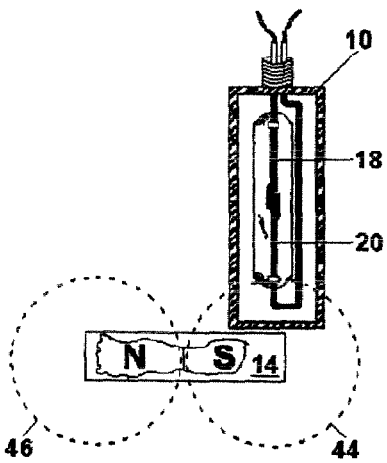

Those of ordinary skill in the art will understand the limitations associated with the current art proximity device 10 that is shown in FIGS. 1D, 1E, and 1F. FIGS. 1D, 1E, and 1F illustrate the effect on the circuit (not shown) that is associated with proximity device 10, when magnet 14 is moved from right to left. As shown in FIG. 1D, the magnet 14 is perpendicular to reed switch 12. In the position shown the magnetic field 46 is biasing reed 20. For illustration purposes, FIGS. 1D, 1E, and 1F show a proximity device as used with a closed loop electrical circuit, or a normally closed circuit. In FIG. 1E as the magnet is moved to the left, magnetic field 46 (north) is out of range to bias reed 20. Also shown in FIG. 1E magnetic pole 44(south) has yet to bias reed 20. This illustrates an open reed switch 12 which in a closed loop circuit is a faulted circuit. In FIG. 1F the closed loop circuit has returned to normal. What is illustrated here is that slight movement to a magnet that is perpendicular to a reed switch can cause a false alarm. If the alignment to the switch is toward the center of the magnet, the greater the potential for a no set to the alarm system or a false alarm if the alarm has been set. Based on the size of the magnet this slight movement could be less than ½ an inch. Most doors and windows have as much as ½ to ¾ of an inch of movement in the lock position. If a reed switch is mounted toward the center of the magnet it puts the switch on the edge of falsing.

Figure 4:
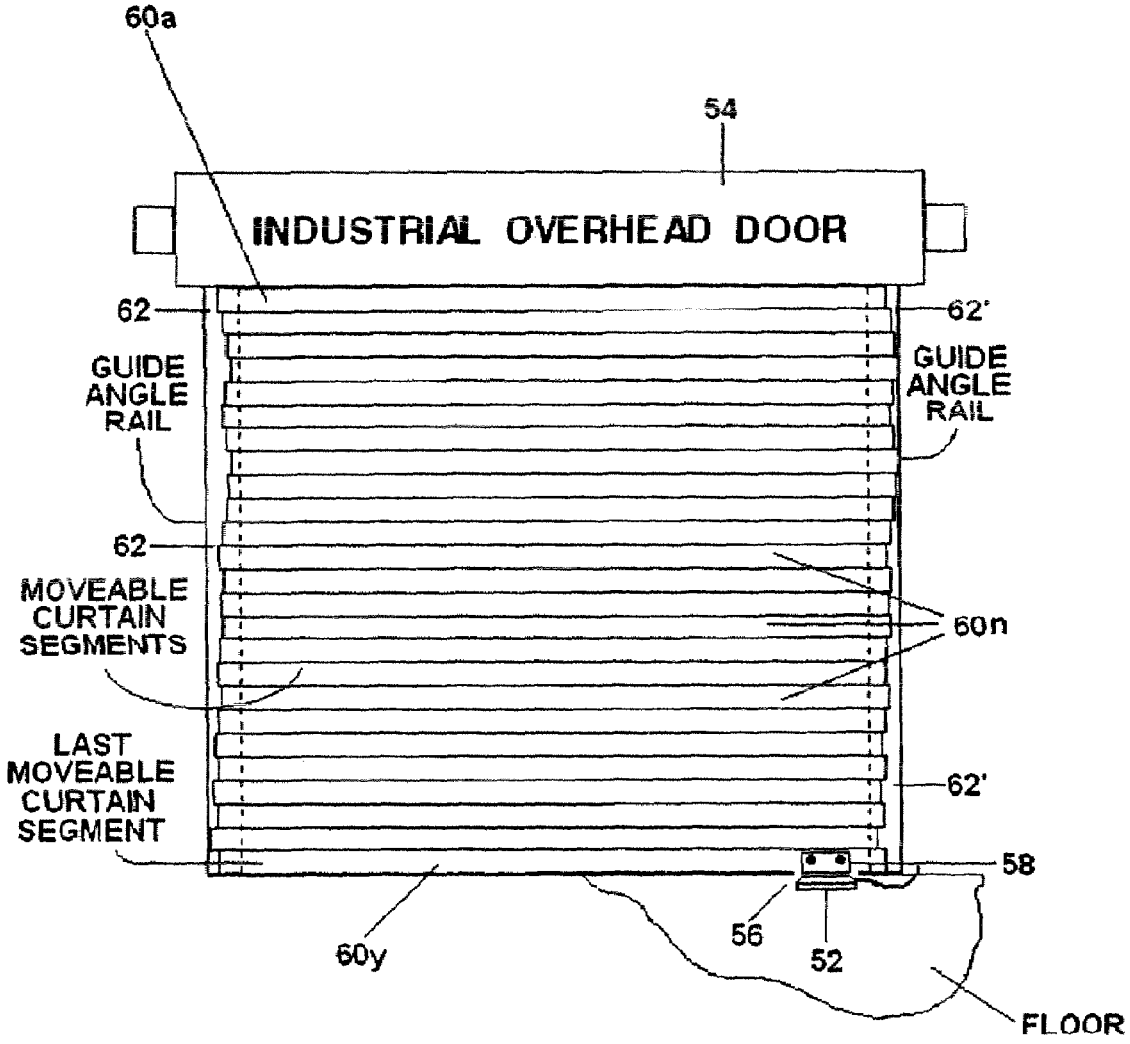
FIG 4. PRIOR ART
FIG. 4 is a plan view of an industrial overhead garage door having a prior art proximity device mounted thereon as seen from the rear or interior of a building, in which the proximity device comprises a prior art reed switch and a magnet assembly installed in space relation to one another.

FIG. 4 shows another prior art proximity device 52 installed with an overhead door 54 that is used as part of a physical monitoring system, such as an alarm. The prior art proximity device shown in FIG. 4 is representative of 90% of industrial applications. The overhead door 54 has a plurality of curtain segments 60*a* to 60*n* (where "n" represents an infinite number of segments) that are movably jointed to one another to define the door 54. The curtain segments are capable of sliding or moving laterally from one side to the other, independent of other segments. This movement is known in the overhead door industry as "play". Manufacturers use "play" to allow the curtain segments 60*a* to 60*n* move freely relative to one another as door 54 rides along opposed side tracks 62 and 62'. Mounted at the base of the door 54, near the lower most segment 60*y*, is the prior art proximity device 52.

Figure 5:
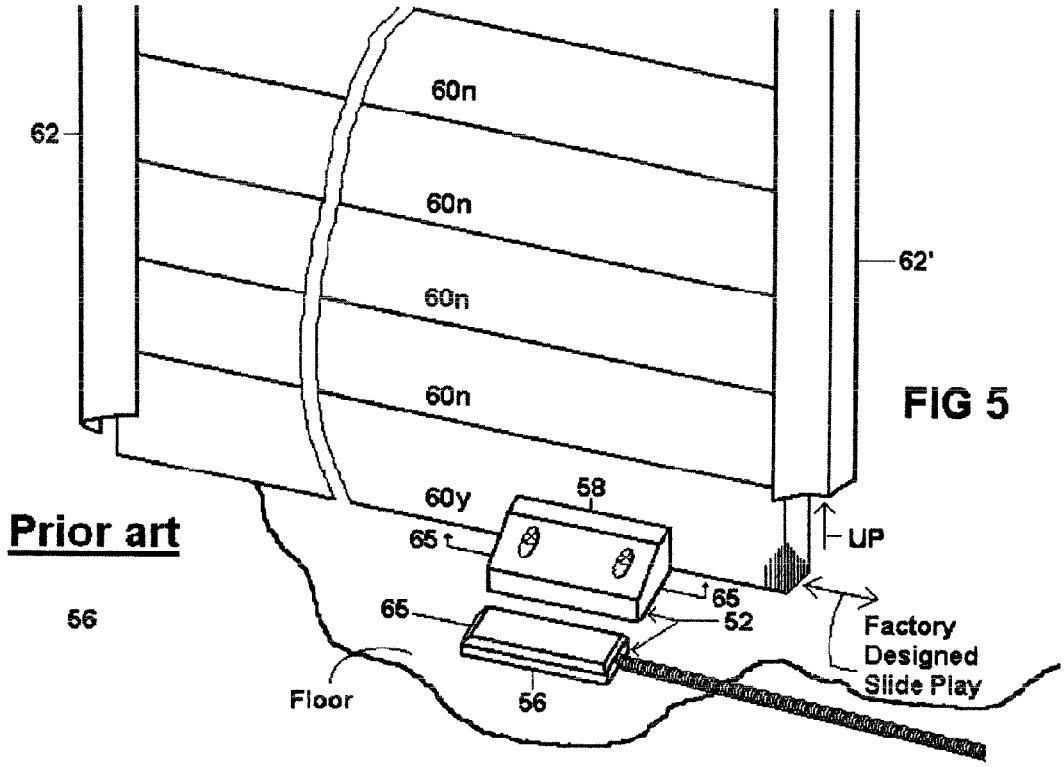
FIG. 5 is an isolated perspective view of the prior art proximity device shown in FIG. 4, relative to the overhead garage door.
Figure 6A:
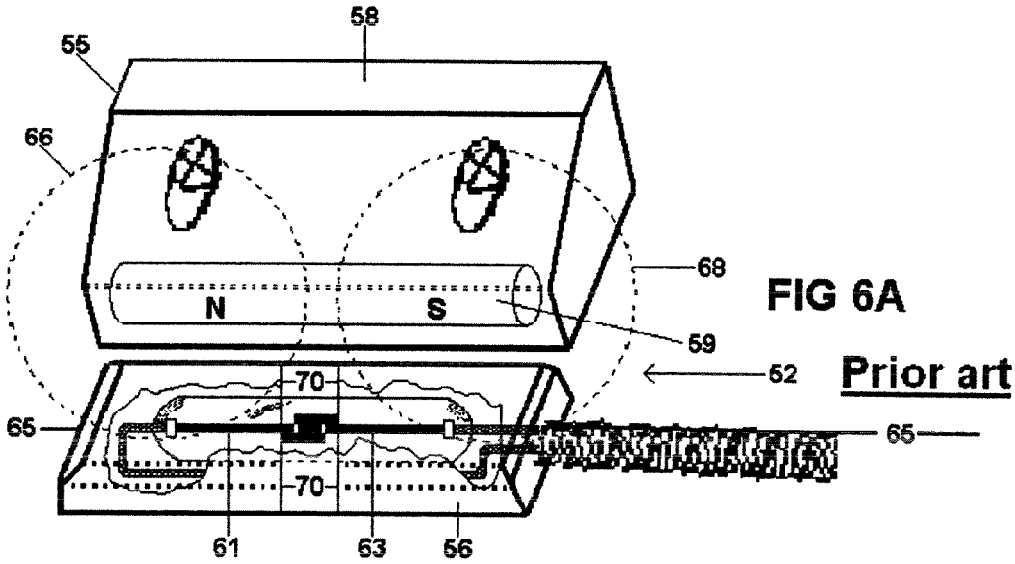
FIG 6A Prior art
FIG. 6A is an isolated perspective view of the prior art proximity device shown in FIG. 5, with a portion of the reed switch broken away to show internal components.

As best seen in FIGS. 5 and 6A, proximity device 52 has a magnet assembly 58 aligned in parallel to a reed switch 56. The parallel alignment of the magnet assembly 58 relative to reed switch 56 is typical of many proximity devices that are commercially available from a number of manufacturers. In this alignment as shown in FIG. 6A, reeds 61 and 63 are disposed in planes that are parallel to a longitudinal axis 65 of the reed switch 56. Each reed is made of material that is capable of being magnetized in the presence of a magnetic field. The magnetic field is generated by magnetic assembly 58 that is attached to the lower most curtain segment 60*n* by screws or other means.

A permanent biasing magnet 59 of magnetic assembly 58 actuates switch 56. The permanent magnet 59 is adhesively attached to a support housing 55. Magnet has a north pole 66 (designated by the letter "N") and a south pole 68 (designated by the letter "S"). Each pole generates a magnetic field such as 66 and 68 that are used to magnetize reeds 61 and 63. Where magnet 59 and reed switch 56 are in proximally alignment relative to one another, field 66 magnetizes reed 61 and field 68 magnetizes reed 63, thereby placing reeds 61 and 63 and switch 56 in a closed state. In the closed state, electric current is capable of flowing through switch 56 to an electric circuit (not shown).

Those of ordinary skill in the art will understand limitations of proximity device 52. Proximity devices 52 of the type illustrated in FIGS. 4, 5 and 6A are commonly installed in industrial overhead doors and other commercial applications. The application of proximity device 52 requires careful alignment so that the magnet assembly 58 is axially aligned and in its proper space relation to switch 56. However, slight movement of the magnetic assembly 58 relative to switch 56 will move magnetic fields 66 and 68 out of alignment relative to reeds 61 and 63. As a result, the slight movement of magnet assembly 58 with as little as an inch or so to the right or left will cause the electric condition of switch 56 to change. The change in the electric condition of switch 56 can trigger a false alarm.

As another example, the lower most curtain segment 60*n* can shift out of alignment relative to the floor when the door 54 is opened and closed numerous times. If curtain segment 60*n* shifts far enough out of alignment to the right, as one example, the magnetic fields 66 and 68 will also shift to the right. As the magnetic fields 66 and 68 shift to the right, the north magnetic field 66 will enter neutral zone 70 and reeds 61 and 63 will be biased by the same magnetic field and, thus, repel away from one another. Once the reeds 61 and 63 repel away from one another, the switch 56 will assume the open state. Once in the open state, the alarm cannot be set or if the alarm is on will trigger a false alarm.

Figure 6B:
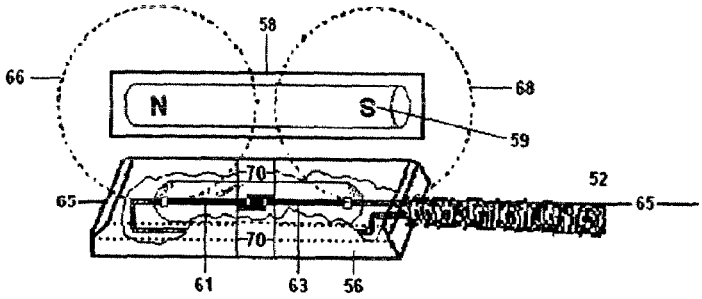
FIGS. 6B, 6C and 6D are isolated views of the prior art proximity device shown in FIG. 6A, illustrating the change in the circuit associated with the proximity device from a normal circuit to a faulted circuit in response to the movement of the magnet assembly from left to right, with a section view of the biasing magnet taken along line 65 in FIG. 6A and portions of the reed switch broken away to show internal components.
Figure 6C:
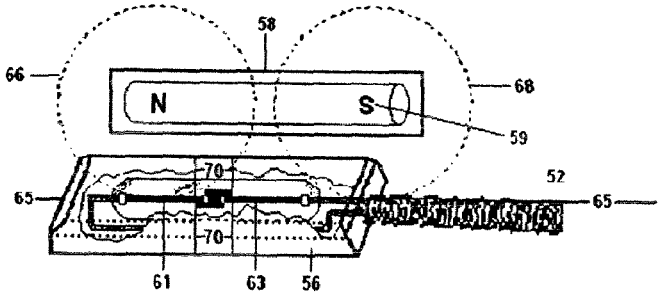
Figure 6D:
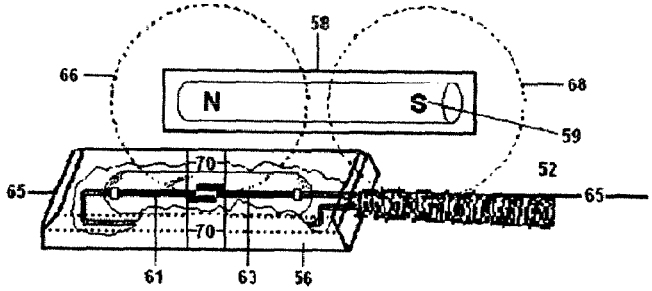

FIGS. 6B to 6G, illustrate the effect on the electronic circuit (not shown) that is associated with the reed switch 56, when the magnet 58 is moved from the left to the right. As shown in FIG. 6B, the magnet 58 is parallel to switch 56. In the position shown, the magnet fields 66 and 68 bias different sides of the switch. That is, magnetic field 66 biases reed 61 and magnetic field 68 biases reed 63, such that the reeds 61 and 63 are magnetically attracted to each other and the circuit associated with the switch 56 is in a normally closed state. As the magnet 58 is moved to the right, the magnetic fields 66 and 68 also moved, as shown in FIG. 6C. However, if the magnet 58 is moved laterally too far to the right, one of the magnetic fields, such as field 68, will no longer be in a position to magnetically influence reed 63. Rather, magnetic field 66 is in a position to bias both reeds 61 and 63. As a result, the reeds 61 and 63 repel away from each other and the circuit is in a faulted condition, as illustrated in FIG. 6D. This faulted condition results in the inability to set the alarm. If the alarm system was on prior to the shift, then a false alarm would be generated.

Figure 6E:
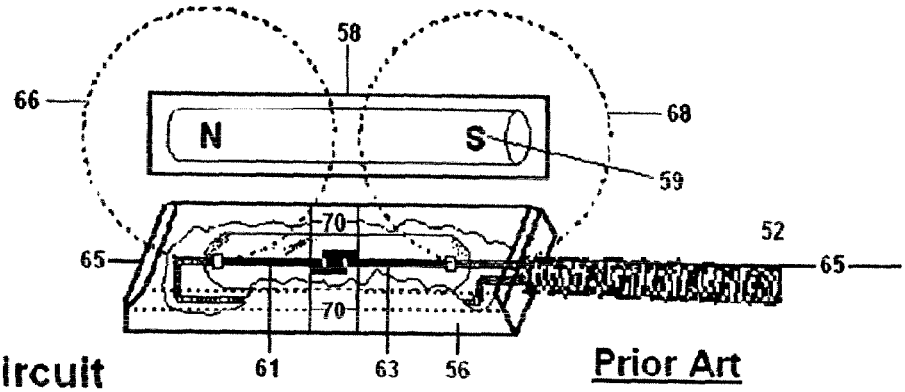
FIGS. 6E, 6F, and 6G arc section views of the prior art proximity device shown in FIG. 6A, illustrating the change in the circuit associated with the proximity device from a normal circuit to a faulted circuit as the as the magnet assembly is moved from right to left.
Figure 6F:
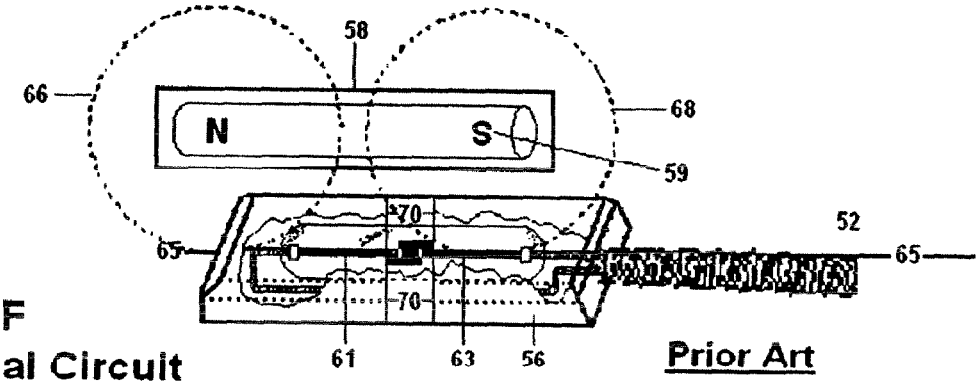
Figure 6G:
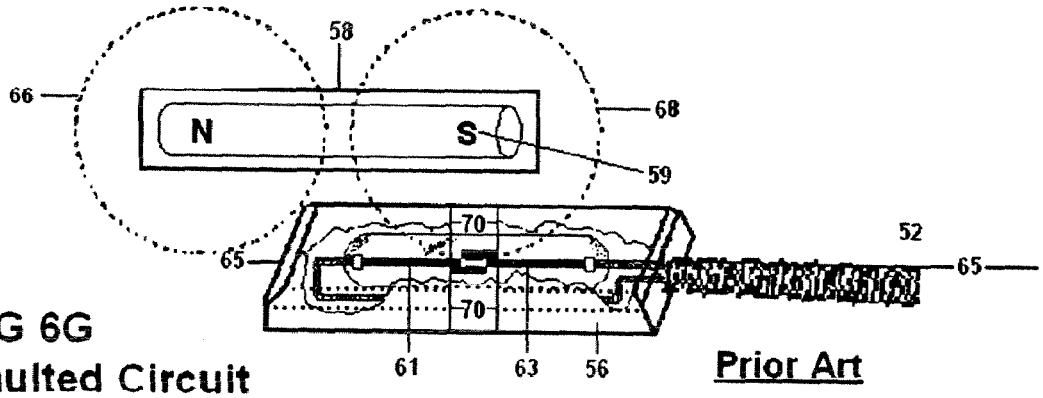

FIGS. 6E, 6F, and 6G further illustrate the effect the magnetic 58 has on the reed switch 56, for describing the effect on the circuit (not shown) associated with the reed switch 56 as the magnet 58 is moved. As shown in FIG. 6G, the magnetic 58 is in a position such that only magnetic field 68 influences and biases reeds 61 and 63. Accordingly, the circuit is in a faulted condition. However, moving magnet 58 from the left to the right or laterally, magnetic field 66 will begin to bias reed 61 and magnetic field 68 will bias reed 63, such that the circuit will be in a normal condition, as shown in FIGS. 6F and 6E. As such, FIGS. 6B to 6G, illustrate the effect that lateral movement of the magnet 58 will have on the reed switch 56 and an affect on the condition of the electric circuit. The movement as illustrated is very slight, such as on the order of approximately ½ to ¾ of an inch, which will cause the state of the reed switch 56 to change and thus effect the condition of the electric circuit. Thus, it should be understood that such relatively small lateral movement of a segment of the door 60*n*, which is consistent with the factory designed play, will change the condition of the reed switch 56 and can cause a false alarm.

Figure 7:
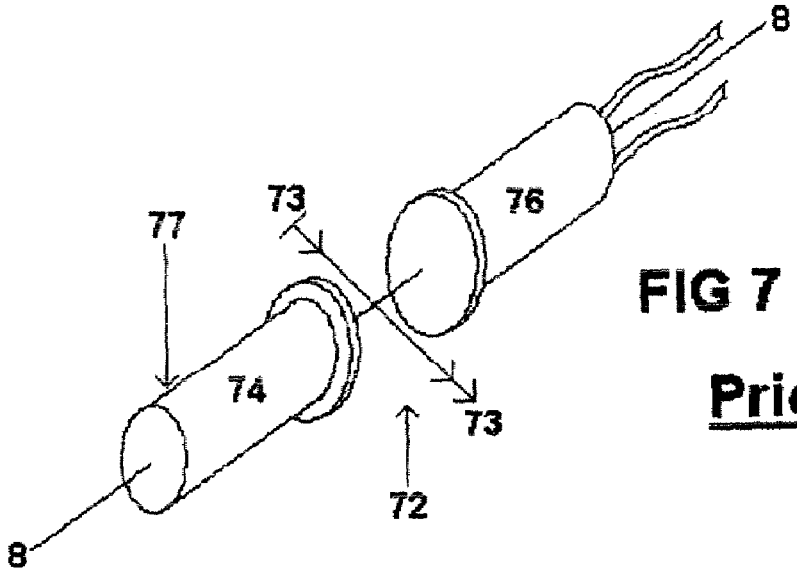
FIG 7 Prior art
FIG. 7 is a perspective view of a prior art proximity device, comprising a reed switch and a magnet.
Figure 8:
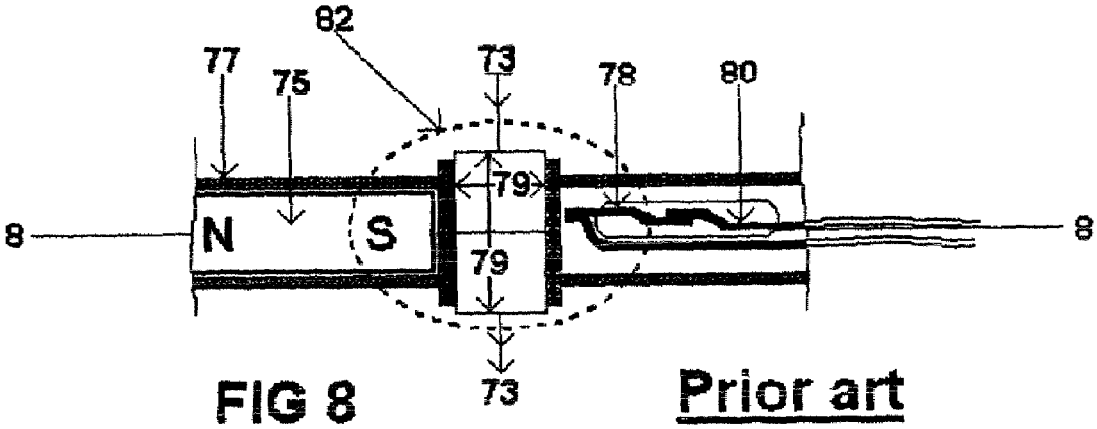
FIG 8 Prior art
FIG. 8 is a section view of the prior art proximity device shown in FIG. 7, taken along line 8-8.
Figure 8A:
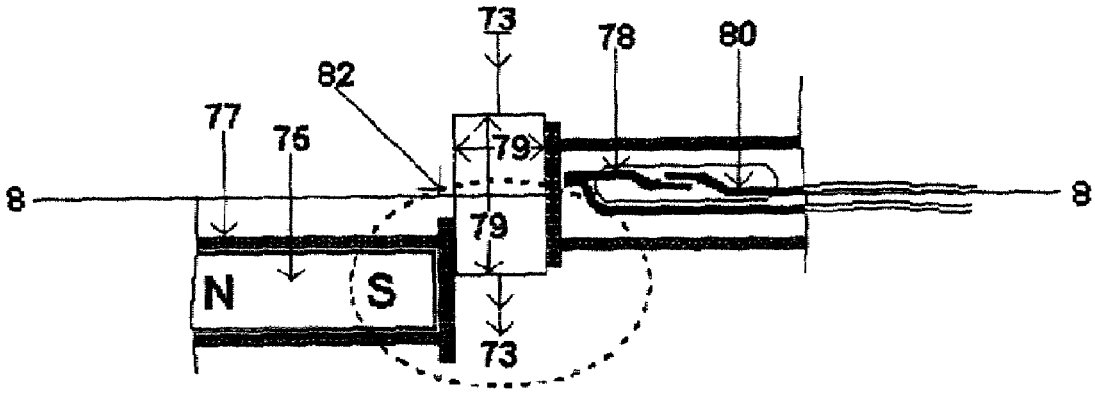
FIG 8A Prior art
FIG. 8A is a section view of the prior art proximity device as shown in FIG. 7, taken along line 8-8, illustrating the movement of the magnet relative to the reed switch and the open condition of the reed switch.

In FIGS. 7, 8 and 8A show another prior art proximity device 72. The proximity device 72 has a permanent magnet assembly 74 and a reed switch 76. In this embodiment, the magnetic assembly 74 and the reed switch 76 are placed in axial alignment relative to one another along horizontal axis 73 of switch 76. The magnet assembly 74 includes a biasing magnetic 75 that is contained within housing 77. Assembly 74 is typically installed in the movable portion of a window assembly or other movable apparatus. As the window is moved, the magnet assembly 74 will move toward or away from the switch 74, to open and close an electronic circuit (not shown).

As shown in FIG. 8 when magnet 75 is axially aligned with switch 76 within a predetermined gap 79, contacts or reeds 78 and 80 interact with the magnetic field 82 and assume a closed condition. In the closed condition, reeds 78 and 80 touch or are in close enough proximity to one another so that electric current can flow through switch 76. Reed 78 will remain biased and thus magnetically attract reed 80 so long as the magnetic field 82 remains in relatively close proximity to reed switch 76. If the magnet assembly 74 is moved away from gap 79, as shown in FIG. 8A, reed 78 is no longer interacting with field 82 and assume an open or electrically noncontacting condition. In an open condition, the switch 76 will be in an open state such that electric current cannot flow through it to the electric circuit. FIG. 8A is a cross-sectional view that illustrates switch 76 in the open state, such reeds 78 and 80 are electrically spaced apart from one another. The point at which reed 78 will no longer be under the influence of magnetic field 82 defines the break point. Proximity devices of the type illustrated in FIGS. 7, 8 and 8A, are presently sold by several manufactures, and is described more fully in Fishette et al, U.S. Pat. No. 5,635,887 assigned to Sentrol, Inc. of Tualatin, Oreg., which is incorporated herein by reference.

Prior art proximity device 72 suffers from similar problems as that suffered by prior art proximity device 52. Proximity device 72 is typically installed in a sliding window that includes a fixed frame and a movable closure member (both not shown). Magnet assembly 74 is mounted to the movable closure member such that it moves toward and away from switch 76 when the window is opened and closed. However, because only one magnet 74 and magnetic field is used, magnet assembly 74 is proximally axially aligned to switch 74 so that it will move toward and away from switch 76 along axis 73. In addition, magnet assembly 74 is mounted to provide a standard gap of 12.5 millimeters (½ inch) which is gap 79.

With the gap so small, the window must be closed sufficiently close enough with gap 79 so that the magnetic field 82 places reeds 78 and 80 in the closed condition to close the switch 76 to set the alarm. Sliding windows and doors actually have two closed positions. There is the fully closed to the jam position, and then there is also the checked to insure the window or door is locked position. The checked to insure position is when someone tries to open the window or door making sure that the locking mechanism has caught. This is the action of someone pulling the window to see that the window or door cannot open. There is play associated with the locking hardware. If there wasn't any play then the window or door would be difficult to unlock. On windows this play can be as much as ½ of an inch. With double sliding doors the play can be 1 inch or more. This play puts the current art sitting on the very edge of proper operation. Another problem associated with the current art gap distance the weather seals. These seals require additional pressure to get the opening closed. If the seal has enough restriction a person may feel that the opening is closed. Again this action puts the current art on the edge of proper operation. The industry presently uses relatively small or narrow gaps to increase the sensitivity of physical monitoring systems, such as an alarm, to respond to slight movement of the closure member. However, during warm weather months, the window cannot be opened far enough to vent air when the alarm is set because the magnet assembly 74 must remain within gap 79. In climates in which an air conditioner is not desired to be used and fresh air is desired, present standard gaps and break distances provide very little, if any, flexibility to vent a room. Adding to the problem with using standard industry gaps and break distances is the fact that irregularities are often present in window and door assemblies through wear and tear. These irregularities make it difficult to close a window or door far enough so that the closure member is close enough to the frame to position magnet assembly 74 within gap 79. Also adding to the problem are foreign materials, such as paint, dust, dirt, and other objects that impede the ability of a window or door being closed all the way. These objects holding the opening open by a ¼ inch or so, this resulting in assembly 74 sitting on the edge of gap 79. Failure to comply with such established gap and break distances in mounting proximity devices, such as 72, fails to provide acceptable tolerances for accommodating standard clearances, expected irregularities and foreign objects, which result in misalignments, spaces between the frame and corresponding closure members, and an inability to completely insure assemble 74 stays aligned within gap 79.

The present invention, by comparison, increases or controls the size of the gap so that the moveable closure member can be moved a sufficient distance, yet maintain the electrical condition of a switch. The present overcomes the limitations of prior art proximity devices, as illustrated by proximity devices 52 and 72, by expanding the gap or break distance through the use of aligned alike magnetic fields or an elongated magnet with specific polarity. The use of an elongated magnet with specific polarity or multiple aligned, alike magnetic fields part of the present invention creates a new wide gap assembly that exceeds industry standards and is flexible enough to control how much gap is desired. In addition, the present invention provides a means for designing and controlling the orientation, relative position, and mounting arrangements of a standard reed switch with a larger magnetic field provided by the present invention.

PREFERRED EMBODIMENTS OF THE INVENTION

Figure 9:
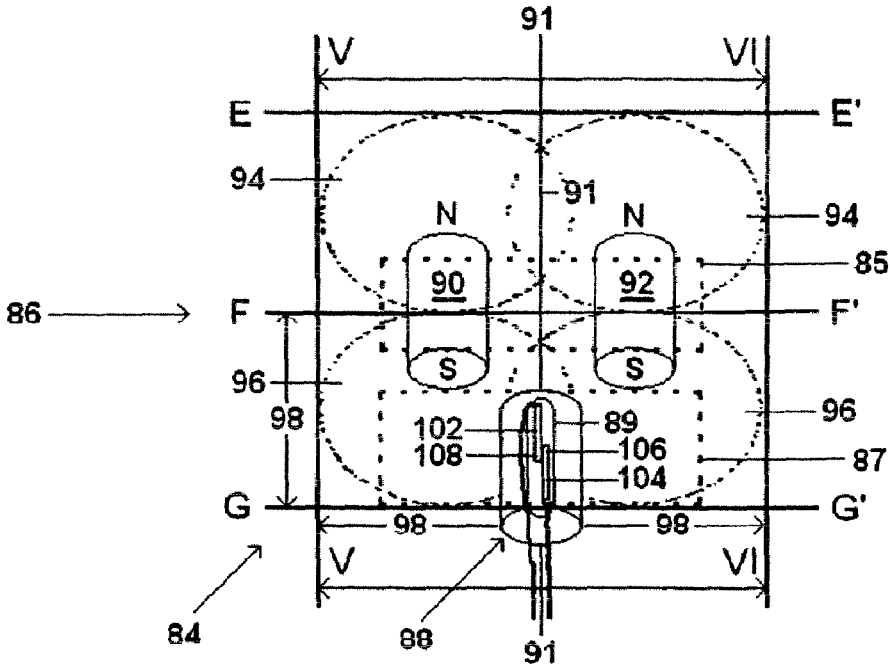
FIG. 9 is a perspective illustration of a magnetically actuated apparatus of the present invention, comprising a sensor and an enhanced magnetic actuator.

FIG. 9 shows a magnetically actuatable apparatus 84 of the present invention for use with magnetically or electrically controlled devices or systems such as, for example, magnetically actuated reed switches and proximity devices that are used with physical monitoring or alarm systems. Apparatus 84 includes an enhanced, actuating magnet assembly or magnetic actuator 86 and a magnetically actuatable control device or sensor 88, also referred to in the security industry as a contact that are operatively connectable to or associated with one another. The magnet actuator 86 comprises an assembly of multiple or a plurality of aligned, alike biasing magnetic fields (two shown) having overlapping magnetic folds. The magnetic actuator 86 is provided to magnetically actuate or to put into use at least a portion of sensor 88 using magnetism or an electro-magnetic field. In a preferred embodiment, two magnets 90 and 92 are shown to create the aligned, alike magnetic fields. It should be understood that the present invention is not limited to any number of magnets or the manner in which aligned, alike magnetic fields can be generated for formed. It is contemplated that one or an infinite number of magnets of the same or a different size, can be used in keeping with the scope of the present invention. For purpose of describing the invention, two magnets are shown.

Magnets 90 and 92 arc commercially available and are in the general configuration of a cylinder. Magnets 90 and 92 are made of any suitable magnetic or magnetizable material, such as iron, steel, ceramic, rare earth, an alloy, and other materials capable of having and maintaining a magnetic field. For example, magnets 90 and 92 may be composed of a nedymium-iron alloy having a coercive force of about approximately 10,000 oersteds (more or less) and a magnetic flux density of about approximately 7,000 gauss. The magnitude of the coercive force and magnetic flux (i.e., strength) of magnets 90 and 92 can vary, and depends largely upon the type of application that is desired. The present invention is not limited to a particular coercive force or magnetic flux, however, the magnets 90 and 92 that are selected should generate a magnetic field that will overlap. It is contemplated that magnets 90 and 92 can be replaced with material that is capable of generating a magnetic field, such as conductive material in which a electric current is passed or other magnetic means.

Magnet 90 and 92 are preferably, but not necessarily, mounted to or associated with support member 85. Support member 85 is any substrate, housing or material in which the magnets 90 and 92 are capable of being secured and held in place. Broken lines are shown in FIG. 9 to illustrate that the substrate can have any shape or size. Accordingly, magnets 90 and 92 are mountable in many types of suitable housings, non-magnetic dielectric material or insulator materials such as plastics, resins, foam, and non-ferocious metals such as cast aluminum or even wood. Preferably, magnets 90 and 92 are coated with epoxy or some other type of sealing, securing material to prevent oxidation and corrosions. It should be understood that in addition to coating the magnets, the magnets can be encapsulated in the housing (not shown) to protect against degradation, breaks, chips and other type of damage. The magnets 90 and 92 can be secured using any securing means known in the art, such as adhesives, brackets and the like. The present invention is not limited to any particular shape or type of magnets, securing means or shape of the support member 85.

Magnets 90 and 92 are spaced apart, but aligned side-by-side to form a line that is parallel to the longitudinal axis of the support member 85, defined by line F-F'. The polarities of each magnet in FIG. 9 are designated by "N" for north pole and "S" for south pole. These markings are for illustrative and descriptive purposes only. The poles of each magnet 90 and 92 should be parallel to each other so that all of the north poles are on one side and all of the south poles are on an opposite side. The spacing between each magnet is dictated, in part, by the strength of each magnet, the type of sensitivity of the magnetically actuatable apparatus that is designed, or design parameters such as the type of substrate that is being used.

Each pole of the magnets 90 and 92 generate a magnetic field or region of magnetic flux having a given direction and a given magnitude. The direction and magnitude of the magnetic flux depends upon the magnetism of each magnet. The magnetic flux is generally defined by the quantity of magnetism, being the total number of magnetic lines of force passing through a specified area. The magnetic flux is a function of intrinsic coercive forces, measured in oersteds, which is defined by its resistance to demagnetization forces. In a preferred embodiment, magnets 90 and 92 are permanent, high coercivity magnets, on the order of about approximately 1,000 to 40,000 oersteds. It should be understood that the present invention is not limited to a specific number of magnets and a particular coercive force.

Magnets 90 and 92 are affixed to support member 85 to keep them fixedly spaced apart relative to one another. In FIG. 9, both of the magnets have substantially the same length of about approximately one half inch and have widths that are equivalent to the diameters of their faces. It should be noted that the size of each magnet can vary. Magnets 90 and 92 are positioned with their poles axially aligned in a row along an imaginary line defined by line F-F', with like poles parallel to one another. Magnets 90 and 92 should be spaced apart, but close enough to one another such that their respective magnetic fields interlock or overlap with each other, thereby creating an effective, actuating magnetic field or region of magnetic flux 94 and 96. The effective magnetic region has a given direction and a given magnitude that is greater than the given magnitude and given direction of any one of the magnets 90 or 92, by themselves.

As illustrated in FIG. 9, the effective magnetic region, 96 for example, has a given direction that extends axially intermediate an imaginary plane defined by F, G, G' and F'. Region 94 is similar, and extends axially intermediate a plane defined by an imaginary line connecting points E, F, E' and F'. As shown, region 96, which is representative of region 94, defines a new wider gap and break distance.

The gap is a function of the magnitude of the combined magnetic flux, defined by effective magnetic region 96. Magnetic region 96 controls the distance in which magnets 90 and 92 or support member 85 can move (i.e., in all dimensions) relative to the position of sensor 88 without a change in electrical condition of the switch. The outer limits of the gap, i.e., the point in which the electrical condition of sensor 88 will change, defines the break point distance. This is a change from present industry standards, which limits the gap to the distance between the location of the switch and the face of a magnet if the magnet is moved away from the switch. Industry standard is about ½ an inch for standard gaps and up to 1 inch for wide gaps. By comparison, the present invention, through the use of multiple, aligned alike magnets with overlapping or interlocking magnetic fields, expands the gap in all linear dimensions, to permit movement of the magnet actuator 86 relative to sensor 88 greater than industry standards. In addition, the use of multiple, aligned alike magnets with overlapping magnetic fields allows more tolerances in the initial installation or closure of a window or other type of movable member, which is another advantage of the present invention over the prior art.

Preferably, the gap created by the present invention has a horizontal component that extends intermediate the sides defined by the line F-G and the line F'-G'. The horizontal component further defines the distance in which the magnetic assembly 86, and thus the support member 85, can move laterally from one side to the other along lateral axis V-VI, yet remain in close enough proximity so that the electrical state or condition of sensor 88 does not change. The gap also has a vertical component that defines the distance in which magnetic actuator 86, and thus support member 85, can be moved away from the sensor 88, yet remain in close enough proximity to maintain the electrical condition of sensor 88. Again, it should be understood by those of ordinary skill in the art that the overlapping magnetic field of region 96 has a magnitude and component in all dimensions relative to the sensor 88.

The orientation of sensor 88 also represents a change in the prior art. Prior art sensors, such as contacts or reed switches, are typically oriented relative to a biasing magnet in two ways. In one embodiment, the reed switch is mounted so that it is parallel to the magnet, similar to the type illustrated in FIG. 6A-6G. In that embodiment, both the magnetic fields of the south pole and the north pole magnetize or bias of the reeds so that the switch is closed. Slight movement to the left or to the right of the reed switch causes the reeds to return to the open state. In a second embodiment, such as the type illustrated in FIGS. 7, 8 and 8A, the magnet is aligned coaxially with the reed switch. In that embodiment, the magnet is moved toward or away from the reed switch along the central longitudinal axis of the switch. If the magnet is moved far enough away from the switch (i.e., beyond the outer limit of the predetermined gap) the reed will be released from the magnetic field and the switch will assume an open state.

By comparison, the present invention teaches away from current industry practice by orienting the sensor 88 by so that it is normal to the longitudinal axis of support member 85 or the line defined by line F-F'. As shown in FIG. 9, sensor 88 is oriented so that it interacts with one of the effective magnetic fields, namely 96. The combination of the orientation of sensor 88 will the effective field 96 formed by multiple, alike magnetic fields, the gap, break point distance, and overall sensitivity of apparatus 84 and similar types of proximity devices can be controlled and provide flexibility in designing systems for different applications.

Sensor 88 is preferably, but not necessarily, a magnetically controlled device such as a magnetic reed switch device for use in a physical security alarm monitoring system, machine controlled system, and the like. Sensor 88 is of known construction, comprising a glass tube 89 having a central longitudinal axis 91. Sensor 88 is mountable to a second support member 87. Support member 87 is any type of housing, substrate, support or other part that can have any shape or sizes, as illustrated by the broken lines. Support member 87 is preferably, but not necessarily, fixed. Support member 87 is fixed in that it remains in a relatively stationary position such as a frame, the floor or any other member. Support member 85 is adapted to move relative to support member 87.

Sensor 88 has a pair of contacts, such as reeds 102 and 104, that are disposed in a plane that is aligned along longitudinal axis 91. Reeds 102 and 104 are made of any suitable magnetizable material, and at least one reed 102 or 104 is adapted to move relative to the other. Reeds 102 and 104 receive and respond to external stimulus, such as a magnetic field to control the flow of electricity to the electric circuit (not shown). Reed 102 has a first contact member 108 and reed 104 has a second contact member 106, each of which are adapted to electrically connect to one another. The contacts 106 and 108, respectively, correspond to a transfer point or structure in which a connection between two conductors can be formed to permit the flow of current or corresponds to the part of a device that makes or breaks such a connection. It is contemplated that other contact means for permitting the flow of electric current can be used which can be any structure having material used to conduct electricity can be used as part of sensor 88. It is also contemplated that the sensor 88 can be replaced with a reed switch, which is referred to in the security industry as a contact, or other control devices or moons for controlling the flow of electric current to the electric circuit.

At least one of reeds 102 and 104 is arranged for displacement or movement relative to the other to move the sensor intermediate an open or non-settable condition and a closed/settable condition. The words settable and non-settable could be used to describe the position of the movable member relative to the fixed member, to describe the position in which the sensor 88 has changed states to is in a position to affect a change on the circuit, such as being in a position to set an alarm or to trigger an alarm. This invention may be used on "normally open" or "normally closed" switches. For purposes of describing the invention, the terms open state and closed state are used. However, it should be understood that the invention can also be described using the words settable and non-settable as alternatives.

Figure 9A:
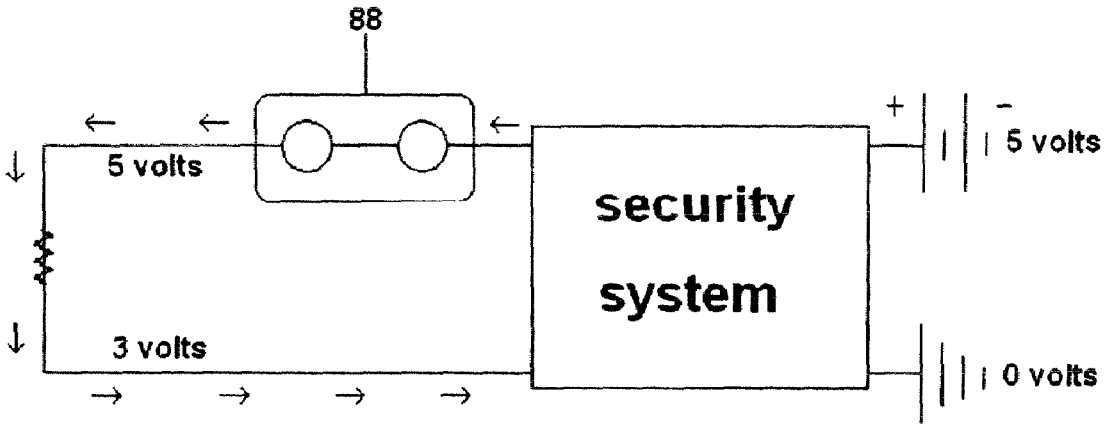
FIG. 9A is a schematic in generic form illustrating an electric circuit for a security device utilizing the magnetically actuated apparatus of the present invention.

Sensor 88 as shown in FIG. 9 is in a normally closed state, such that electric current can flow through to the electric circuit, of the type similar to FIG. 9A. It is contemplated that sensor 88 is normally closed or in a settable condition, thus permitting electric current to flow through the sensor 88 in a normal biased condition. The term settable is meant to include a state in which the circuit is in a condition such that an alarm can be set or the alarm circuit is normal. It should be understood that the present invention is not limited to that particular condition or arrangement. Also, settable will include a state in which a moveable member is moved relative to a fixed member, such that the sensor 88 is in a state in which the condition of the electric circuit is changed or changeable. That is, for example, an alarm connected to the circuit can be turned on or set when the sensor 88 or is in a settable position. Of course, it should be understood that in a non-settable state, the sensor 88 is in a position in which the circuit cannot be set or the alarm cannot be turned on.

In a normally open state, reed 102 is displaced away from reed 104 such that contact 108 are not within close proximity or touch contact 106. When contact 106 and 108 are not in close proximity to one another, electric current cannot flow through sensor 88 to the electric circuit. However, when contact 106 moves within close proximity to or touches contact 108, electric current can flow through sensor 88 to the electric circuit because the sensor 88 is in a closed state, as illustrated in FIG. 9.

It should be understood, of course, that the present invention is not limited to sensor 88 being in either a normally open state or a normally closed state. It its contemplated that the present invention may be employed in an electric to system or loop in which the sensor 88, or reed switch, is normally opened or normally closed, which is entirely discretionary to the designer of the circuit. Those of ordinary skill in the art would appreciate that sensor 88 will be electrically connected together in a circuit with wires electrically connected to a physical monitoring system or control unit, shown generically in FIG. 9A. The security system is settable based upon the amount of voltage that is sensed that runs through the loop. In a normally closed condition, the sensor 88 is in the closed state so that the current runs through the system and is registered by the security device. If, for example, 3 volts is registered, the security can be set. If the volts drops below 3 volts because the sensor 88 is opened, the security device can interpret that condition as a basis to trigger the alarm. If sensor 88 is in an open state, the security device will not sense any voltage returning to the system and that condition can also be interpreted as not settable or could trigger the alarm. If 3 volts are sensed, such as if the sensor is in the closed state, then that condition can be interpreted to set the security device.

In operation, magnetic actuator 86 is mounted to a movable closure member, such as support member 85, which is adopted to move relative to a second support member 87. Sensor 88, which is connected to an electric circuit, is fixedly mounted in or about the second support member 82, which is preferably a frame or other support structure that surrounding a doorway, window, or access panel. The first support member 85 is displaceable either side-to-side (i.e. moving from the left to the right of the paper) or away from structure 87*b* (i.e. moving toward the top of the paper). As the first support member 85 is displaced, it takes with it magnetic actuator 86 which, in turn, causes magnetic fields 94 and 96 to also be displaced. As described above, magnetic region 96 actuates sensor 88, which is preferably a reed switch, by magnetizing reed 102. Once magnetized, reed 102 will interact with reed 104, thereby assuming a closed or touching condition so that electric current can flow to the electric circuit. The lateral movement of the first support member 85 relative to the second support member 87 defines a portion of gap 98 for the apparatus 84. When support member 85 is displaced far enough so that the magnetic region 96 no loner influences reed 102, then reed 102 will become unmagnetized and release reed 104, thereby returning the sensor 88 to the open state. The point in which sensor 88 resumes the open state is known as the break point distance. Therefore, the effective magnetic region 96 increases the gap and the associated break point distance beyond the range of current acceptable gap distances which, as discussed previously, is about ½ inch for standard gap mounts and 1 inch for wide gaps. The ability to increase and control the standard and wide gap as desired, and thus overcome the limitations of prior art devices that become compromised by not contemplating the amount of "play" that is built into an overhead garage door or the limitation that arise in a closeable structure, such as a window or door assembly.

Use of multiple overlapping magnetic fields to define an effective region of magnetic flux or magnetic field is novel. Presently, prior art proximity devices use one magnet that is oriented either coaxially (See FIG. 7 or 8) or parallel (See FIGS. 4, 5 and 6A) to the reed switch. Those prior art devices are limited because only one magnetic is used to bias the reeds of the reed switch. Using one magnet limits the gap or distance in which the movable support member can be moved relative to the fixed support member before the reed switch is no longer under the influence of the magnetic field. That is why the gap of present industry standards is only about ½ to 1 inch. In view of the small tolerances of the gaps of the prior art, proximity devices are susceptible to falling out of alignment if the magnet or the support member in which the magnet is mounted is displaced a distance greater than the gap distance of the device. Some windows and doors sold on the market today have factory designed movement that exceeds the current industries standard gap tolerances. This results in unnecessary police dispatches to false alarms. The present invention overcomes the limitations of the prior art by providing a means in which to widen the gap or to reset the break point distance that exceeds present industry standards. Use of multiple, aligned alike magnetic fields with overlapping magnetic fields therefore provides an enhanced magnetically-actuated means of widening the gap to allow the support member to move relative to the reed switch a greater distance than is presently available commercially using a single magnet.

A wider gap is advantageously used to control the operation of the sensor 88, and ultimately, the electric circuit, notwithstanding movement or misalignment of the first support member 85 relative to the second support member 87. In other words, the present invention permits greater movement of two cooperating members in which a sensor 88 and an actuating magnetic field are mounted, without any degradation of the efficacy of the ability of the magnetic field to influence sensor 88. This will allow "breathing" or "venting" in that when the present invention is applied to a movable closure assembly, such as a window, the window can be left open a greater distance that otherwise is not possible with present prior art proximity devices. The ability to vent will enable a room to receive more fresh air, yet maintain the electrical condition of the sensor 88. The use of venting can advantageously be used in climates when fresh air is needed to vent a room. The present invention is also flexible enough so that the magnitude of the gap is controllable by the selection of the number and magnetic strength of the magnets or the location of the sensor 88. Therefore, when the present invention is used, the effective magnetic flux region is advantageously used to actuate the sensor 88 to control the state of the electric circuit. Also, the effective magnetic flux region 94 or 96 allows the support members to which the magnetic actuator 86 and sensor 88 are mounted, to be displaced relative to one another in a desired distance in a given direction. The magnitude that of the displacement of the first and second members relative to the magnetic flux of any one of the magnets 90 or 92.

Figure 10:
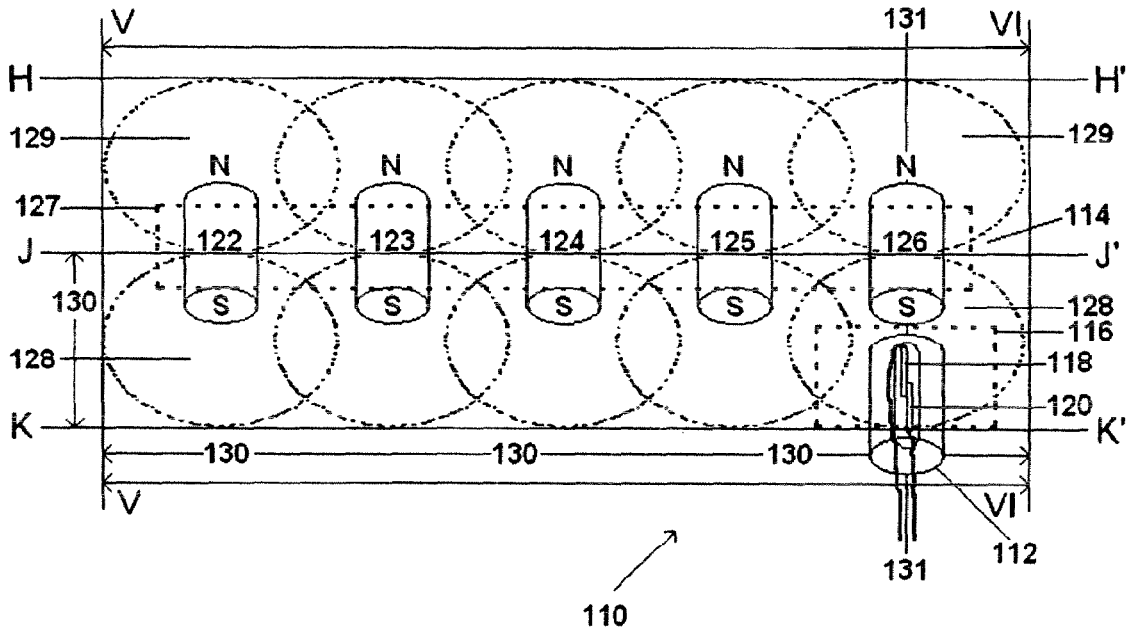
FIG. 10 is a perspective illustration of a magnetically actuated apparatus of the present invention, comprising a sensor and an enhanced magnetic actuator.

Referring to FIG. 10, an alternative magnetically actuated apparatus 110 is shown. Apparatus 110 has a sensor 112 and a magnetic assembly or actuator that operatively interact or are associated with one another. The sensor 112 is preferably, but not necessarily, a magnetic reed switch or other sensing means for responding to external magnetic stimuli. Sensor 112 comprises a glass tube in which a first reed 118 and a second reed 120 are arranged for displacement relative to one another in response to a magnetic field. Sensor is fixedly mounted to a first support member 116, which is shown in broken lines to illustrate that support member 116 can be of any suitable shape and made of any suitable material, such as a frame of a door or window.

Preferably, the first rood 118 is movable intermediate a non-settable/open position spaced away from reed 120 and a settable/closed position in close proximity to or touching reed 120. Reeds 118 and 120 each have a contact member or means that are adapted to permit electric current to flow through sensor 112 to an electric circuit (not shown) when reeds 118 and 120 are in the settable condition, in the presence of a magnetic field. Reeds 118 and 120 are oriented so that they are normal or perpendicular to the magnetic assembly 114.

The magnetic actuator or assembly 114 is provided to magnetically actuate or operate sensor 112 through the use of magnetism. The magnetic actuator 114 is fixedly mounted to a second support member or structure 127. Support member 127 has a longitudinal axis along line J-J' and is mechanically adapted to be displaced horizontally and vertically relative to support member 116. Displacement of support member 127, and thus, magnetic assembly 114, controls the electric condition of sensor 112.

Magnetic actuator 114 preferably comprises multiple or a plurality of aligned, alike magnetic fields that are preferably, but not necessarily defined by actuator magnets 122 to 126 (five shown) that are assembled to magnetically interact with and control the electric condition of sensor 112. The number of magnets can be more or less. Magnets 122 to 126 preferably have high coercivity, on the order of about 2,000 to about approximately 30,000 oersteds. Magnets 122 to 126 are spaced apart and positioned with their poles axially aligned, with like poles facing side by side to each other. That is, magnets 122 to 126 are aligned preferably in a row one next to the other along a longitudinal axis, defined by J-J'. Each magnet 122 to 126 has a north and south magnetic pole, identified by the letters "N" and "S" that faces the neighboring magnet, so that all north poles are on one side and all south poles are on an opposite side.

The poles of each magnet define a north magnetic field and a south magnetic field of a given magnitude and a given direction. The magnets 122 to 126 should be spaced apart, but close enough to each other such that their respective magnetic fields overlap and interlock to form an effective actuation magnetic field 129 and 128. For example, magnetic field 128, which is representative of 129 with the exception of the polarity, has a given magnitude and a given direction that is greater than or in excess of the given magnitude and direction of the magnetic field of any one of the magnets 122 to 126. Magnetic field 129, as illustrated in of FIG. 10, is disposed in a plane that is normal to a longitudinal axis 131 of sensor 112.

The use of multiple, aligned, alike magnetic fields is advantageously used to create an enhanced magnetic field, such as field 129 and 128, so that support member 127 that can move horizontally and vertically relative to sensor 112 or to support member 116. This movement will not change the electrical condition of the sensor 112. Furthermore, it should be understood that field 128 will work 170° off of the center of sensor 112 and rotate 360° along the axis defined by J and J'. If the movement of the aligned alike magnetic fields puts sensor 112 to the left of V or the right of VI, the electric condition of sensor 112 will change. Use of field 128 creates a desired gap 130.

Gap 130 is three dimensional, comprising a vertical component and a horizontal component, which is shown in FIG. 10 by the combined magnetic fields that are depicted within broken lines to illustrate that the magnitude and direction of gap 130 is variable. The vertical component is defined by the distance in which support member 127 can be moved either toward or away from sensor 112 (e.g., toward the top or the bottom of the paper), without a change in the electrical condition of sensor 112. If support member 127 is moved away from sensor 112 such that reed 118 is no longer biased by magnetic field 128, the point in which the magnetic field 128 releases reed 118 defines the break point or the upper vertical limit of gap 130. If support member 127 is moved vertically toward sensor 112, the point in which the electrical condition of sensor 112 changes because the magnetic field 128 magnetizes both reeds 118 and 120 with the same polarity equally, thereby causing each reed causes to repel away from each other, defines the lower limit of the gap and a second break point. Similarly, if support member 127 is moved laterally along its longitudinal axis to the left of the paper, the point in which the magnetic field no longer biases reed 118 such that the electric condition of sensor changes defines a portion of gap 130. If support member is moved laterally along its longitudinal axis to the right of the paper, the point in which magnetic field 128 no longer biases reed 118 such that the electric condition of sensor 112 changes defines another portion of gap 130 and break point distance. It should be understood by those of Ordinary skill in the art that gap 130 represents the desired distance in which support member 127 is capable of moving without any change in the electrical condition of sensor 112.

It is contemplated that gap 130 has a three-dimensional geometrical configuration. It is also contemplated that gap 130 can also be defined relative to the movement of sensor 112 or support member 127. If, for example, sensor 112 drops below plane K-K', then the electrical condition would change because field 128 is no longer in a position to bias 118 to that sensor 112 resumes an open state. Likewise, if sensor 112 or support member 127 is displaced beyond the line V-VI, then the electrical characteristics would also change. Any change in the electrical condition of sensor 112 by movement of either of support member 127, magnetic actuator 114, or sensor 112, defines a portion of gap 130 and its associated break point distance. Accordingly, gap 130 of apparatus 110 is set by a variety of factors, including the strength and size of the magnets.

Figure 11:
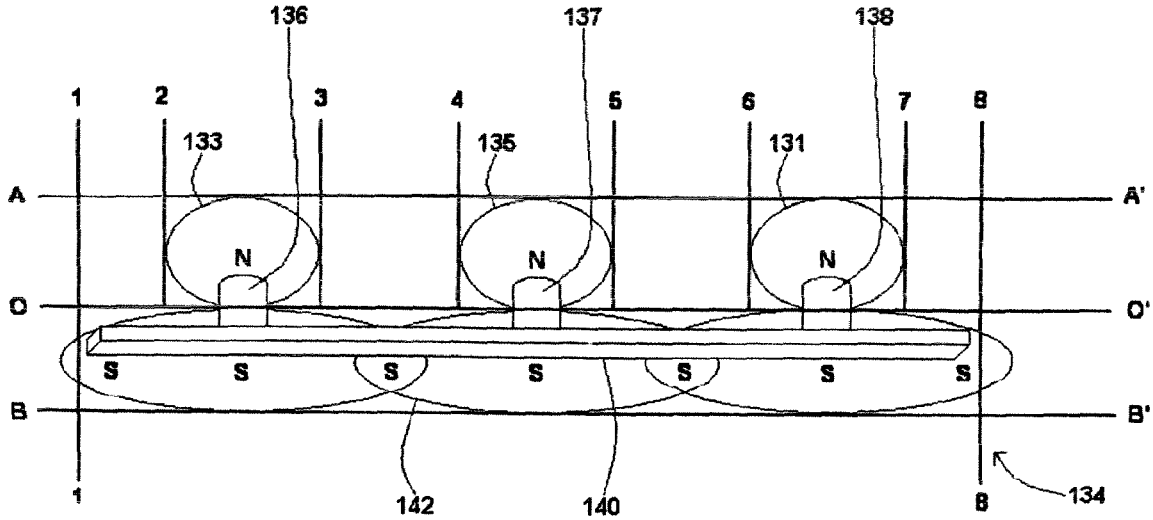
FIG. 11 is a perspective illustration of a magnetically actuated apparatus of the present invention, comprising an alternative embodiment of an enhanced magnetic actuator.
Figure 11A:
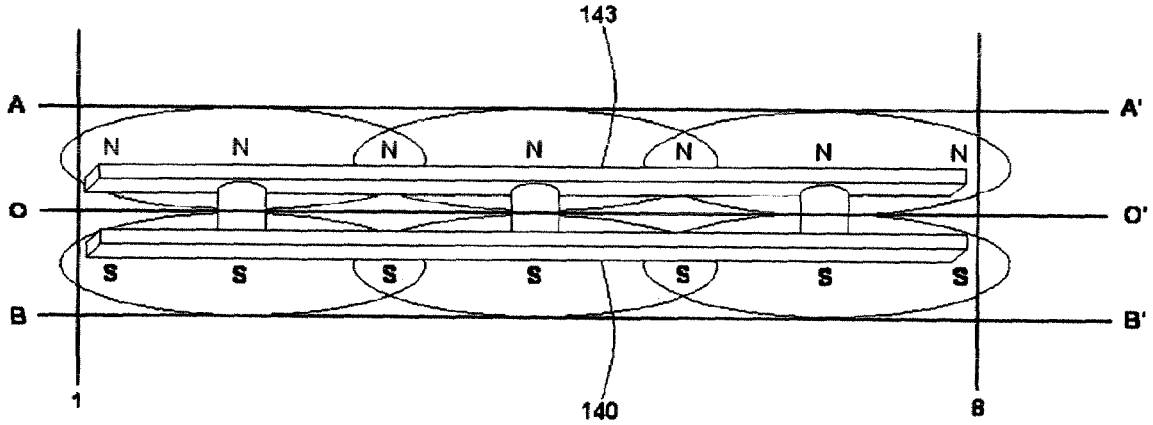
FIG. 11A is a perspective illustration of a magnetically actuated apparatus of the present invention, comprising an alternative embodiment of an enhanced magnetic actuator.

Before turning to FIGS. 11 and 11A, it should be noted that the present invention is not limited to the specific application of magnetic actuator 114 and sensor 112. That is, sensor 112 can be mountable in the movable support member, i.e., 127, and the magnetic assembly may be entered can be mountable to the fixed support member 116. The magnetic actuator 114 and sensor 112 should be mounted separately in members that are capable of moving relative to one another to in one embodiment, in which two or more members that are associated with one another are displaceable.

FIG. 11 shows an alternative embodiment of a magnetic actuator or magnetic assembly 134. The magnetic actuator 134 comprises a plurality of aligned, alike magnetic fields associated with a magnetizable member form a magnetic actuator. Preferably, the aligned, alike magnetic fields are formed by magnets 136 to 138 (three shown) that are aligned in a row one next to the other with like poles facing side by side to each other. Each pole creates a magnetic field having a given magnitude and a given direction.

Magnets 136 to 138 are secured to a magnetizable member, such as bar 140 that is made of magnetizable material, such as a steel. The bar 140 is secured to the face of each magnet and held in place by magnetism. An epoxy or other adhesives might be used to ensure that magnets 136 to 138 remain in place. Securing each magnet 136 to 138 to the bar 140, magnetizes bar 140 to define an effective actuation magnetic field 142. Magnetizing bar 140 creates a substantially continuous magnetic actuation field that has an effective magnitude of a given direction and a given magnitude that is greater than or in excess of the magnitude of any one of the magnets. Bar 140 is advantageously used to simulate the use of multiple magnets to create an effective magnetic actuation field 142, thereby reducing the quantity of magnets used. Preferably, in creating the continuous field 142, the magnets 136 to 138 can be positioned away from each other without their respective magnetic fields overlapping. As illustrated in FIG. 11, with regard to the vertical lines defined by numbers 1 through 8, the magnetic field 133 of magnet 136 extends intermediate lines 2 and 3; the magnetic field 135 of magnet 137 extends intermediate lines 4 and 5; and the magnetic field 131 of magnet 138 extends intermediate lines 6 and 7. However, magnetic fields 131, 133, and 135 do not overlap. Despite the fact that the magnetic fields 131, 133, and 135 do not overlap, the use of bar 140 creates the effective magnetic field 142. Therefore, fewer multiple aligned alike magnets call be used to create an effective magnetic actuation field 142. As a result, a continuous aligned alike overlapping magnetic field cannot be created at these distances without the use of the bar 140. If the bar 140 is removed, breaks in the magnetic field will result, which are shown in FIG. 11 at positions 1-2, 3-4, 5-6, and 7-8 each of which re disposed in the plane A, O, O' and A'.

Magnetic actuator 134 operates in much the same way as magnetic assembly 114 as shown in FIG. 10. Magnetic actuator 134 is mountable to a moveable first support member 139 that is displaceable or moveable relative to a relatively fixed second support member, in which a reed switch (not shown) may be mounted. Preferably, the reed switch will be mounted in the second support member such that its longitudinal axis is normal to the magnetic field 142. In that way, the first support member 139 can be moved laterally (i.e., from left to right) relative to the second support member and displaced away from the reed switch a distance that is greater than otherwise capable it one magnet is used, such as the prior art shown in FIGS. 7 and 8. Accordingly, the gap for the magnetic actuator 134 is wider than the gap that is used if one magnet is used. It should be understood, of course, that the magnitude and direction of magnetic field 142 and gap is three dimensional, having a geometric shape that is defined by the geometrical shape of the magnetic flux emitted from the steel bar 140. FIG. 11A is an example of the use of two magnetizable members 140 and 143 to enhance the magnetic fields equally.

Figure 12:
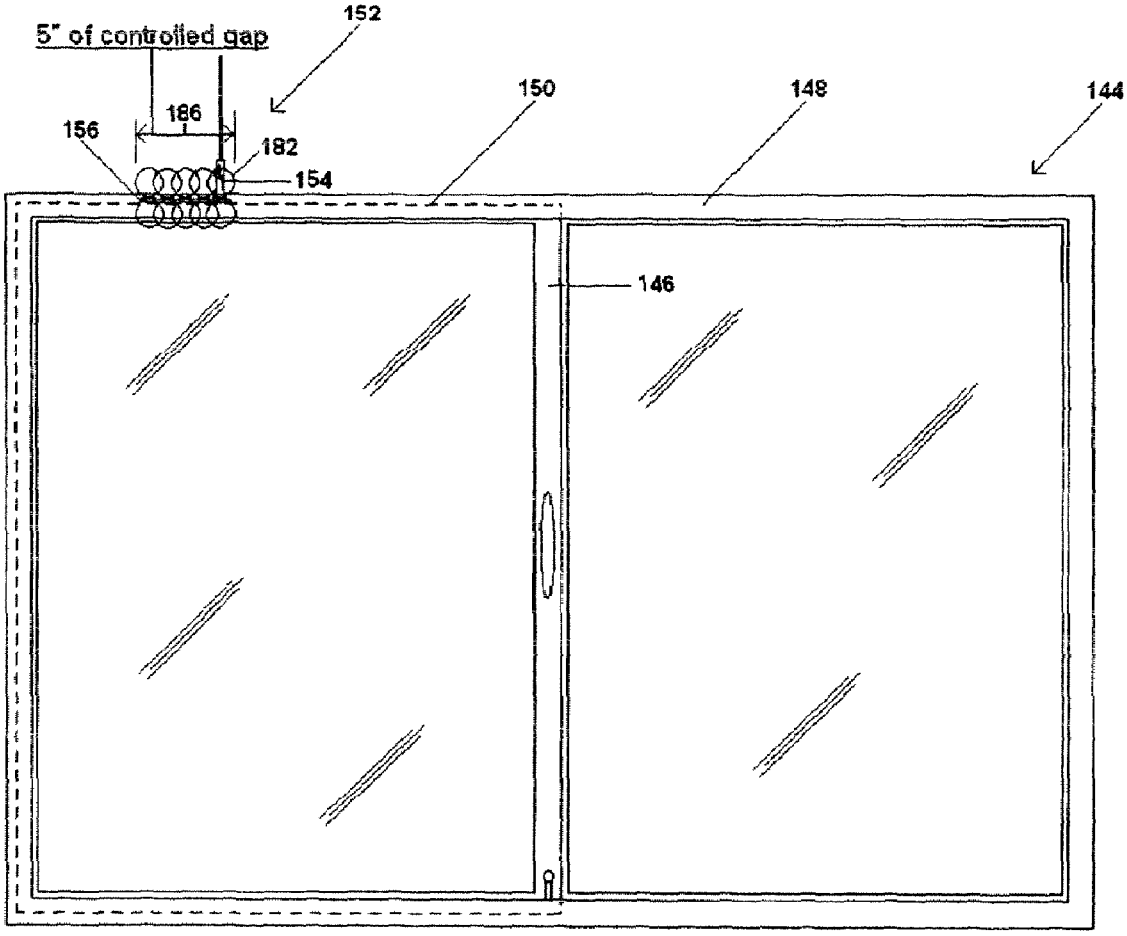
FIG. 12 is a front plan view of a window assembly, showing the installation of a magnetically actuated apparatus, having a control device and an enhanced magnetic actuator of the present invention.

Turning now to FIGS. 12 to 15 an exemplary application of a preferred embodiment of a magnetically actuated apparatus of the present invention is shown. FIG. 12 shows a closeable glass sliding door or window assembly 144 in a closed condition, that is mounted within a wall of a hypothetical room. Assembly 144 comprises a first movable member 146 arranged for displacement relative to a second fixed member that is in the form of a frame 148. The first member 146 is a typical sliding window, having a handle that is used to displace the first member 146 relative to the second member 148 in order to open and close the window. The first member 146 has an edge 150 that seats within a track or groove (not shown) of the second member 148 so that the first member 146 can move or slide laterally toward and away from a side of the second member 148. The phantom lines show the location of the edge 150 of the first member relative to the frame 148. It is contemplated that window assembly 144 can be replaced with any closure assembly, in which one part moves relative to the other.

A magnetically actuated apparatus 152 is associated with window assembly 144. Apparatus 152 has a sensor 154 and a magnetic actuator or assembly 156. The sensor is preferably, but not necessarily a control device such as a reed switch that responds to an external stimuli. Sensor 154 is mounted to the second member 148, using any suitable attachment means. Sensor 154 may be mounted to the second member 148 using adhesives such that the face of sensor 154 faces the first member 146. Opposite the face of sensor 154 are wires that lead to an electrical circuit of a physical monitoring system, such as an alarm system (not shown).

Figure 13:
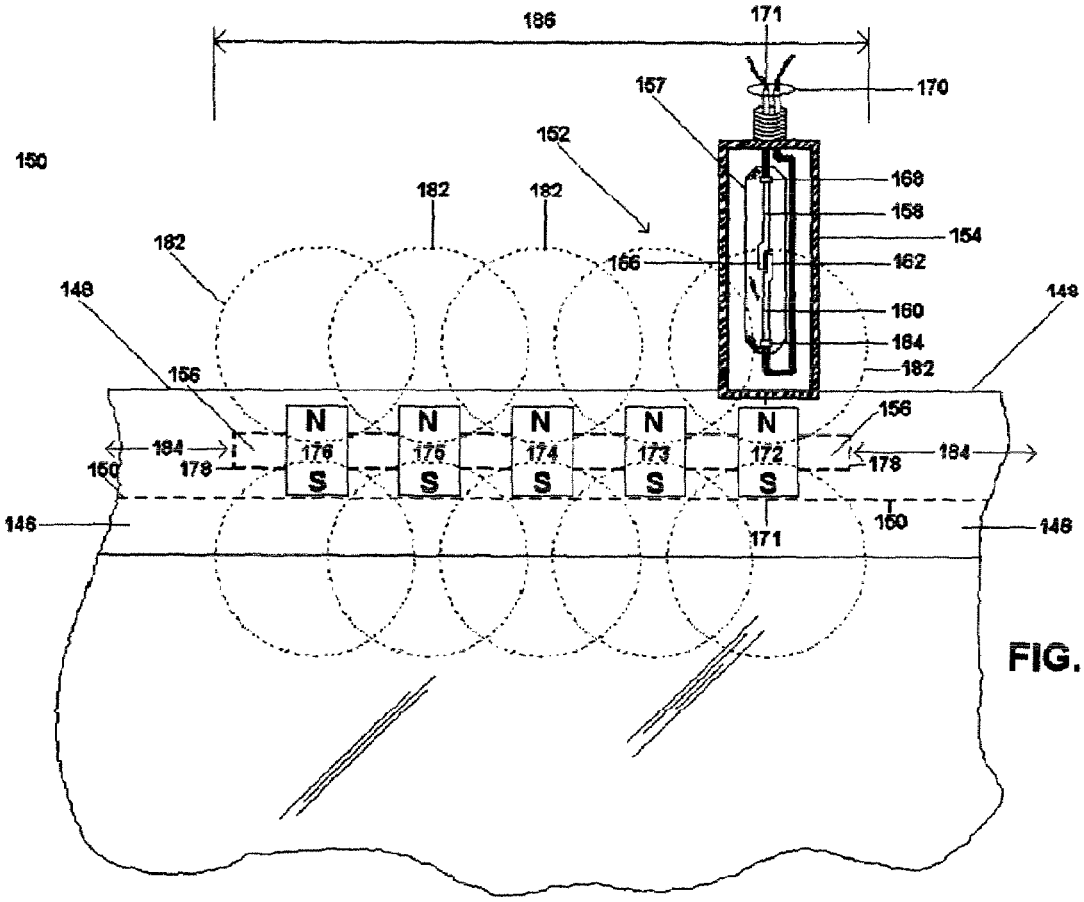
FIG. 13 is an isolated plan view of the magnetically actuated apparatus and magnetic actuator shown in FIG. 12, with portions of the control device broken away to shown internal components.

As best seen in FIG. 13, sensor 154 is preferably, but not necessarily, a reed switch having a first electrical contact 158 and a second electrical contact 160 (i.e., such as reeds) that are disposed within a glass tube 157. Contacts 158 and 160 are made of magnetizable material, such as steel, and define a longitudinal axis 171. One or both of contacts 158 and 160 are adapted to electrically connect to one another in response to a magnetic field. Preferably, contact 160 is fixed within tube 157, having a free end 162 and an opposite end 164 that is connected to an end of a wire that is connected to the electrical circuit of the alarm. Contact 158 is movable in response to the influence of a magnetic field, having a free end 166 that is adapted to ohmically connect to end 162 of contact 160 to close the sensor 152. Opposite to end 166 is end 168 that is connected to wire 170 that is attached to electric circuit of the alarm.

Sensor 154 is used to control the condition of the electrical circuit. For example, sensor 152 has an open condition and a closed condition in response to a magnetic field. In an open condition, contacts 160 and 158 are spaced apart from one another such that electric current cannot flow through sensor 154. In a closed condition, ends 162 and 166 touch or are in close enough proximity to one another so that electric current that enters 170 can flow through contact 160 and wire 164 to the electric circuit of the alarm. The flow of electric current to the alarm can be interpreted as a condition to set the alarm. The condition of sensor 154 is controlled by a magnetic field formed by assembly 156.

Assembly 156, which is a type of magnetic actuator as contemplated by the present invention, is provided to magnetically actuate contacts 158 and 160 to open and close the switch. Assembly 156 comprises a plurality of aligned, alike multiple magnets (five shown) 172 to 176 that are secured to a support 178 to keep them in fixed relation together. Support 178, shown in broken lines, can have any shape and be made of any material. Any housing or other structure that is sturdy, but flexible enough to hold the magnets can be used. It is contemplated that support 178 can be integrally formed as part of the first member or a separate structure altogether. Support 178 can be mounted using any suitable securing means, such as adhesives and fasteners. It is also contemplated that the magnets 172 to 176 can be embedded into the first member 146.

In a preferred embodiment, magnets 172 to 176 are aligned adjacent to one another in a row, forming a line connecting their center that is normal to axis 171. Each magnet has a pole of opposite polarity (i.e., a north and a south pole) such that like poles are arranged adjacent to one another to define an effective magnetic field or region of magnetic flux 182 having a given magnitude and a given direction that is greater than the given magnitude and direction of any one of the magnets 172 to 176. The magnetic flux region 182 is aligned along and further defines the axis 184 that is normal to axis 171.

Region 182 is used to magnetically actuate the contacts 158 and 160 of sensor 154 using magnetism. For instance, the magnetic field of region 182 will magnetize contact 160 by changing the domain structure to induce a magnetic field. Once contact 160 is magnetized, it will magnetically attract contact 158 so that contact 158 is displaced along axis 171. If contact 158 is moved close enough so that end 166 moves within close proximity to touch end 162, the sensor 154 will be in the closed condition so that electric current can flow through or to the alarm. The electrical condition of sensor 154 will not change so long as a magnetic field of region 182 continues to magnetize contact means 160.

The magnitude and direction of region 182 defies the gap of the assembly 152. As discussed previously, the gap represents the distance between two points (i.e., the break points) that the magnetic assembly 156 or support structure 146 can be moved relative to the second member 148, in a given direction so long as the electrical condition of sensor 154 does not change. Preferably, the magnetic region defines a gap 186, which is about 5 inches as shown in FIG. 12. It should be understood, of course, that the present application is not limited to any specific number of magnets or the length of the gap 186. It is contemplated that any number of multiple magnets can be used, so long as at least two magnets are used that are each aligned with like poles facing side by side to each other. In addition, it is contemplated that the length of gap 184 can be from about approximately one inch to any length that is desired. The length of the gap 184 that is selected is depended largely upon the magnitude of the displacement of the first member 146 relative to the second member 148 or, vice versa, that is desired.

Figure 14:
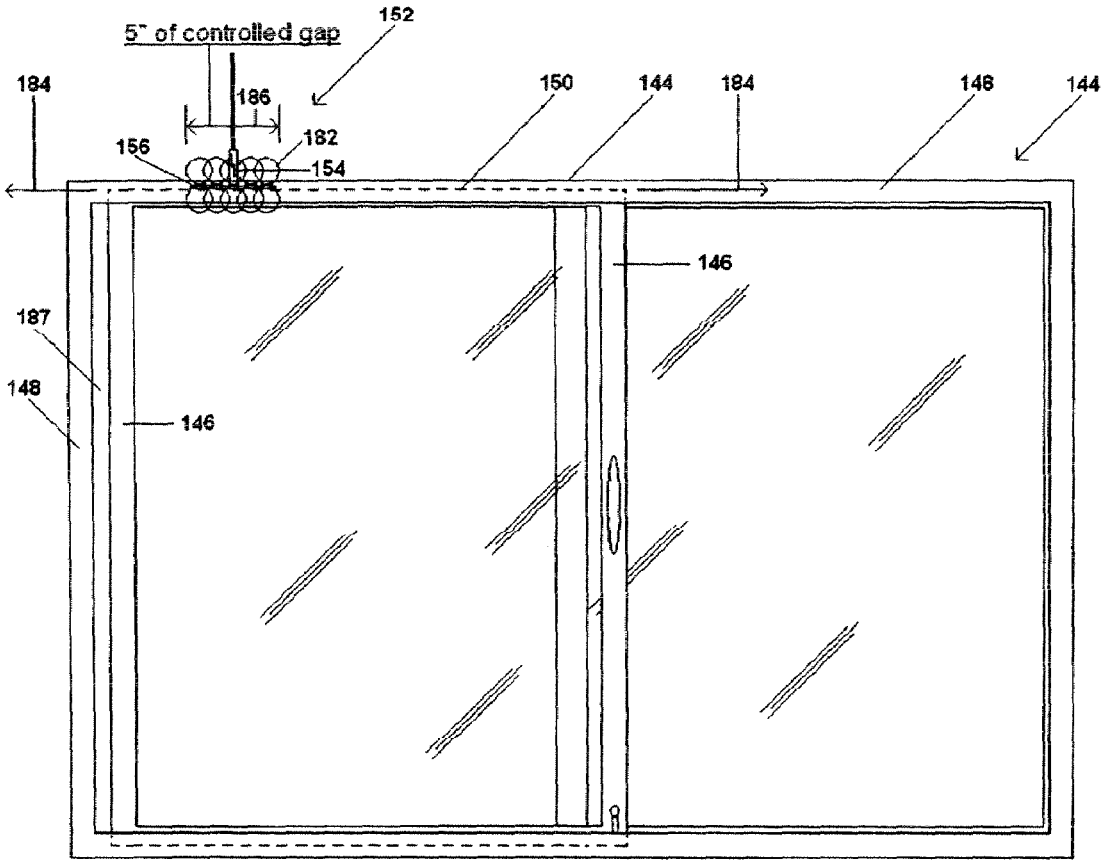
FIGS. 14 and 15 are front plan views of the window assembly shown in FIG. 12, illustrating the operation of the magnetically actuated apparatus with the enhanced magnetic actuator of the present invention.

FIG. 14 represents a vented sliding glass window assembly 144 as shown in FIGS. 12 and 13, in the partially open condition. In the partially open condition, the first member 146 has been displaced relative to the second member 148 toward a side (i.e., to the right of the paper). Moving the first member 146, causes the magnetic assembly 156 to move laterally along the axis 184, taking with it region 182. As shown, the window is opened about 2 and ½ inches to the right, thereby creating an opening 187 between the edge of the second member 148 and the edge of the first member 146, which will permit air to enter in or through the opening 187. Notwithstanding the displacement of the support structure 148 relative to the support structure 146, sensor 154 remains in the electrically closed state because the contact 160 remains under the influence or disposed within the magnetic field of region 182. As a result, the domain orientation of the reed 160 will remain magnetized and magnetically attract reed 158. Accordingly, the alarm will continue to sense the electric current flowing through sensor 154. The continuous flow of electric current can be interpreted volts to maintain the alarm in the ready state, i.e. not triggered.

Figure 15:
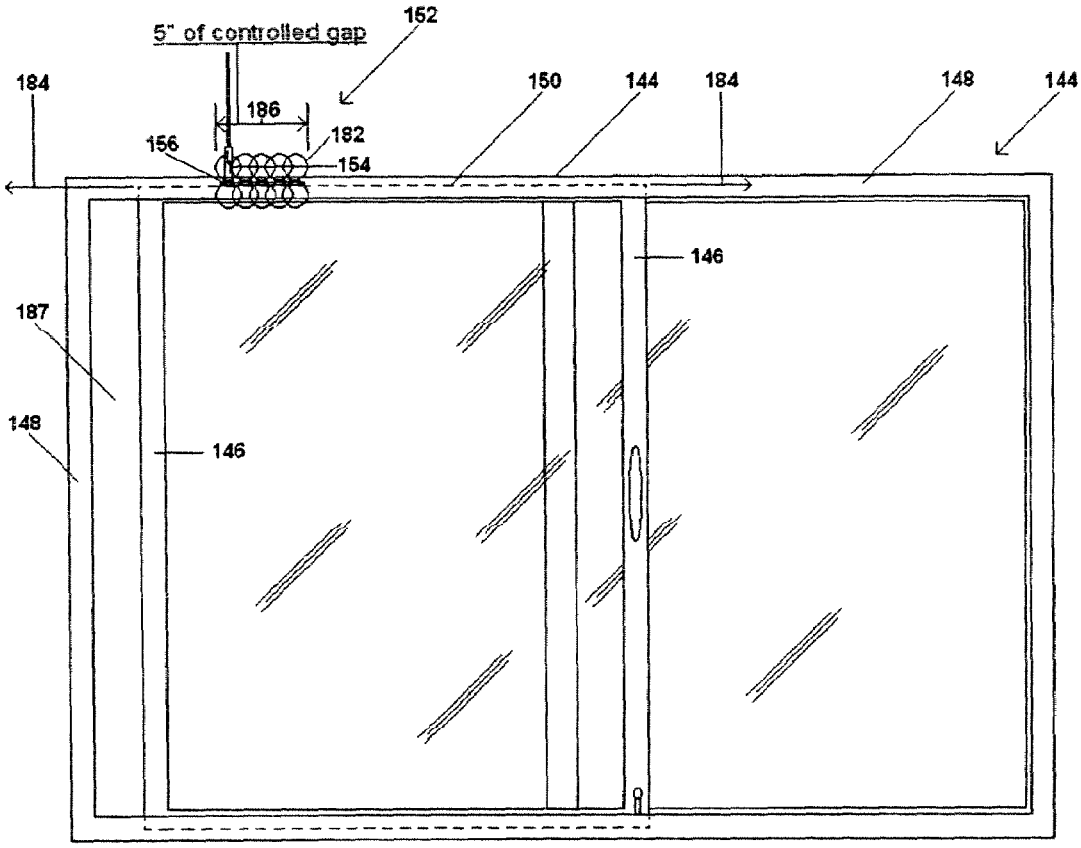

FIG. 15 illustrates further movement of the first member 146 relative to the support structure 148 to a fully vented condition. In this illustration, first member 146 has been moved an additional 2 and ½ inches toward the side of the second member 148 (i.e. to the right of the paper). In this position, contact 160 of the sensor 154 remains disposed in the magnetic region 182. As a result, the alarm is not triggered because the sensor remains in a closed condition even though the first member 146 has been displaced about approximately 5 inches, so that additional venting or air can be emitted into the hypothetical room. Notwithstanding the displacement of the first member 146 relative to the second member 148, the sensor 154 remains in the closed condition. The gap 186 thus permits venting of the window assembly 144 by allowing more air to enter through the window, which is not available with current industry standards.

Therefore, the present invention allows greater movement of one member relative to a second member to further define a wide gap magnetically-actuated device that is not available in the prior art. The use of the sensor 154 with the multiple, or plurality of aligned, alike overlapping magnets defines a greater gap 186 and break point distance that could not otherwise be achieved utilizing one magnet that is presently utilized in the art. The exemplary embodiment of the present invention as shown in FIGS. 12 to 15 is advantageously used to permit greater venting in window assemblies, door assemblies and similar types of closeable assemblies which might be preferable in the months of the year when it is desired to have greater magnitude of air to enter or exit a particular enclosed structure, such as a house or room. In addition, the present invention permits structures such as a window assembly to be closed to set an alarm, without having to ensure that the window is returned to its fully closed position or the position when the window assembly was installed. In other words, the wider gap 186 created by the use of multiple aligned, alike overlapping magnets permits the window to be moved to toward the side of the frame (i.e., to the left of the paper) without reaching the point in which edge of the first member has returned to its closed position, fully touching condition, as best seen in FIG. 15. Therefore, even if debris, paint, weather seals, and other foreign objects impede the ability of the window to be closed all the way, the alarm can still be set. Moving the window beyond five inches, will case the first member 146 to move beyond gap 186 because the magnetic region 182 no longer influences the domain orientation of the contact 160. Once contact 160 loses its magnetism, it will release contact means 158 and the flow of electricity to alarm system is broken. Once the flow of electricity is broken, the alarm system will not register the current, which can be interpreted as a condition to trigger the alarm.

It should be understood that the present invention can be adapted to apply to any assemblage in which one part is adapted to move relative to another part. For example, it is contemplated that the first movable member can be any support structure, piece of material, part of a machine, or component that is capable of being moved or displaced relative to a second member. The second member can be any support structure, piece of material, part of a machine, or component that mechanically or electrically interacts with the first member, such as two parts that are capable of sliding or displacing from a first position to a second position relative to one another in any given dimension or direction. Therefore, it should be understood that the present invention has many applications, and is not limited to use in window assemblies, overhead doors, or door assemblies as illustrated in the drawings.

Figure 16:
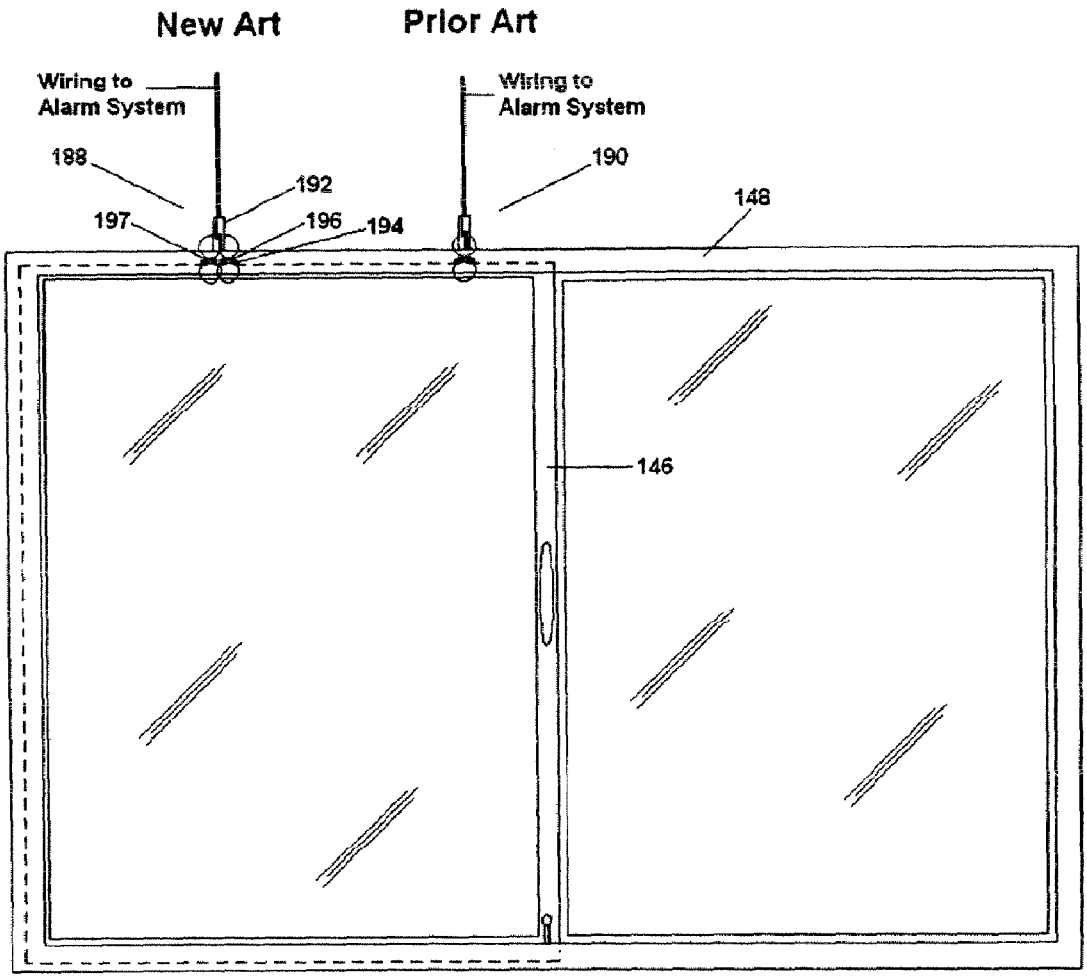
FIG. 16 is a front plan view of a window assembly, showing the installation of a magnetically actuated apparatus comprising a reed switch and an enhanced magnetic actuator of the present invention, juxtaposed to a prior art proximity device having a reed switch and prior art magnet.

The advantages of the present invention over the prior art is further illustrated in FIGS. 16 to 18. As shown in FIGS. 16, 17, and 18, a magnetically actuated apparatus 188 of the present invention is shown in comparison to the prior art proximity device 190. Apparatus 188 comprises a sensor 192 and magnetic assembly 194 comprising a plurality of aligned, alike permanent magnets (two shown) 196 and 197.

Sensor 192 is mountable to the second member 148 for opening and closing an electric circuit wired to an alarm system. Sensor 192 has a magnetically actuated control means for controlling electric current flowing to the electric circuitry of an alarm system in response to magnetic flux. The control means is preferably, but not necessarily, a reed switch having an open state and a closed state. As best seen in FIGS. 17 and 18, the control means comprises a first reed 198 and a second reed 200 that are electrically wired to an alarm system and are shown in a closed condition. In the closed condition, reeds 198 and 200 are in contact to one another so that electricity can flow to the alarm system. Because the operation of a reed switch is known by those of ordinary skill in the art further description is not necessary.

Reeds 198 and 200 are controlled by magnetic assembly 194, which is a further example of a magnetic actuator contemplated by the present invention. The magnetic assembly 194 is mountable to the first member 146. Each magnet 196 and 197 are arranged adjacent to one another having alike, opposed magnetic fields of opposite polarity of a given magnitude. The magnetic fields of the magnets 196 and 197 overlap or are in close proximity to one another to combine to form a first and second effective magnetic actuator fields of opposite polarity 202 and 204. Each effective magnetic field 202 and 204 is capable of moving the control means intermediate the open state and the closed state, wherein each magnetic actuator field has a given magnitude of magnetic flux that is greater than the magnetic flux of any one of the magnets 196 and 97. As shown in FIG. 17, a combined magnetic actuation field 202 is oriented normal to reeds 198 and 200.

The prior art device 190, by comparison, has a reed switch 206 that is axially aligned with a permanent magnet 212. The reed switch 206 is mounted to the first support member 148 and has a first reed 208 and a second reed 210 made of magnetizable material. Reed 210 responds to a magnetic field 214 emitted from magnet 212. The magnetic field 214 of magnet 212 magnetizes reed 210 so that it is attracted to reed 208 through magnetism. When reed 210 is biased, it will contact reed 208 such that sensor 206 is in a closed condition, thereby permitting electric current to flow through to the alarm.

As shown in the FIGS. 17 and 18, the advantages of the present invention over the prior are is illustrated. As shown in FIG. 18, the first member 146 is displaced approximately ½ to ¾ of an inch toward the right. The movement of first member 146 is representative of several movable closure structures, similar to the locking play that might be built into a window assembly. Some windows and doors may have as much as ¾ of an inch or more of movement when locked. When the first member 146 is moved beyond ¾ of an inch, the prior art proximity device and reed switch 206 will move from a closed condition to an open condition (See FIG. 18) because the reed 210 is no longer exposed to the magnetic field 214 of magnet 212. As a result, the alarm system to which reed switch 206 is attached will change electric condition. The change in electric condition can be interpreted as a basis to trigger the alarm.

By comparison, there will be no change in condition of the alarm system that is connected to the apparatus 188. Apparatus 188 will not change condition because, notwithstanding the displacement of the first member 146 relative to support structure 148 approximately ¾ of an inch, reed 200 remains exposed and influenced by the magnetic field 202 of the magnetic assembly 194. Therefore, the apparatus 188 of the present invention provides greater movement of the magnetic actuator device, and thus greater movement of the support structure 146 relative to second member 148 in comparison to the movement permitted by the prior art proximity device 190 or the use of one magnet. The present invention thus allows a first support member to move relative to a second support member a distance having a magnitude that is greater than the magnitude that is obtained using the single magnet. As such, those of ordinary skill in the art will appreciate that the present invention provides greater flexibility in designing systems that will be applied to closure systems whose normal movement exceeds current gap standards, such as windows, doors and the like.

Referring to FIGS. 19 to 23 an alternative embodiment of a magnetic apparatus 216 is shown for use in an overhead door assembly. Apparatus 216 has a control device 218 and a magnetic actuator 220 that operate relative to one another. The control device 218 operates in response to external stimuli, such as a magnetic field to control the flow of electric current, similar to a switch. The control device preferably comprises, but not necessarily, a sensor such as a reed switch 224 that is contained in an oval or oblong shell 222 made of any suitable material. Shell 222 is hollow having an interior in which a glass tube of the reed switch 224 is disposed. Reed switch 224 comprises a first reed 226 and a second reed 228 that are each electrically connected to at least one wire of an external electronic device, 230 and 232, that are contained in an armored cable or shell 234 that is connected to an alarm system (not shown). Reeds 226 and 228 defined the longitudinal axis of the reed switch 224.

Reeds 226 and 228 are actuated by a magnetic actuator 220. The magnetically actuator 220 preferably, but not necessarily, comprises a magnetic assembly having a series or multiple, aligned alike overlapping magnets 236 to 240. The magnets 236 to 240 are mountable to a first member 242 spaced apart from each other along an imaginary axis (M-M') that is normal to the longitudinal axis of the reed switch 224.

Figure 19:
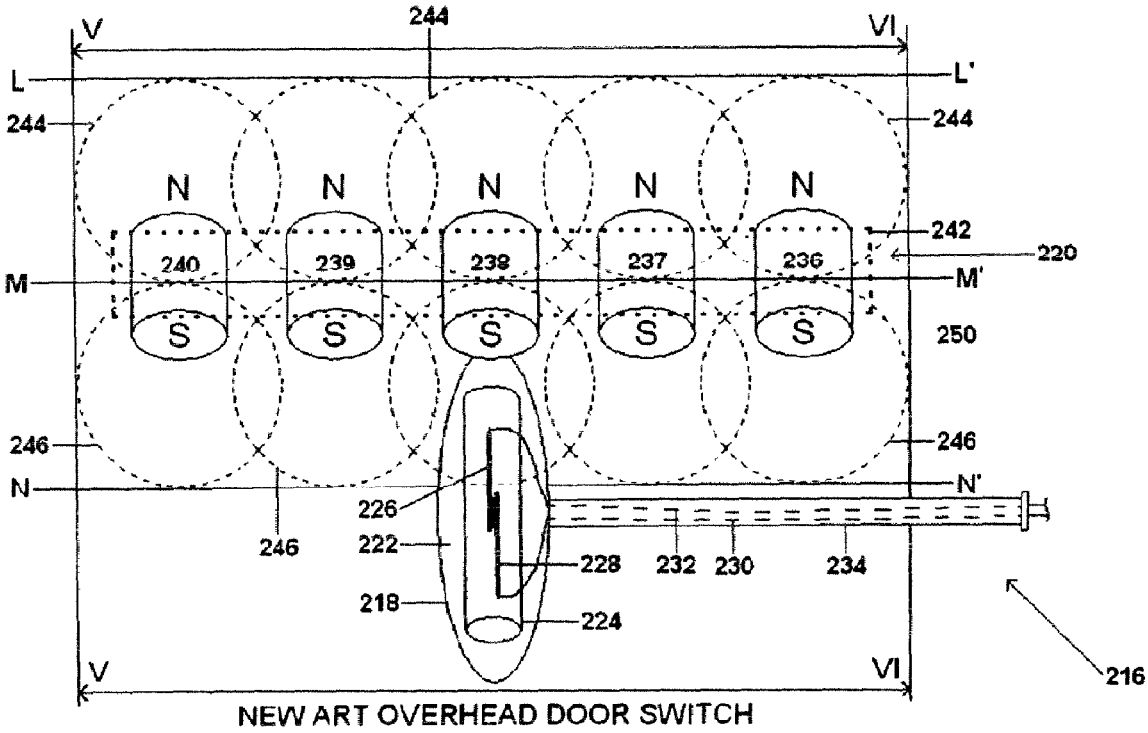
FIG. 19 is a perspective view illustrating a magnetically actuated apparatus of the present invention for use with an industrial overhead door of conventional construction, comprising a control device and an enhanced magnetic actuator of the present invention.

Each magnet has a magnetic field defined by either a north pole and a south pole that face side by side each other. The magnetic field of each magnet has magnetic flux of a given magnitude and direction. The magnets 236 to 240 are axially aligned in a row and are spaced closely enough to one another to such that their respective magnetic fluxes overlap and touch each other to define an effective magnetic field or magnetic actuator region, having a north component 244 and a south component 246. The magnetic actuator region 246 actuates reeds 226 and 228. Preferably, as shown in FIG. 19, region 246 of the magnetic actuator extends intermediate sides defined by M-N to M'N'. The magnitude and direction of region 246, which can also be referred to as an actuation area, further defines a gap and associated break distance, shown in broken lines to illustrate the fact that their magnitude and dimension is variable.

The embodiment of the apparatus 216 shown in FIG. 19, shows a new embodiment and direction in the prior art. In particular, the orientation of the control device 218 relative to the magnetic actuator 220 is novel, particularly in the context of an overhead door assembly. That is, in the embodiment shown in FIG. 19, the control device 218 is mountable normal to the magnetic actuator 220. The reed switch 224 is mounted in the center of region 246. This allows for the factory play adjustment that is built into the curtain guide support tracts that hold the overhead door in place (See FIG. 20). The control device 218 is mountable on a first support structure, such as floor adjacent to the door, between V to VI on the plane defined by M to M'. The magnetic actuator 220 can thus be displaced horizontally along an axis parallel to the line V-VI. This displacement will not change the electrical condition of the magnetic reed switch and covers the natural adjustment play that the overhead door manufacturers build into their overhead doors. The orientation and location of the control device 218 as illustrated in FIG. 19 represents a change in the art, because the current art has the reed switch mounted parallel to non-alike magnetic fields (See FIGS. 4 to 6). The prior art design does not allow for the factory adjustment play build into the support rails. The use of aligned, alike magnetic fields of the magnetic actuator 220 are positioned between about approximately 85° off the center of the control device 218 to 0° off the tip of reed 226. This encompasses about 85° of movement. The controlling aligned alike overlapping fields acts as one large magnetic field between MN to M'N'along the plane parallel to line V to VI, though the use of multiple magnets.

An opposing magnetic actuator region 244 is created along LM to L'M' along plane V to VI. This opposite field may be advantageously used to control the activation of one or more control devices (not shown). Therefore, it should be understood that the magnetic actuator 220 is not limited to the number of control devices or sensors that might be used as part of the present invention. This feature is advantageously used to compensate for the factory built in rail adjustments or play in an industrial door. This allows the door to move with the play and does not change the electrical condition of the reed switch 224, thus eliminating the potential of a false alarm caused by random door movements.

Figure 20:
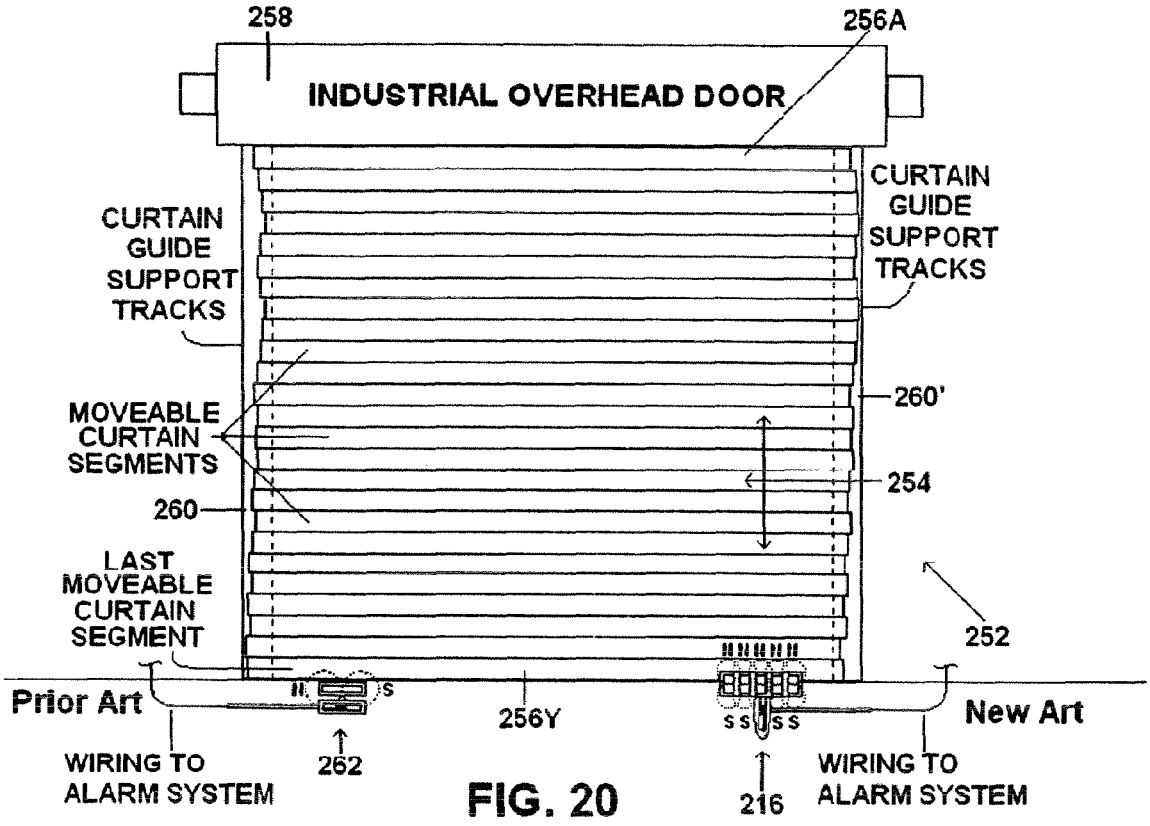
FIG. 20 is a plan view of an industrial overhead door of convention construction, showing the installation of the magnetically actuated apparatus shown in FIG. 19 juxtaposed to a prior art proximity device.

FIG. 20 shows apparatus 216 applied to an industrial overhead door assembly 252. The door assembly 252 comprises a door 254 that is comprised of a plurality of movable curtain segments 256*a* to 256*y* that are flexibly joined to one another so that the door 252 can be rolled into assembly 258 when the door is opened. Segments 266*a* to 266*y* are contained within a pair of opposed curtain guide support rails 260 and 260' that guide the movement of the door to housing 258. Segments 256*a* to 256*y* are displaced relative to one another to illustrate the play or adjustment that door manufacturers build into door assemblies.

Figure 21:
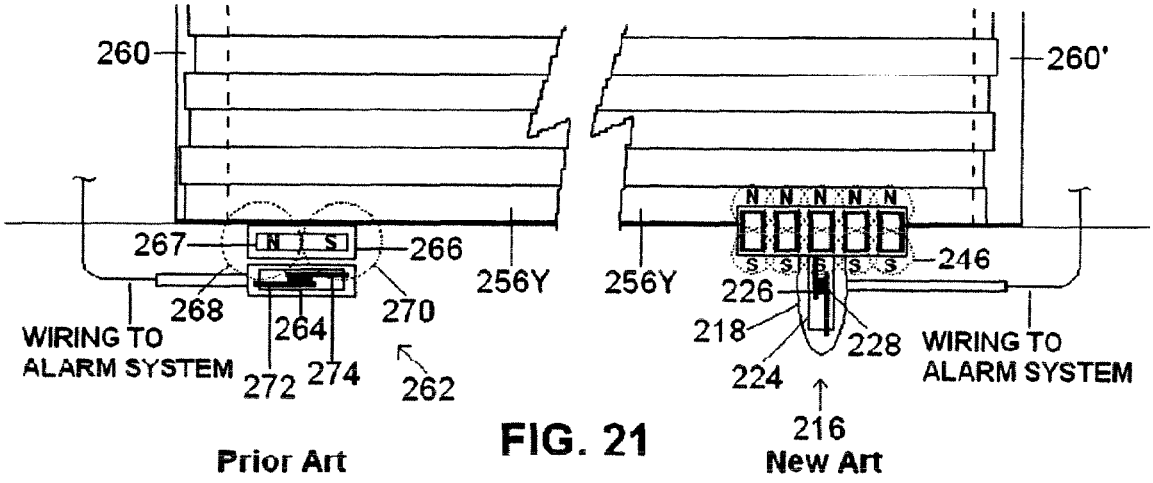
FIG. 21 is an isolated front plan view of the industrial overhead door shown in FIG. 20, illustrating the operation of the magnetically actuated apparatus of the present invention juxtaposed to the prior art proximity device.

Apparatus 216 of the present invention is shown relative to a prior art proximity device 262 assembly, of the type illustrated in FIG. 6A. In FIG. 21 the prior art proximity device comprises a reed switch 264 that is actuated by a magnet assembly 266. Magnetic assembly 266 has a magnet 267 that is disposed in a plane that is parallel to the reed switch 264. Magnet 267 has a north pole and a south pole that create a north and a south magnetic field, 268 and 270, respectively. Magnetic field 268 magnetizes reed 272 of reed switch 264 and magnetic field 270 magnetizes reed 274. As shown, reeds 272 and 274 are attracted to each other in the presence of a magnetic field to place the reed switch in a closed condition when the magnet is in the position shown in FIG. 20. In the closed condition, electric current can flow through reed switch 264 to the alarm system.

By comparison, the apparatus 216 of the present invention is also shown in which the reed switch 224 is disposed in magnetic field 246. As shown, magnetic field 246 magnetizes reed 226 so that it magnetically attracts reed 228. As a result, reed 228 moves toward or is biased toward reed 226 so that the reed switch 224 is in a closed condition, in which electric current can flow to the alarm circuit.

As shown in FIG. 21, door 254 is in the closed position, in which the last movable segment 256*y* is in the lowest most point. As shown in FIG. 21, when the segment 256*y* lands in an acceptable closed position for both switches, the reed switch 264 and 224 will be in their respective closed conditions to permit electric current to flow to the alarm system.

Figure 22:
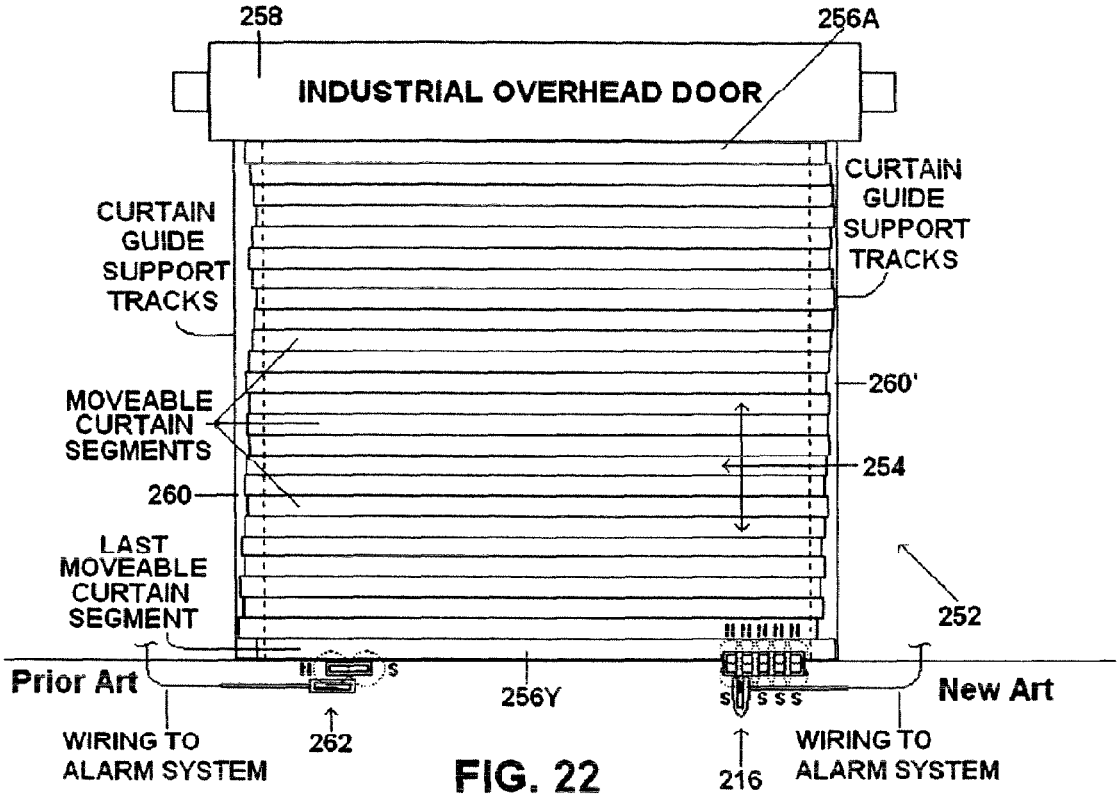
FIG. 22 is a front plan view of the industrial overhead door shown in FIG. 20, illustrating the application of the magnetically actuated apparatus of the present invention in which a normal circuit is maintained, juxtapose to the prior art proximity device illustrating a faulted circuit.
Figure 23:
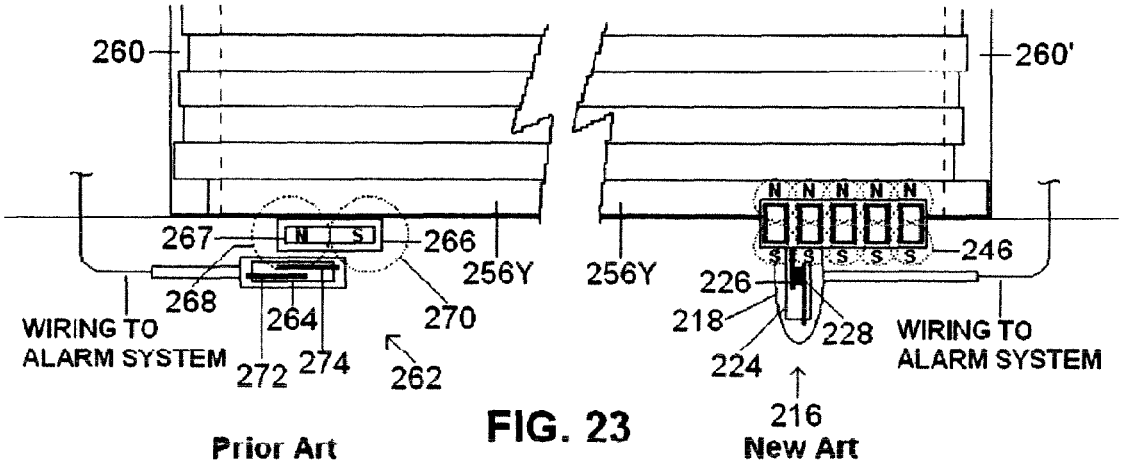
FIG. 23 is an isolated view of the magnetically actuated apparatus of the present invention shown in FIG. 22 in which a normal circuit is maintained, juxtapose to the prior art proximity device illustrating a faulted circuit.

Turning now to FIGS. 22 and 23, the industrial overhead door is shown in the closed position, but the last segment 256*y* has moved to the right. The last segment is displaced toward the rail 260' and is in position that is unacceptable for present prior art devices for purposes of setting the alarm. As best seen in FIG. 23, magnet 267 has shifted toward the right, such that only the north field 268 magnetizes both of the reeds 274 and 272. In the present design, both reeds 274 and 272 must be magnetized with opposite polarity for the switch to remain in the closed condition. When reeds 274 and 272 are equally magnetized by pole 267, the reed switch 264 will be in an open condition such that electric current cannot flow through to the alarm system. By comparison, the apparatus of the present invention maintains electric current that flows to the alarm system. As best seen in FIG. 23, the reed switch 224 remains magnetized by field 246 even though the lower most segment 256*y* has shifted to the right. As a result, electric current can continue to flow to the alarm system so that the alarm can be set. It should be understood that the present invention-allows more play in the movement of curtain segments or other types of movable members or support structures that can be advantageously used to control the flow of electricity to an electric circuit.

Figure 24:
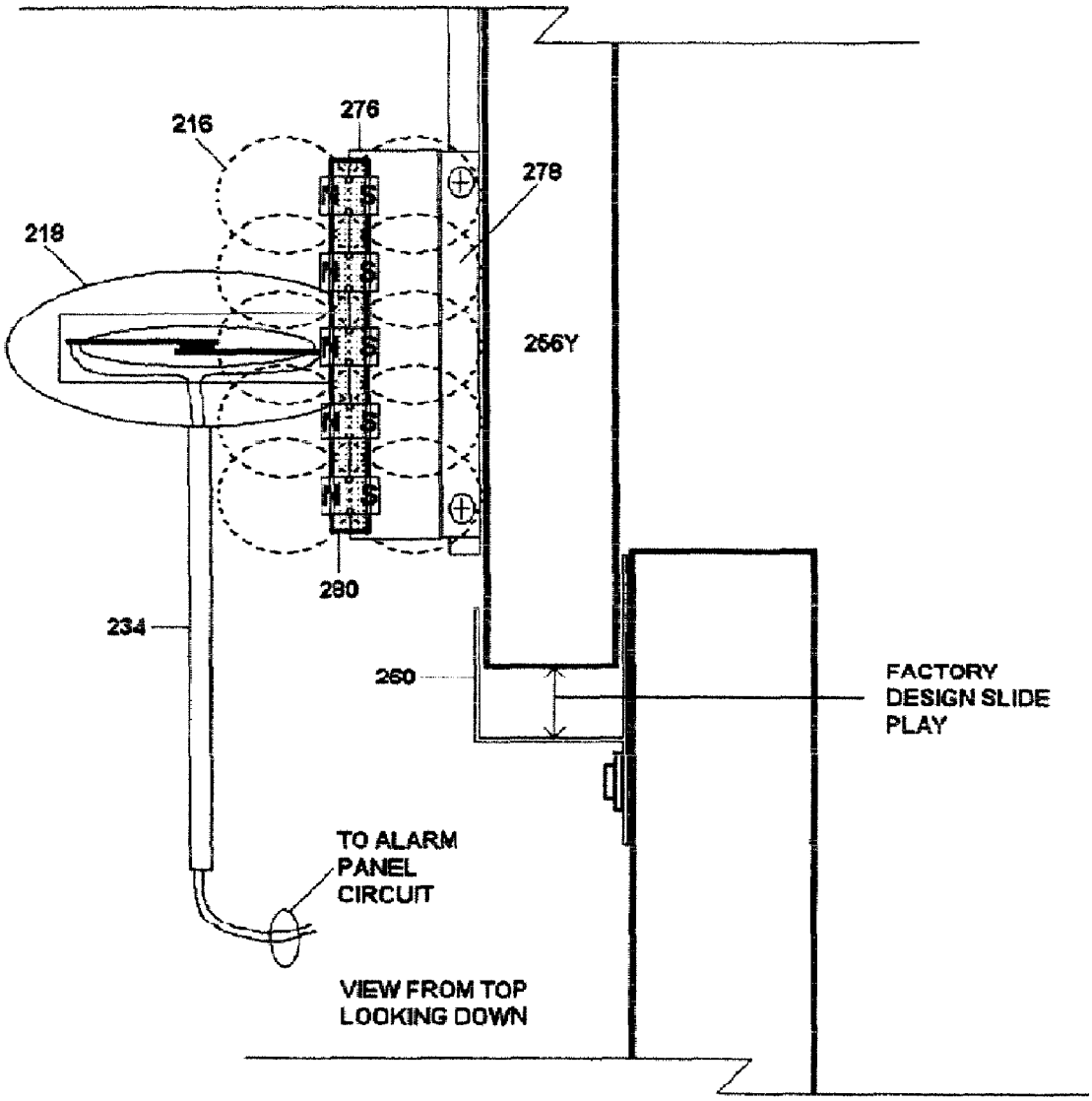
FIG. 24 shows an adjustable bracket assembly of the present invention.

Turning now to FIG. 24, an adjustable bracket assembly 276 for use with the embodiments of the present invention is shown. Assembly is provided so that the direction of the effective magnetic actuation field can be controllably adjusted. Adjustment of the effective magnetic actuation field may be required, when a closure support member of a segment of an industrial overhead door, as for example, has moved from its original installed position. Rather than attempt to realign the closure member or curtain, adjustable bracket can be used to relocate and redirect the direction of the effective region of magnetic field. This will aid in the fine tuning of the switch to the enhanced magnetic assemble.

Figure 25:
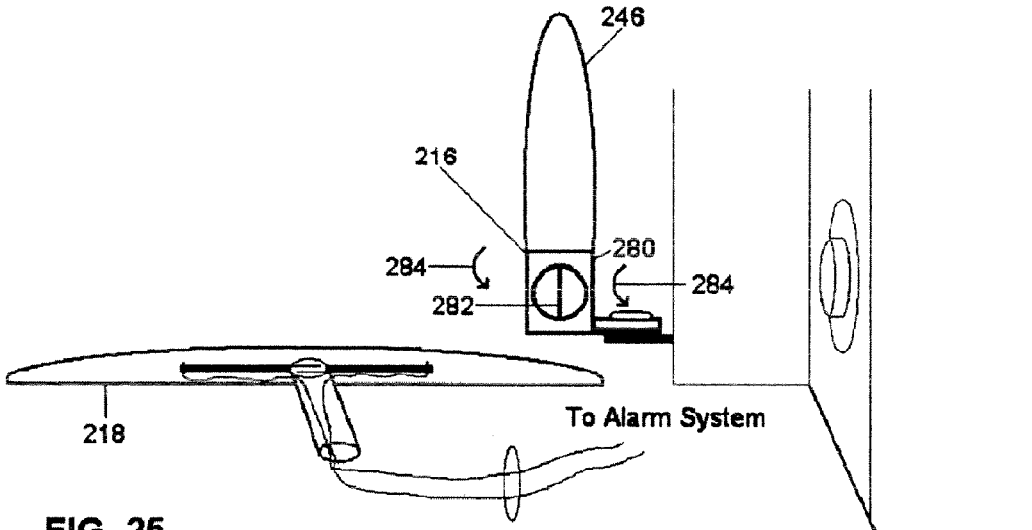
FIGS. 25, 26, and 27 are interior views illustrating the use of the adjustable bracket assembly shown in FIG. 24.
Figure 26:
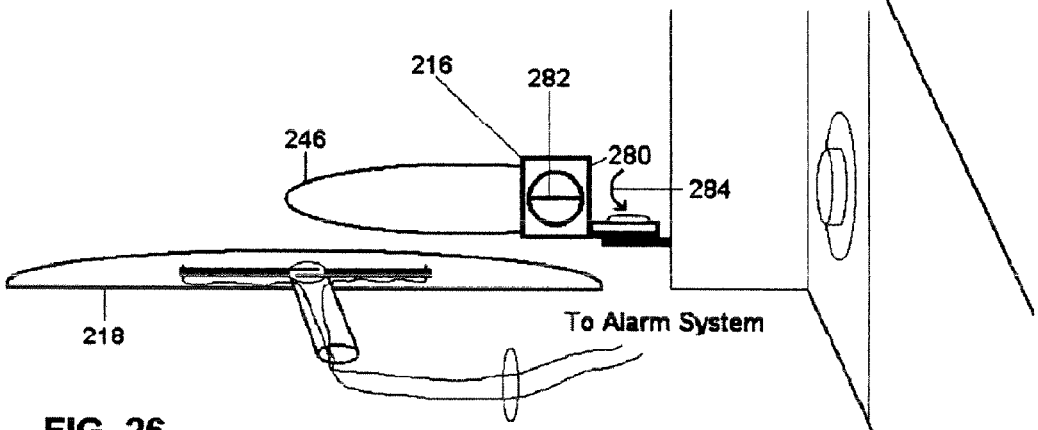
Figure 27:
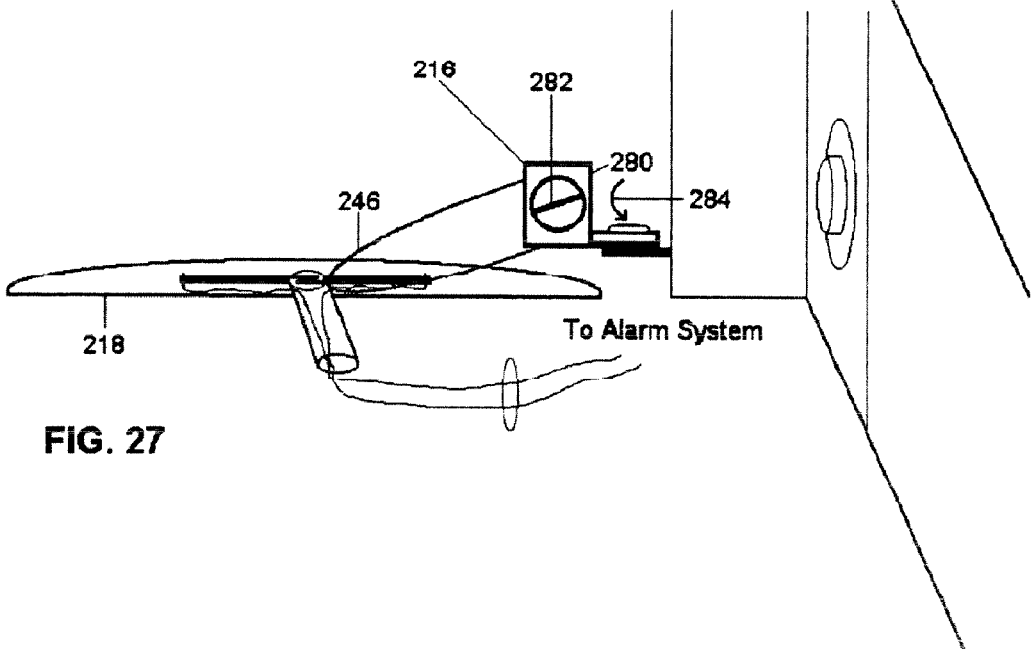

Adjustable bracket 276 is secured to curtain segment 256*y* by a base support using a pair of screws or other securing device. Base support 278 is positioned over sensor 218 that is fixedly secured to the floor. As best seen in FIG. 25, a releasable and rotatable assembly 280 is secured to base support by a suitable means, including screws, welding, nails, rivets, and the like. Rotatable assembly 280 forms a support member that is used to hold the plurality of aligned, alike permanent magnets. A manually operated knob or dial is used as an adjustment member 282 to control and rotate the effective magnetic field 246. As illustrated in the sequential steps shown in FIGS. 25 to 27, knob 282 can be rotated counter-clockwise in accordance with arrow 284 to change the direction of the effective field 246 by rotating until it intersects or is in a position to interact with switch 218, which allows for a completed electrical circuit. Although the operation of the knob 282 is operated manually, it is contemplated that the rotation of magnetic assembly 216 can be automated, using one or more actuators, such as pneumatically controlled devices, hydraulically actuated control devices or an electromagnetic device operated by an external control unit.

An alternate version of the embodiment of a magnetically actuated apparatus 300 is shown in FIGS. 28, 29, 30 and 31. The magnetic apparatus 300 comprises a control device 302 and a magnetic actuator or assembly 304. Instead of using multiple aligned alike magnetic poles, the magnetic assembly 304 comprises a uniquely elongated magnet 306 with specific polarity may be used as a magnetic actuator. The magnetic actuator 304 is positioned directionally to accommodate the wide gap that is necessary to protect some types of openings that have as much as an inch or more of lateral play in their locked position. These openings are prone to false alarms do to the limited gap abilities of prior art proximity devices. By using an elongated polarized magnet that is directional to lateral movement, a second structure or member can move with a wider margin which is currently not available in the current art today. The magnetic 306 is made of any suitable magnetic or magnetizable material, such as iron, steel, ceramic, rare earth, an alloy, and other materials capable of having a magnetic field. For example, the magnet 306 may be composed of a nedymium-iron alloy having a coercive force of about approximately 10,000 oersteds (more or less) and a magnetic flux density of about approximately 7,000 gauss. The magnitude of the coercive force and magnetic flux (i.e., strength) of magnet can vary, and depends largely upon the type of application that is desired. The present invention is not limited to a particular coercive force or magnetic flux, however, the magnet should generate a specific continuous magnetic field. It is contemplated that magnet can be replaced with material that is capable of generating a magnetic field, such as conductive material in which a electric current is passed or other magnetic means.

The magnet 306 is preferably, but not necessarily, mounted to a first support structure 308. The support member is any substrate, housing or material in which the magnet is capable of being reasonably secured and held in place. Broken lines are shown to illustrate that the substrate can have any shape or size. Accordingly, the magnet 306 can be mounted by itself or mountable in many types of suitable housings, non-magnetic dielectric material or insulator materials such as plastics, resins, foam, and non-ferocious metals such as cast aluminum or even wood. Preferably, the magnet 306 is coated with epoxy or some other type of sealing, securing material to prevent oxidation and corrosions. It should be understood that in addition to coating the magnet 306, the magnet 306 can be encapsulated in the housing to protect against degradation, breaks, chips and other type of damage. The magnet 306 can be secured using any securing means known in the art, such as adhesives, brackets and the like. The present invention is not limited to any particular shape or type of the magnet, of securing means or shape of the support member.

Figure 28:
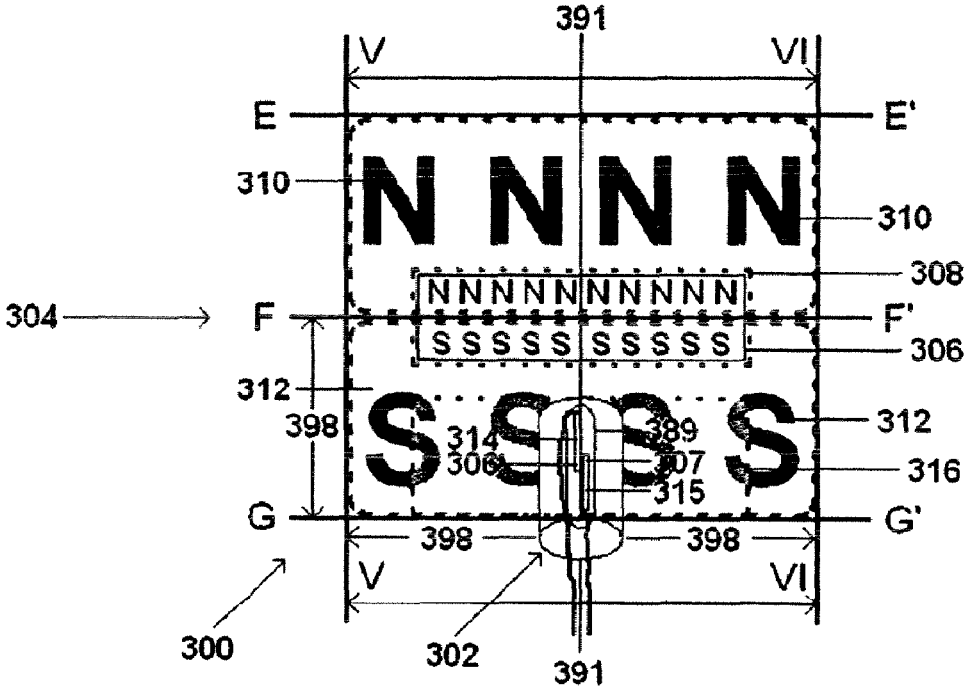
FIG. 28 shows an alternative embodiment of a magnetically actuated apparatus of the present invention, an elongated magnetic actuator with unique specific polarity, as used as a wide gap proximity device, with comparison to FIG. 9.

As seen in FIG. 28, the comparison of functionality is identical to FIG. 9. The difference between them is the controlling magnetic means. In FIG. 28 the magnetic 306 of an actuator 304 has replaced the aligned alike magnets 90 and 92 of FIG. 9. The exact same electrical function is obtained using either aligned alike magnetic poles or a uniquely elongated magnet with specific polarity. For the purpose of showing the similarities between the two only the magnets have changed in the demonstration of the two versions. All of the electrical attributes of FIG. 9 apply to the electrical attributes of FIG. 28. It is understood that do to the description of functionality of FIG. 9 it also applies to FIG. 28 and that no further explanation is necessary.

As best seen in FIG. 28, the magnetic actuator 304 operates in much the same way as the magnetic actuator 86 that is shown in FIG. 9. The magnetic actuator 304 has an effective region of magnetic flux having a north component 310 (identified by the letter "N") and a south component 312 (identified by the letter "S"). The magnitude of the north 310 component and the south 312 component are greater than the magnitude of any one magnet that is presently used in the prior art. As shown, the south component 312 is used to actuate a pair of reeds 314 and 315 of the control device 302. The south component has a magnitude that extends and lies between the region defined by lines F to G, G to G', G' to F'; and F' to F. It should be understood that the magnitude and direction of the effective region of the south component is not limited to two dimensions, but rather is extends in all dimensions. The north component 310 is similar, in that it has an effective region that extends in all directions and dimensions and is partially defined by lines E to F, F to F', F' to E' and E' to E. As such, a wider gap is available that extends along the line V and VI. This wider gap accommodates lateral movement or displacement of support structures and support members relative to one another.

Control device 302 is mountable to a second support structure 316 that is fixed. The first support structure 308 in which the magnetic actuator 304 is mounted is adaptable to displace or move relative to second support structure 316. The interaction between the magnetic actuator 304 and control device 302 operates in much the same way as the sensor 88 shown in FIG. 9 to control the flow of electric current to an alarm system (not shown), as discussed previously. As such, it should be understood that the effective region of magnetic flux 312 permits greater lateral movement of the first support structure 308 relative to the second support structure 316 and vice-versa. The use of an elongated magnetic bar 306 having opposed magnetic fields in the manner depicted in FIG. 28 is unique in the art because the present art teaches away from the use of large elongated magnets. Instead the physical monitoring industry utilizes smaller, compact sized magnets as part of present physical monitoring systems to supposedly increase the sensitivity of proximity devices to slight movement of one structure relative to another. As discussed previously, the use of such proximity devices having a low tolerance for movement is limited because those types of devices are not adapted to operate relative to the lateral movement of a first support structure relative to a second support structure along the line V to VI. It should be understood that the lateral movement, can be in any direction.

Figure 29:
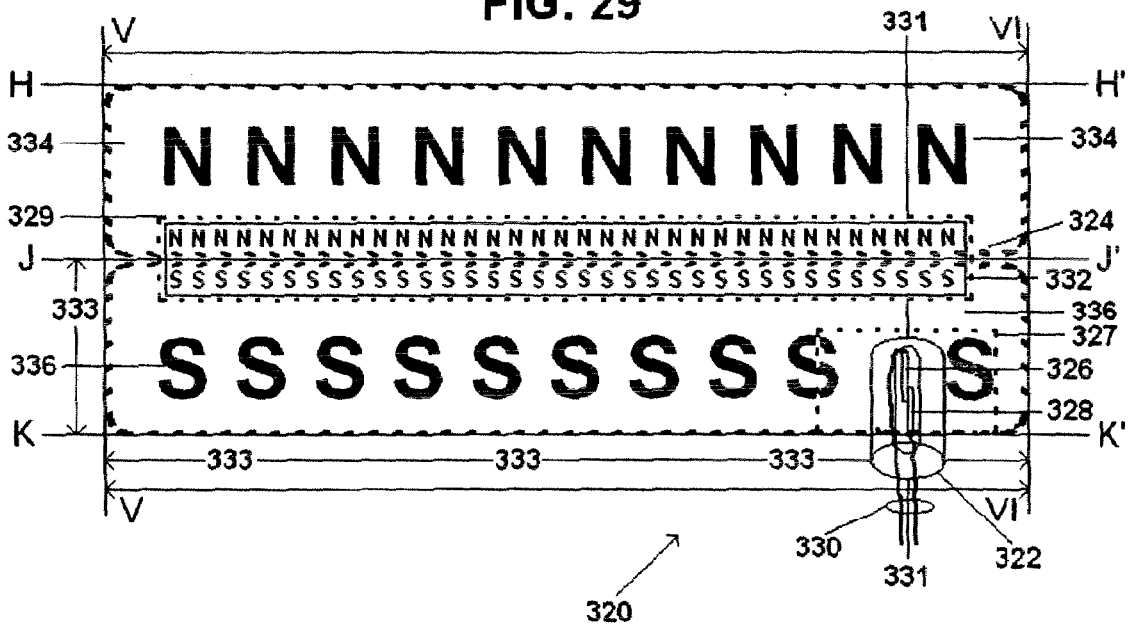
FIG. 29 shows an alternative embodiment of a magnetically actuated apparatus of the present invention having an elongated magnetic actuator with unique specific polarity with comparison to FIG. 10.

Turning to FIG. 29, an alternative embodiment of a magnetic assembly or apparatus 320 of the present invention is shown. The magnetic assembly 320 comprises a control device 322 and a magnetic actuator 324 that is provided to operate the control device 322. The control device is mountable to a first support member 327 and the magnetic actuator is mountable to a second support member 329, that is adapted to move or displace relative to the first support member 327. The second support structure is depicted by broken lines to illustrate that it can any shape or size. The control device 322 is preferably, but not necessarily, a sensor or switch having a pair of reeds 326 and 320 disposed in a glass tube that are electrically connected to a wire assembly 330 that is connected to a an electric circuit (not shown), such as the kind used in a physical monitoring system. The magnetic actuator 324 comprises an elongated magnet 332 having specific polarity of the type illustrated in FIG. 29. As shown, the magnet 332 has a north component (identified by the letter "N") and a south component (identified by the letter "S"), each having a given magnitude and direction. The magnitude of the north 334 component and the south 336 component are greater than the magnitude of any one magnet that is presently used in the prior art. As shown, the south component 336 is used to actuate reeds 326 and 328 of the control device 322. The south component has a magnitude that extends and lies between the region defined by lines J to K, K to K', K' to J' and J' to J The magnitude and direction of the effective region of the south component is not limited to two dimensions, but rather is extends in all dimensions. The north component is similar, in that it has an effective region that extends in all directions and dimensions and is partially defined by the lines, H to J, J to J', J' to H' and H' to H. As such, use of an elongated magnet of the type illustrated in FIG. 29 creates wider gap that extends along the line V and VI. This wider gap accommodates lateral movement or displacement of support structures relative to one another.

Figure 30:
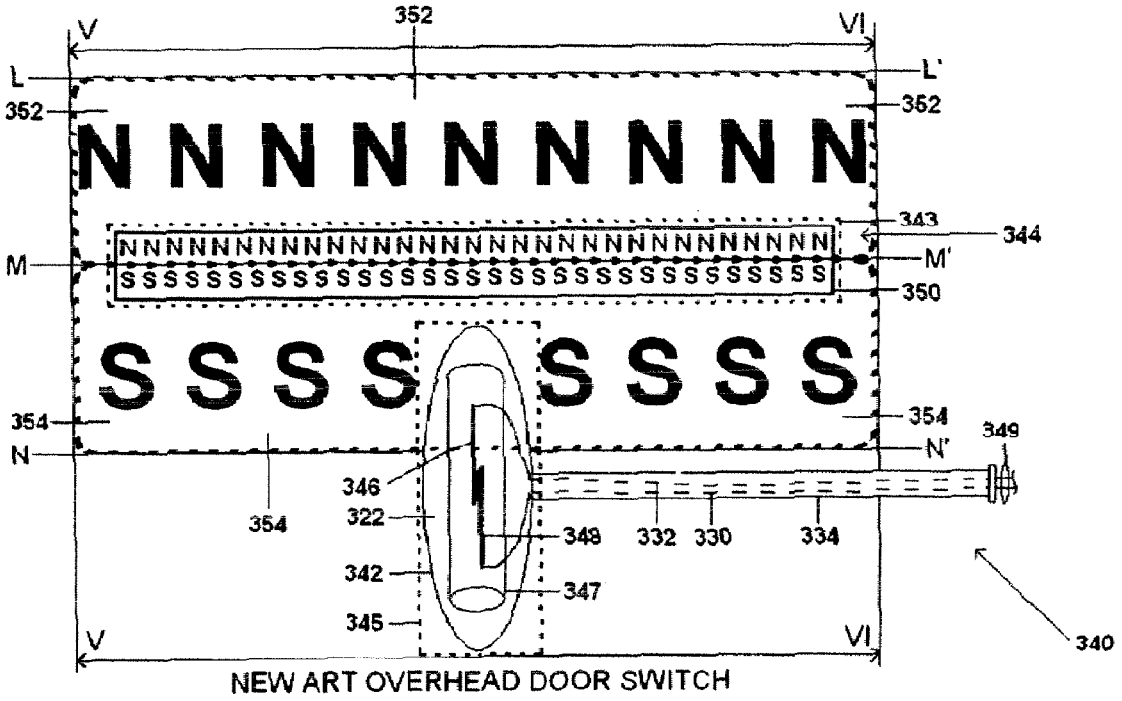
FIG. 30 shows an alternative embodiment of a magnetically actuated apparatus of the present invention having an elongated magnetic actuator with unique specific polarity with comparison to FIG. 19.

FIG. 30 shows an alternative embodiment of a magnetic assembly or apparatus 340 of the present invention is shown. The magnetic assembly 340 comprises a control device 342 and a magnetic actuator 344 that is provided to operate the control device 342. The control device is mountable to a first support structure 345, such as a floor. The magnetic actuator is mountable to a second support structure 343 that is adapted to displace or to move relative to the first support structure 345. The second support structure 343 is shown in broken lines to represent that it can be of any shape, type or form so long as the magnetic actuator is releasably secured thereto. In this embodiment, the magnetic assembly 340 is shown for use with an overhead door switch that is connectable to an alarm or a physical monitoring system. The control device 342 is preferably, but not necessarily, a sensor or switch having a pair of reeds 346 and 348 that are movably disposed in a glass tube 347 that are electrically connected to a wire assembly

349 having a pair of wires that is connected to a an electric circuit (not shown), such as the kind used in a physical monitoring system. The magnetic actuator 344 comprises an en elongated magnet 350 having specific polarity of the type illustrated in FIG. 30. As shown, the magnet 350 has a north component 352 (identified by the letter "N") and a south component (identified by the letter "S") 354, each having a given magnitude and direction. The magnitude of the north 352 component and the south 354 component are greater than the magnitude of any one magnet that is presently used in the prior art. As shown, the south component 354 is used to actuate reeds 346 and 348 of the control device 342. The south component has a magnitude that extends and lies between the region defined by lines M to N, N to N', N' to M' and M' to M. The magnitude and direction of the effective region of the south component is not limited to two dimensions, but rather is extends in all dimensions. The north component 352 is similar, in that it has an effective region that extends in all directions and dimensions, that lies between the lines, L to M, M to M', M' to L' and L' to L.

It should be understood that the elongated magnet has a predetermined, specific polarization along its lateral or longitudinal side, as illustrated in the exemplary embodiments shown in FIGS. 28 and 29. As shown, the elongated magnet can be made of any magnetizable material, such that the north poles are on one lateral side and the south poles are on an opposite lateral side. That is, the north poles and the south poles are disposed in opposed planes that are parallel to the longitudinal axis of the magnet. The elongated magnet is thus different that a typical magnet in which the north pole (identified by the letter "N") and the south pole (identified by the letter "S") are on opposite sides, such as to the left and right, and are joined about the halfway along the magnet. The use of an elongated magnet having specific polarity of the type illustrated in FIG. 28 creates an effective region or field of magnetic flux having a north component and a south component, each having a given magnitude and given direction that substantially duplicates the effective region of magnetic flux that is created using aligned, alike magnets, of the type illustrated in FIGS. 9, 10, and 19 and discussed previously herein. As such, it should be understood that the effective region of magnetic flux has a given magnitude and direction that is greater than the magnitude and direction of the magnetic flux that is created using a typical magnet. This allows the first support structure (or member) to be displaced relative to the second support structure (or member) a distance that is greater than or in excess of the displacement that can be obtained using one magnet. In addition, it should be noted that the effective region of magnetic flux is aligned in plane that is transverse to the axis defined by at least one contact member of the sensor or contact, similar to the manner in which aligned, alike magnets are oriented relative to the sensor, as depicted in FIGS. 9, 10 and 19.

Therefore, it should be understood in keeping with the scope of the present invention that the effective field of magnetic flux created by the elongated magnet operates as a magnetic actuator to actuate control devices, such as a contact, sensor or magnetic reed switches, similar to the aligned, alike magnets. Those of ordinary skill should appreciate that an elongated magnet can be made by controlling the domain orientation of each lateral side of magnetizable material to create a north component on one lateral side and a south component on the opposite side. Each lateral side of magnetizable material can be integrally joined to the other or separated by non-magnetizable material in order to create the elongated magnet having a north component and a south component of the type illustrated in FIGS. 28, 29, and 30. Other means for creating an effective region of magnetic flux is contemplated. In particular, it is contemplated that the elongated magnet can be created using an electromagnet to create an effective region of magnetic flux having a given direction and a given magnitude that duplicates the effective region of magnetic flux created by aligned, alike magnets. It is also contemplated that a device or elongated piece of material that can be magnetized to create an effective region of magnetic flux that is used to actuate a control device, falls within the scope of the present invention.

As such, use of an elongated magnet of the type illustrated in FIGS. 28, 29 and 30 illustrate the use of an elongated magnetic of a specific type that can be adapted to be used in the alternative to multiple aligned, alike magnets. The elongated magnets, similar to 306, 332 and 350, are constructed such that the magnetic fields will be on opposite sides to one another and aligned along a line that is normal to the reeds. Therefore, the magnet should be mounted to a support structure, such that at least one component of the effective region of magnetic flux in a given direction and a given magnitude will actuate the reeds to open or close to control the flow of current to the electric circuit which, in turn, can be used to set an alarm. Use of the elongated magnets creates a wider gap and break distance that is presently not available for use in physical monitoring systems of the prior art. Therefore, the use of the elongated magnet allows an electric circuit to be operated, even though there might have been a shift or displacement of a first member relative to a second member, such as a door moving out of its original alignment relative to a frame. In that way, the alarm system that is connected to the electric circuit can still be operated, despite any movement or displacement of the first member relative to the second member (and vice-versa) out of its initial alignment position. It should be understood by those of ordinary skill in the physical monitoring system and electrical arts that the electrical components of the control devices and the electric circuit operate in much the same way as the control devices and electrical circuits that were previously discussed with regard to the magnetic assembly or apparatus shown in FIGS. 9 and 9A and the other descriptions of the invention. As such, further description of the manner in which an electric switch and components operate in response to an effective magnetic field that is created by the magnetic assemblies or actuators of the present invention, is unnecessary.

Figure 31:
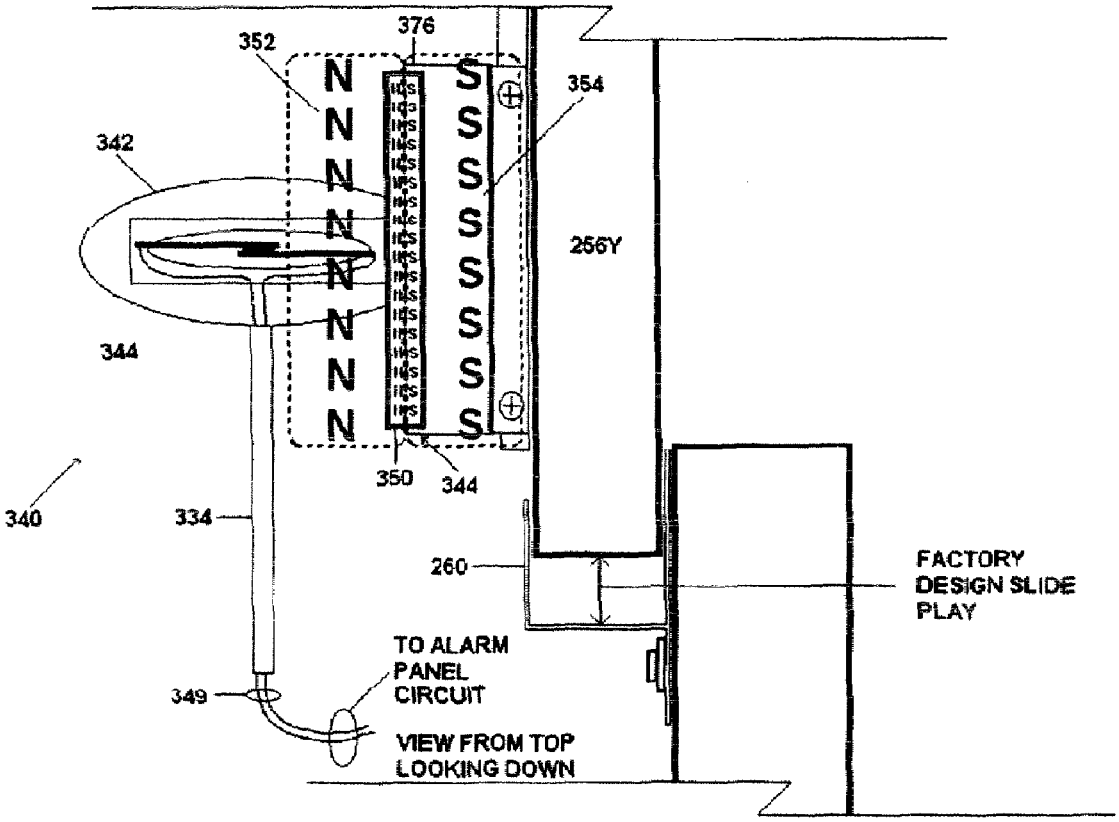
FIG. 31 shows an alternative embodiment of a magnetically actuated apparatus of the present invention having an elongated magnetic actuator with unique specific polarity with comparison to FIG. 24, as used with an overhead door

FIG. 31 further illustrates the manner in which the elongated magnetic bar 350 of the magnetic actuator 344 is viewed from the top of an overhead garage door looking downwardly (i.e., into the paper). As shown, the elongated magnetic 350 permits lateral play or displacement of the door segment 256*y* relative to the floor. Once again, the magnetic actuator 344 of the present invention increases the wide gap and permits greater lateral movement than previously accommodated using a single magnet of the type illustrated in FIG. 6A. It is understood that do to the description of functionality of FIG. 24 it also applies to FIG. 31 and that no further explanation is necessary.

By using an elongated magnet with specific polarity the process of lateral control is obtained similar to the use of aligned alike magnets that are not offered in the current art today. Doors and windows come in hundreds of selections from many different manufacturers. Not all doors and windows close the same. Double sliding glass doors for example lock in the center. When locked an inch or more of lateral play allows the doors to move left or right. The lateral play is designed into the door so that locking mechanism does not bind which would make the door difficult to use the locking mechanism. The lateral play puts the current art on its edge and can exceed its edge of operation. The current art has been found to be unstable do to vibration and temperature when sitting at the edge of operation.

In use, the magnetic assembly of the present invention demonstrates that a wide gap control is desired for the stability for alarm circuits, without compromising security. By increasing the stability of the alarm circuits, the number of false alarms that currently generated by the current art today can be reduced. This will have a significant impact to the responding authorities by not having to respond to nuisance alarms. This results in safer road conditions for local communities. In addition, it has been shown that it is desired to be able to allow air flow into a room while still being able to have the opening secured by the alarm system. The ability to be able to close the opening without having to reset the alarm system allows more flexibility than is offered by devices of the prior art. Furthermore, the wider gaps and break point distances allow the design and movement of overhead doors to exceed the current limitations of the prior art to reduce the number or the frequency of false claims.

Figure 32:
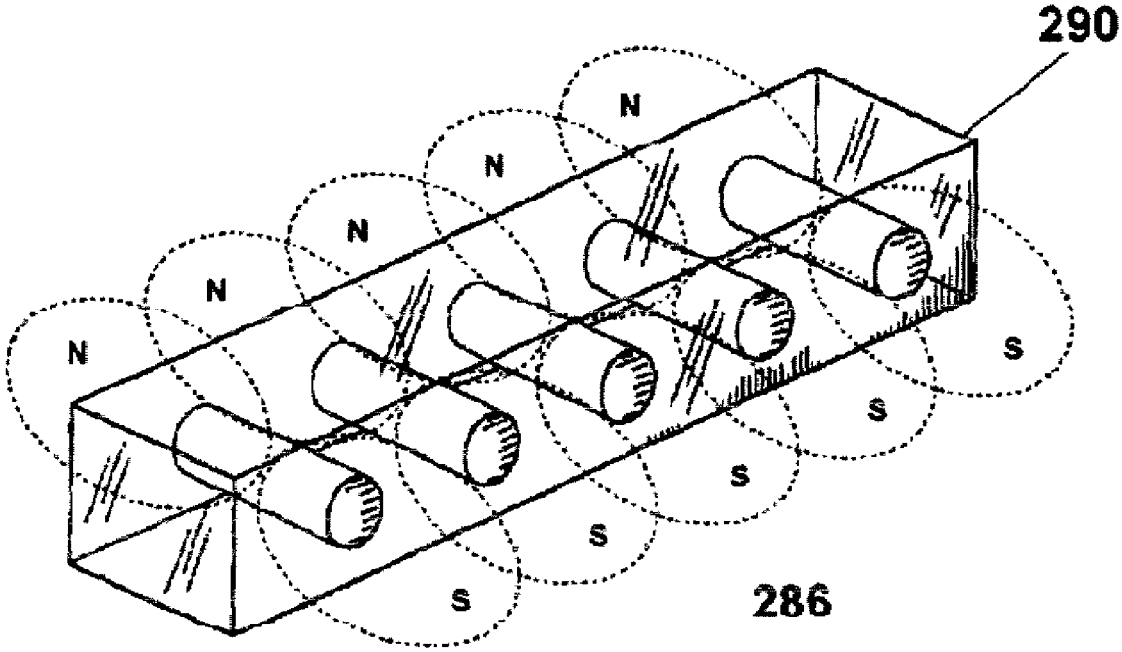
FIGS. 32, 33 and 34 are perspective views of alternative embodiments of the magnetic actuator of the present invention.
Figure 33:
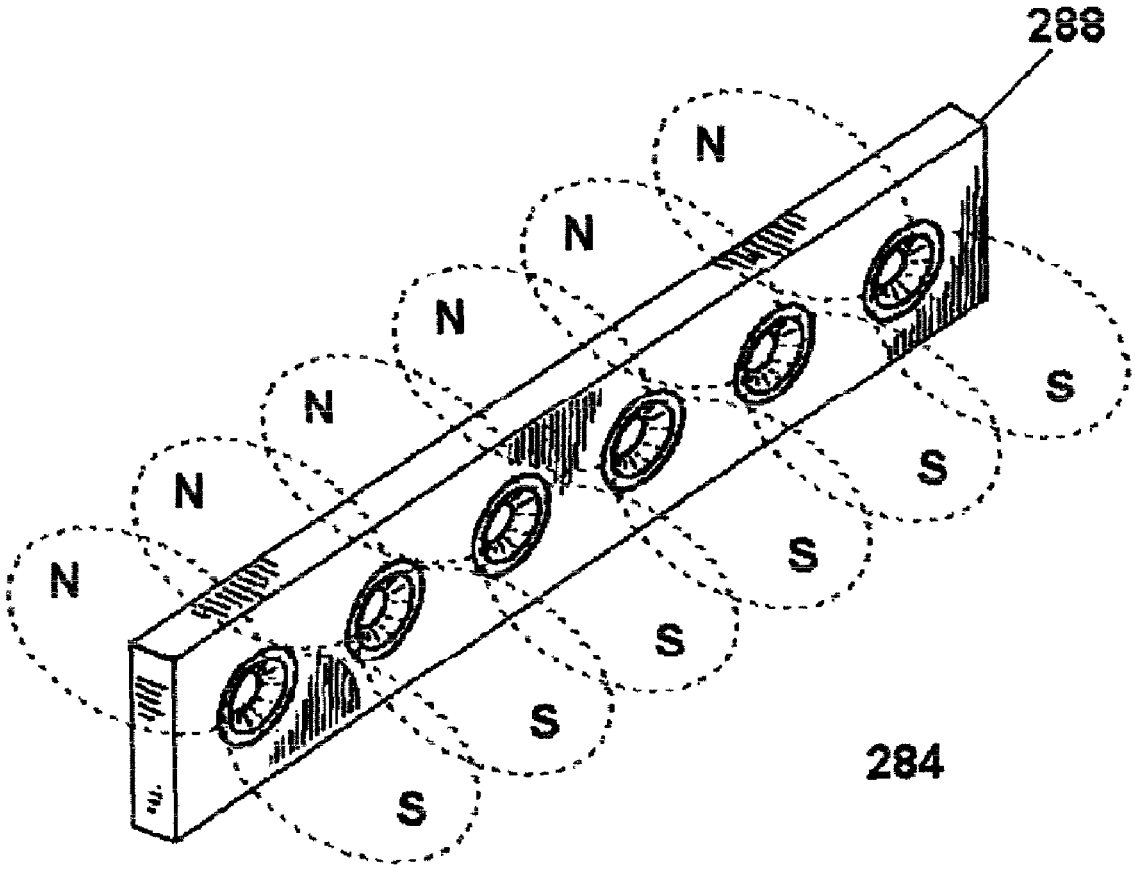
Figure 34:
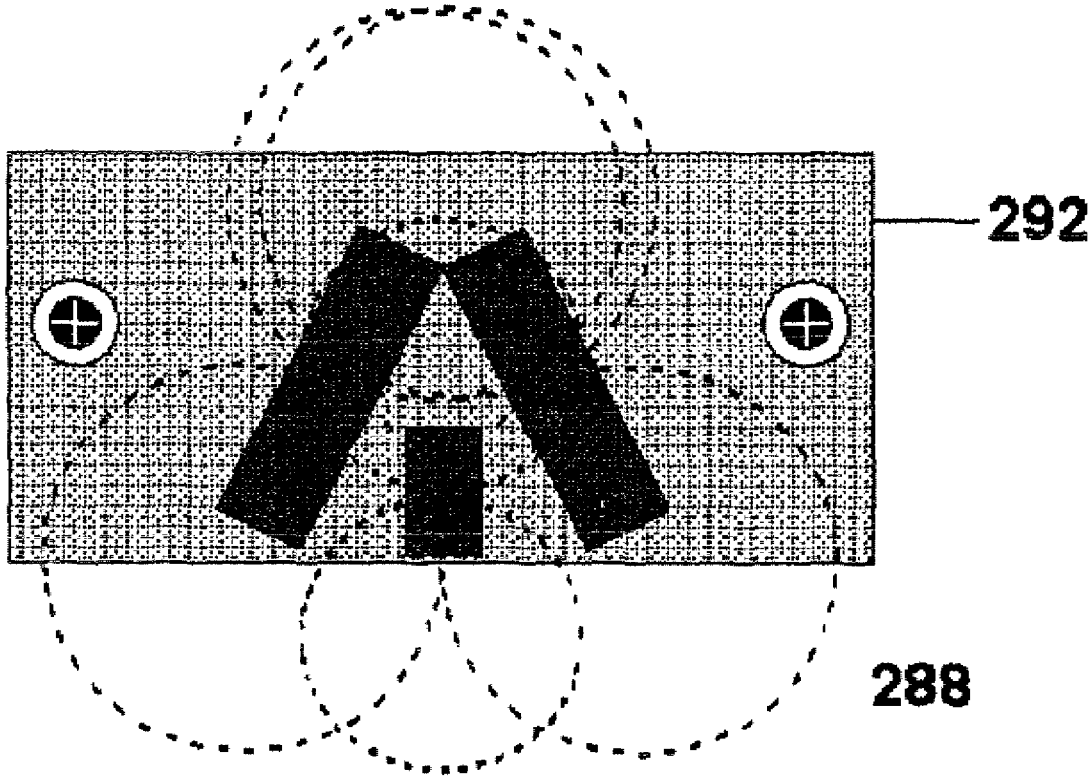

FIGS. 32, 33 and 34 illustrate alternative embodiments of enhanced magnetic assemblies 286, 284, and 288 mounted to a support member. These drawings illustrate that support member can be made of suitable material, such as wood 288, plastic 290 or alloy 292. Each support member 284 and 286 maintains the multiple, aligned alike biasing magnets in position in a row. Each magnet will generate a magnet field that has a given magnitude and a given direction that overlaps with the magnetic field generated by its neighboring magnet. The embodiments shown in FIGS. 32 and 33 are provided to illustrate the flexibility in the design of a magnetic assembly of the present invention.

The present invention may be embodied in other specific forms, as exampled in FIG. 34, without departing from the spirit or essential attributes thereof and, accordingly, reference should be made to the appended claims, rather than to the foregoing specification, as indicating the scope of the invention.

In FIGS. 35 through 37A examples of different types of designs are displayed to show how an elongated magnet can be constructed. There may be many shapes that could be configured; round, square, and rectangle are some that can be used. The one factor that they must have is the specific designated pole to create the lateral control.

Figure 35:
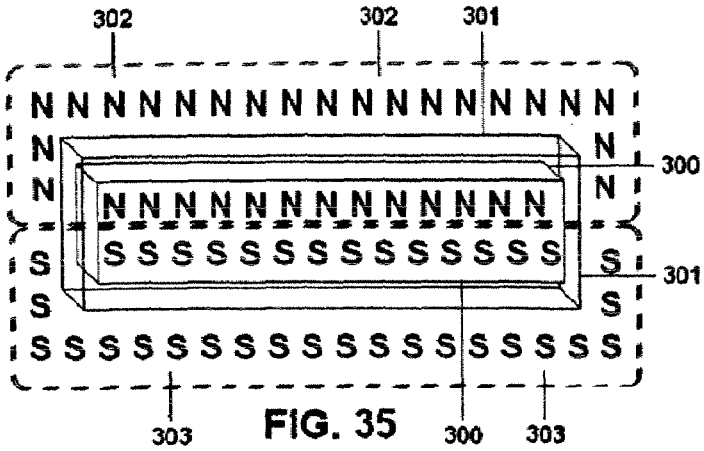
FIGS. 35. 35A, 36, 36A, 37 and 37A are examples of the different types of elongated magnetic actuators with specific polarity that can be used.
Figure 35A:
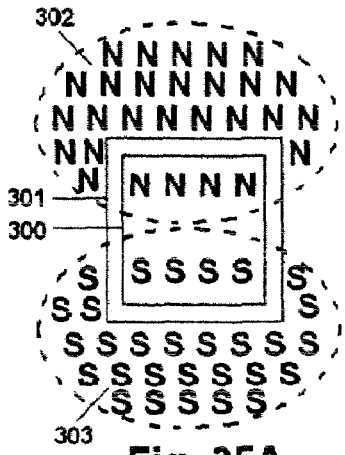

FIG. 35 and FIG. 35A shows an evenly squared elongated magnet 300 housed in a support assembly 301 with unique specific poles 302 (north) and 303 (south). FIG. 35 is a frontal view and FIG. 35A side view.

Figure 36:
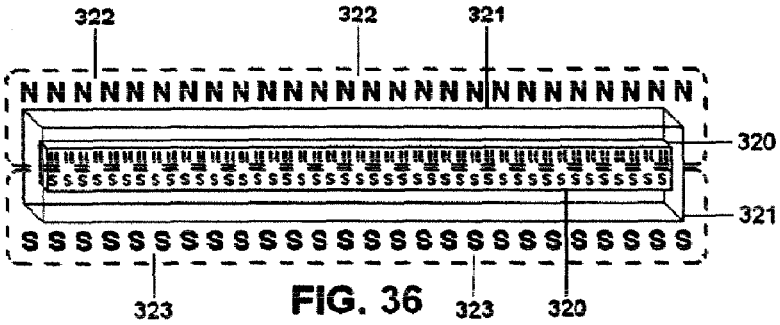
Figure 36A:
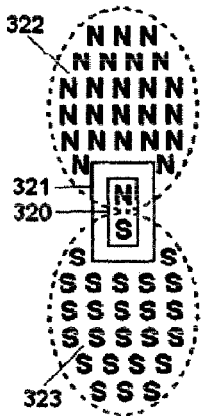

FIG. 36 and FIG. 36A shows a rectangle elongated magnet 320 housed in a support assemble 321 with unique specific poles 322 (north) and 323 (south). FIG. 36 is a frontal view and FIG. 36A side view.

Figure 37:
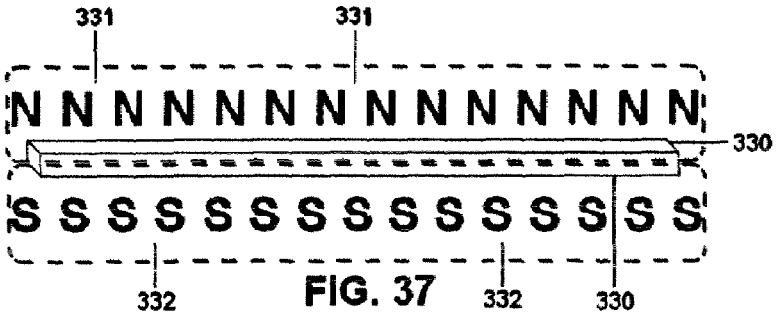
Figure 37A:
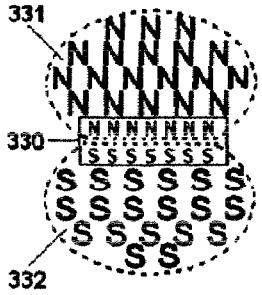

FIG. 37 and FIG. 37A shows a rectangle elongated magnet 330 without a support assemble with unique specific poles 331 (north) and 332 (south). FIG. 36 is a frontal view and FIG. 36A side view. Being that 330 can be constructed from one piece of specifically magnetizable material it would not have to be house in a support member. It could be secured to the movable support member directly with adhesives, brackets and the like.

The present invention may be embodied in other specific forms without departing from the spirit or essential attributes thereof and, accordingly, reference should be made to the appended claims, rather than to a foregoing specification, as indicating the scope of the invention. In addition, it is contemplated that the magnetic assembly for magnetically actuated control devices as described in the specification is not limited to use in physical monitoring systems. Rather, it is contemplated that the present invention can be used with any electrical circuit in which the flow of current is felt to be controlled. As such, it should be understood that the magnetic assembly of the present invention can be utilized to control the flow of current to infirm any type of electrical circuit, similar to what is commonly referred to as a switch. In addition, it is further contemplated that the magnetic actuator can be in the form of other actuating means for actuating or operating its associated control device. For example, an electro magnetic actuator may be used in place of a physical magnet in order to create an effective region of magnetic flux having a given magnitude and a given direction that is greater than the magnitude and direction of any one physical magnet. Moreover, the use of an electrically inter-connected device for creating a magnetic field may be used as an actuator means as part of the magnetic assembly.

As such, from the foregoing detailed description, it will be evident that there are a number of changes, adaptations and modifications of the present invention which come within the others of those of ordinary skill in the art. Accordingly, the embodiments shown in the drawings are for purposes of illustrating the manner in which the present invention can be applied without, however, excluding other applications that fall within the spirit and scope of the appended claims.

I claim:

1. An adjustable magnetic switch for controlling an electric circuit mountable to first and second support members, one of which members is movable, the switch comprising:

a control arranged to be secured to the first support member having at least one magnetizable contact means arranged for movement between a setting condition and a non-setting condition to control electric current to the electric circuit, the at least one contact means defining a contact axis, a magnetic actuator secured to the second support member; and an adjustable member secured to the movable one of said members;

the magnetic actuator exhibiting a magnetic field comprising first and second magnetic field portions wherein the first field portion comprises an elongated magnetic field of a given polarity in a desired direction defining a substantially continuous elongated magnetic actuation field portion of an extent of a given magnitude and elongated in a first direction that is substantially greater than the extent of the second magnetic field portion of the given polarity in a second direction transverse to the first direction, the first magnetic actuation field portion being normal to the contact axis for moving the at least one contact means between the setting condition and the non-setting condition, the adjustable member including an operative control member to adjustably control the relative direction of the first magnetic actuation field portion to the contact means axis, so that the movable one support member moves relative to the fixed support member a greater distance than is obtainable using a magnetic field corresponding to the extent of the second field portion, without a change in the setting or non-setting condition of the at least one contact means.

2. The switch as recited in claim 1, wherein the adjustable member is releasably secured to the second support member.

3. The switch as recited in claim 2, wherein the adjustable member includes a knob to adjustably control the direction of the magnetic actuation field.

4. The switch as recited in claim 2, wherein the adjustable member is secured to the second member by a bracket.

5. The switch as recited in claim 2, wherein the adjustable member is operated pneumatically.

6. The switch as recited in claim 2, wherein the adjustable member is operated by an actuator to automate the adjustment of the direction of the first magnetic actuation field portion.

7. The switch as recited in claim 1, wherein the first and second magnetic field portions comprise a plurality of aligned discreet alike magnetic fields, each of the aligned magnetic fields having opposed alike poles having magnetic flux of a given direction and magnitude.

8. The switch as recited in claim 7, wherein the contact means is a reed switch having a first contact member and a second contact member for forming an electric connection.

9. The switch as recited in claim 8, wherein the reed switch is wired to an alarm switch having an open state and a closed state for setting and triggering the alarm.

10. The switch as recited in claim 1, wherein said magnetic actuator has a lateral side and wherein the first elongated magnetic field portion of like polarity extends along the lateral side.

* * * * *